US007165619B2

(12) United States Patent
Fox et al.

(10) Patent No.: US 7,165,619 B2
(45) Date of Patent: Jan. 23, 2007

(54) SUBSEA INTERVENTION SYSTEM, METHOD AND COMPONENTS THEREOF

(75) Inventors: Preston Fox, The Woodlands, TX (US); John Goode, Arlington, TX (US); Ivan Iankov, Houston, TX (US); David Martin, Cypress, TX (US); Andrew Michel, Houston, TX (US); Ronald Yater, Houston, TX (US)

(73) Assignee: Varco I/P, Inc., Houston, TX (US)

( * ) Notice: Subject to any disclaimer, the term of this patent is extended or adjusted under 35 U.S.C. 154(b) by 595 days.

(21) Appl. No.: 10/368,762

(22) Filed: Feb. 19, 2003

(65) Prior Publication Data

US 2003/0178200 A1 Sep. 25, 2003

Related U.S. Application Data

(60) Provisional application No. 60/433,259, filed on Dec. 13, 2002, provisional application No. 60/425,399, filed on Nov. 12, 2002, provisional application No. 60/362,437, filed on Mar. 7, 2002.

(51) Int. Cl.
*E02F 29/12* (2006.01)

(52) U.S. Cl. ..... 166/343; 166/77.2; 166/75.15

(58) Field of Classification Search ..... 166/338, 166/339, 340, 341, 343, 345, 349, 351, 360, 166/366, 378, 77.2, 77.3, 77.1
See application file for complete search history.

(56) References Cited

U.S. PATENT DOCUMENTS

| | | | | |
|---|---|---|---|---|
| 3,182,877 | A | 5/1965 | Slator et al. | |
| 4,054,104 | A | 10/1977 | Haselton | |
| 4,899,823 | A * | 2/1990 | Cobb et al. | 166/351 |
| 4,943,187 | A | 7/1990 | Hopper | 405/190 |
| 5,002,130 | A | 3/1991 | Laky | |
| 5,890,534 | A * | 4/1999 | Burge et al. | 166/77.3 |
| 6,053,252 | A | 4/2000 | Edwards | 166/348 |
| 6,116,345 | A * | 9/2000 | Fontana et al. | 166/343 |
| 6,182,765 | B1 | 2/2001 | Kilgore | 166/381 |
| 6,488,092 | B1 | 3/2001 | Moss | |
| 6,276,454 | B1 | 8/2001 | Fontana et al. | 166/343 |
| 6,386,290 | B1 | 5/2002 | Headworth | 166/346 |
| 6,460,621 | B1 | 10/2002 | Fenton et al. | 166/347 |
| 6,488,093 | B1 * | 12/2002 | Moss | 166/339 |
| 6,659,180 | B1 | 12/2003 | Moss | 166/339 |
| 6,698,520 | B1 | 3/2004 | Fenton et al. | 166/347 |
| 6,763,889 | B1 | 7/2004 | Rytlewski et al. | 166/338 |
| 6,808,021 | B1 | 10/2004 | Zimmerman et al. | 166/381 |
| 6,843,321 | B1 * | 1/2005 | Carlsen | 166/355 |
| 2003/0000740 | A1 | 1/2003 | Haynes et al. | 175/57 |

(Continued)

*Primary Examiner*—Thomas A Beach
(74) *Attorney, Agent, or Firm*—Guy McClung

(57) ABSTRACT

The subsea intervention system (SIM) includes a BOP module 10 and CT module 20. A tool positioning system 76 is used for positioning a selected subsea tool 22 stored within a rack 18 with a tool axis in line with the BOP axis, while a marinized coiled string injector 80 is moved by positioning system 81 to an inactive position. Power to the subsea electric motors 162 is supplied by an electrical line umbilical extending from the surface for powering the pumps 164, with the hydraulic system controlled by power control unit 198. The injector 80 preferably includes a pressure compensator roller bearing 220 and a pressure compensated drive system case 254.

129 Claims, 59 Drawing Sheets

U.S. PATENT DOCUMENTS

2003/0155127 A1 8/2003 Carlsen ..... 166/368
2003/0178200 A1* 9/2003 Fox et al. ..... 166/341
2004/0094305 A1 5/2004 Skyaerseth et al. ..... 166/339

* cited by examiner

SUBSEA INTERVENTION SYSTEM, METHOD AND COMPONENTS THEREOF

RELATED APPLICATIONS

The present application incorporates by reference therein and claims priority from each of U.S. application Ser. No. 60/362,437, filed Mar. 7, 2002, application Ser. No. 60/433,259, filed Dec. 13, 2002 and application Ser. No. 60/425,399, filed Nov. 12, 2002.

FIELD OF THE INVENTION

The present field of the invention relates generally to a subsea intervention system and a method for performing subsea intervention operations. The invention further relates to improvements in the specific components of the intervention system and the interrelationship of those components in this and other intervention systems. The invention also relates to a subsea coiled tubing injector and, more particularly, to a subsea coiled tubing injector capable of achieving reliable operation at a relatively low cost, and preferably one with a pressure compensated drive system.

BACKGROUND OF THE INVENTION

Years of production experience have shown that close reservoir supervision and relatively minor well intervention procedures may dramatically increase the amount of oil recovered from a given reservoir. As one example, for water drive reservoirs the standard method of production is to perforate the pay zone an optimal distance above the oil-water contact. As the oil-water contact moves up, the bottom perforations are squeezed off. If necessary, new perforations are added higher in the wellbore. This method allows more reserves to be recovered in a shorter period of time and reduces the costs associated with disposing of produced salt water. In a low-pressure reservoir, this method may prove critical to the economic viability of the well. Slight increases in the WOR may greatly reduce the production rate or even kill the well.

For wells located on land or in and shallow water, close reservoir supervision and minor well intervention work is common practice. In deep-water subsea wells, however, the cost of performing even a minor well intervention is very high. The standard practice for performing a minor intervention requires a drilling rig to be mobilized on the well and riser to be run. In 7,500 feet of water, just the time to deploy and retrieve the riser may be 4 to 5 days each way. At a day rate of $250,000 to $300,000, the cost of even a simple workover can be in the range of $6,000,000 or more. This high cost often makes simple intervention work prohibitively expensive. Also, there may be a considerable amount of production time lost while awaiting the availability of a suitable deepwater rig.

A major oil company recognized the need for an alternative technique for performing intervention work on subsea wells using coiled tubing technology and contracted Applicant to run a development project to create and commercialize such a device. The gated project consists of three major phases: feasibility, detailed design, and manufacturing and testing. The primary goal for the first phase of the subsea intervention module (SIM) project was to perform a sufficient amount of engineering and design work to verify the feasibility of the system.

The subsea intervention module (SIM) is a subsea coiled tubing unit envisioned to provide an economical means for servicing subsea wells. Initially, the SIM was to be assembled and deployed off the back of a large workboat. After the requirements for the SIM were more fully defined, the size and weight of the SIM practically may require the use of a ship with a large moonpool.

U.S. Pat. No. 4,054,104 discloses the submarine well drilling system with drill pipes restored in a submerged vessel.

U.S. Pat. No. 4,899,823 discloses a method of placing a coiled tubing or wireline reel and injector on the deployment vessel and blow out preventers (BOP's), strippers, and a second injector subsea. While this solution provides an incremental step change, it requires the injector and lubricator travel back to the deployment vessel every time a new tool is used.

In the ExxonMobil provisional Patent Application No. 60/224,720, all of the required equipment is located subsea. This patent application presents the concept of a tool caddy device located between the stripper and BOP stack, allowing tools to be switched out subsea. The caddy consists of two sets of tubes containing the tools and capable of acting as pressure vessels. While this system is good, it requires at least 35 feet between the top of the BOP stack and the injector. It also adds a significant amount of weight to the structure and is somewhat limited in the number of tools that it can carry. U.S. Pat. Nos. 6,488,093, 5,002,130, and 4,899,823, and publication PCT No. 01/00342, U.S. Ser. Nos. 97/17,219 and 99/11,811, as well as publication U.S. Ser. No. 2002/0,040,782 A1 disclosed various subsea intervention systems.

A conventional coiled tubing injector may be positioned at the surface of a land-based well or in relatively shallow water of an offshore well, although positioning of the tubing injector in a moderate or deep water well is impractical for most offshore coiled tubing operations. Some injectors have utilized sealed bearings for both land and shallow water operations. Conventional dynamic seals in sealed bearing packages cannot, however, reliably withstand the hydrostatic sea pressure and high operating speeds encountered for a coiled tubing injector working in a deep water environment. According to one proposal, the subsea tubing injector is protected from the subsea environment by an enclosure, with seals provided between the enclosure and the coiled tubing above and below the injector. An example of this system is discussed in U.S. Pat. No. 4,899,823.

Coiled tubing has been reliably used in land-based hydrocarbon recovery operations for decades, since various well treatment, stimulation, injection, and recovery operations may be more efficiently performed with conveyed coiled tubing than with threadably connected joints of tubulars. In a conventional land-based operation, the coiled tubing injector may utilize a gear drive mechanism with conventional bearing assemblies to reliably and efficiently transmit power to the coiled tubing.

Conventional pipeline practice involves the launching of pigs to perform maintenance operations on pipelines. A pigging loop provides a closed circuit for the pigs to be launched and retrieved. Pigging is typically done to remove debris, such as paraffin or sand, which restricts the flow of production. A significant drawback to conventional pipeline techniques is the additional capital cost of the pigging loop, and the likelihood pigs getting stuck in the pipeline.

The disadvantages of the prior art are overcomed by the present invention, and an improved subsea intervention system and method, and components of such a system, are disclosed below.

SUMMARY OF THE INVENTION

The subsea intervention system and method, and the component of the system and individual steps of the method, overcome numerous problems associated with prior art intervention systems and methods. The summarization of the invention thus discusses individual features which may be used in both a preferred embodiment and in alternate embodiments of the intervention system, method, components and steps thereof.

A preferred embodiment of the subsea intervention system and method lower a selected tool from a variety of stored subsea tools through a blowout preventor and into the well. The blowout preventor has a BOP axis, and the selected tool is preferably lowered into the well on coiled tubing. The intervention system may then select to withdraw the tool from the well through the subsea blowout preventor and return the selected tool to the plurality of stored subsea tools. The system includes a subsea injector for moving the coiled tubing axially through the blowout preventor, one or more strippers, a tool positioning system for moving a selected tools from the storage position to a run-in position above the blowout preventor, with the tool axis substantially aligned with the BOP axis, an injector positioning system for moving the injector from the run-in position wherein the injector is above the blowout preventor with a injector axis substantially aligned with the BOP axis, to an inactive position for allowing the selected tool to occupy at least a portion of the BOP axis occupied by the injector when in the run-in position.

In a preferred embodiment, the tool positioning system and method move the selected tool in a first linear direction substantially perpendicular to the BOP axis from a storage position to a run-in position wherein the selected tool is above the blowout preventor with the tool axis substantially aligned with the BOP axis. In a preferred embodiment, a subsea tool storage rack is provided for storing at least some of the tools within a common plane substantially parallel to the BOP axis. The tool positioning system may move the selected tool in a second linear direction which is angled (not parallel) with respect to the first linear direction and also a substantially perpendicular to the BOP axis. In one embodiment, the tool positioning system moves the selected tool in a first linear direction with respect to a stationary tool storage rack, while in another embodiment the tool positioning system moves the entire rack, including the selected tool. A selected tool positioning system may use one or more of a fluid powered cylinder, a rack and pinion mechanism, and a powered winch. The injector positioning mechanism similarly includes at least one of a hydraulic powered cylinder, a rack and pinion mechanism, and a powered winch. One or more strippers may move with the injector to the inactive position. In an alternate embodiment, a pivot mechanism is provided for moving the injector from the run-in position and to an inactive position. In another embodiment, a y-connector is used to place the tubing injector in parallel with the selected tool when in the run-in position.

In a preferred embodiment, the tool positioning system and method include the plurality of actuators, and a selected combination of activated actuators provides a discreet position for moving the selected tool in a first linear direction or a second linear direction. The tool positioning system, when activated, moves each of a plurality of actuators to its discreet position thereby moving the selected tool a discreet linear amount.

In a preferred embodiment, the subsea intervention system and method includes one or more subsea motors which are electrically powered by an electrical umbilical extending from the intervention system to the surface. The subsea intervention system preferably includes one or more subsea pumps powered by one or more motors, with the pumps powering at least one of the tool positioning system and injector positioning system.

In a preferred embodiment, an axial length of each of the plurality of the tools is no greater than an axial spacing between a lower gate valve and a tool holding/latching device.

In one embodiment, a BOP structural frame is provided for housing the blowout preventor. The structural frame substantially decouples forces transmitted through the blowout preventor, and preferably withstand at least four times the force transmitted through the blowout preventor.

In a preferred embodiment, a subsea coiling tubing reel is positioned with a center of rotation and/or the center of gravity of the reel below a top of the injector.

In a preferred embodiment, the subsea intervention system and method include a circulation system for flushing a selected tool.

In a preferred embodiment, the tubing injector includes a traction device including opposed grippers laterally moveable with respect to the coiled tubing to move in a respective chain link member of an endless loop chain into gripping engagement with the coiled tubing. A drive motor is provided for powering the endless loop chain. A plurality of roller bearings each act between the respective link member and a gripper, with each roller bearing including one or more seals subjected to subsea conditions. A pressure compensating device is provided within each shaft of the plurality of the roller bearings for subjected lubricant in a fluid passageway in the roller bearing to a fluid pressure functionally related to subsea pressure, such that a controlled pressure differential exists across the one or more seals which seal the lubricant from the subsea conditions. The pressure compensating device may include a piston movable within a bore in the shaft of the roller bearing. A seal is provided for maintaining substantially sealed engagement between the piston and the shaft to fluidly isolate the lubricant from the subsea conditions. A biasing member within the shaft exerts a selected bias on the piston. In an alternate embodiment, a diaphragm is positioned within the shaft for sealing lubricant from the subsea environment. A fluid inlet port is provided in the shaft for selectively inputting lubricant into the fluid passageway in the roller bearings assembly.

In an alternate embodiment, a pair of outboard bearing assemblies are provided on the injector. A pressure compensating device is provided for compensating pressure of lubricant in at least one of the gear case and the pair of outboard bearing assemblies. In an alternate embodiment, a diaphragm separates lubricant from the subsea conditions, such that movement of the diaphragm provides pressure compensation for the lubricant in the gear case and/or the pair of outboard bearing assemblies. The pressure compensating device may be secured to the injector housing, and air spaces within the gear case and within the pair of outboard bearing assemblies may be substantially filled with lubricant prior to the deployment. The pressure on the lubricant may be controlled to be higher than, equal to, or lower than the pressure of a subsea environment.

These and further features and advantages of the subsea intervention system will be apparent to those skilled in the art in view of the following detailed description, wherein reference is made to the figures in the accompanying drawings.

BRIEF DESCRIPTION OF THE DRAWINGS

FIG. 31 is a pictorial view of a CT module, while

DETAILED DESCRIPTION OF PREFERRED EMBODIMENTS

Figure 1:
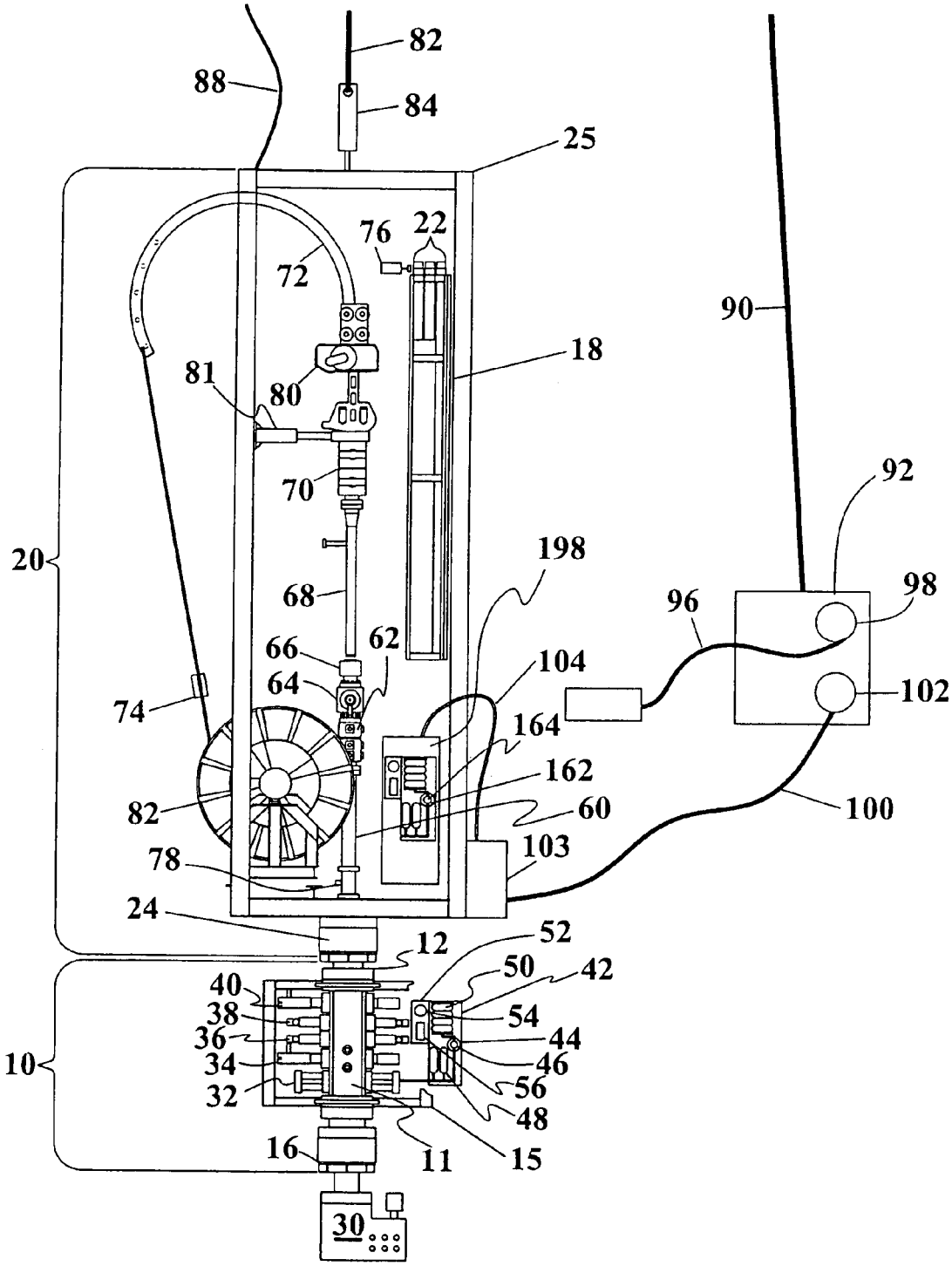
FIG. 1 illustrates one embodiment of a coiled tubing module and a BOP module.

The SIM as shown in FIG. 1 consists of two basic modules. The BOP module 10 maintains control of the well during workover operations and allows a conventional BOP to be connected to the well. The coiled tubing (CT) module 20 as depicted includes a marinized injector, a quick-change reel, strippers, and a tool magazine, as discussed more fully below. All of the tools required to complete the workover may be loaded into the tool magazine while the SIM is on the deck of the ship. If necessary, additional tools may be deployed and loaded into the magazine subsea. When fully assembled, a latched SIM may be approximately 70 feet tall and weigh approximately 340,000 pounds.

The feasibility study identified major technical hurdles and a financial hurdle to overcome in order to develop the SIM. The technical hurdles included development of a marinized injector, a reliable wet connector for the coiled tubing connector, a power/control system, a system to circulate seawater, techniques for controlling the bending moments of a conventional stack, and deploying the SIM from the ship. Other areas of technical advancement include improvements for the mechanisms for selectively positioning a tool in parallel with the injector, improvements in the system for powering the intervention system, improvements moving a tool and storing a plurality of tools, improvements in moving tools to a run-in position within an intervention system, improvements to a circulating system for flushing selected tools, and alternative proposals for positioning a selected tool above the BOP.

The injector may be fully marinized using a combination of water resistant lubricants and corrosion resistant alloys as explained more fully below. A cluster of sensors may be mounted above the injector to provide positioning information for the tubing reel. A BHA proximity sensor may be mounted below the bottom stripper to indicate if the BHA is present.

Coiled Tubing Module

The coiled tubing system may consist of an electrically driven hydraulic power system driving a coiled tubing injector and reel. A hydraulic power unit supplies the required flows and pressures to operate and control the complete coiled tubing system. The tubing injector conveys the tubing and thus the tool(s) connected at the lower end thereof into and out of the well bore. The tubing reel stores the required tubing for tripping into and out of the well bore.

The tubing reel may be located directly above the tubing injector. The tubing may be guided off of the reel and into the injector by automatic positioning of the tubing reel. The reel is preferably moved from side to side and may be guided with respect to the injector by a guide arch structure. The tubing reel assembly may be a "Drop-in Drum" type, which allows the tubing reel spool to be removed quickly for easy replacement. The tubing spool may be designed to allow the BHA connector and electrical collector ring to remain intact on each tubing spool. Once a spool is to be removed from the SIM, it may be placed in a protective bath to prevent corrosion until it can be thoroughly coated with a corrosion inhibitor.

The power/control unit (PCU) may consist of an electrically powered pump assembly, hydraulic pumps, and a multiplexed system for controlling the SIM. The PCU may be lowered to the SIM with its own umbilical. Hydraulic and electrical power may be transmitted to the SIM using jumpers connected with an ROV. No hydraulic power need be run from the surface. A power cable may supply all the electricity needed to operate the SIM.

The two modules that comprise the SIM may be assembled on the deck of the ship using a skid system. Prior to assembly, the coiled tubing (CT) module may be located directly over the moonpool, followed by the BOP module. The CT module 20 may be hoisted by a crane to allow the BOP module to be skidded over the moon pool, directly under the CT module. The CT module may then be lowered and latched onto the BOP module. Guide rails in the mast of the crane may hold the components while being hoisted and stabbed together. The two modules may then lifted as an assembly. After the skid assembly retracts to expose the unobstructed moon pool, the SIM may be lowered through the moon pool and down to the well head connector.

Each of the modules 10, 20 may be fitted with skidding shoes that may slide on the skid beams attached to the deck of the ship. Push pull cylinders may provide the skidding force. Each module may be positively locked to the vessel in the x. y, z directions with lock pins, which must be manually removed before a module may be moved.

A dynamic bumper frame in the moon pool may guide the SIM and reduce the loads on the SIM frame during the deployment and retrieval procedures. The SIM may be lowered with a motion compensated cable reel assembly to prevent the loss of tension on the hoist cable. Various hoist control cable designs may be used.

In one design. the hoist/control cable consisted of a single bundle that included steel wire rope for load-carrying capacity and fiber optic lines and power line. This design is not preferred rejected because the size of the bundle (greater than 6-inch diameter) and reel assembly would have been prohibitively large and prohibitively expensive. In the second design, the hoist and control cables were separate lines and reels that were strapped together as the SIM was lowered to the subsea tree. This design was unattractive because the strapping procedure added a great deal of time and complexity to the deployment procedure.

The preferred design uses a hoist line and a power control line wrapped on independent reels. The SIM may be lowered to the subsea tree using the hoist line and two work-class ROV's for guidance. Docking points along the outside of the SIM frame allow the ROV's to attach to the SIM. At this point, the power control line may not be attached to the SIM, so the SIM only has battery power. A dedicated high-pressure accumulator or one of the ROV's may be used to latch the SIM onto the H-4 mandrel on the subsea tree. If an accumulator is used, the ROV may still provide the input to activate the pressure circuit. After the SIM has been latched onto the tree, the H-4 connector on the bottom of the SIM may be pressure and pull tested using an ROV. One of the ROVs then releases the hoist line using a Delmar type connection device. The second ROV may be brought back to the ship and a power control unit (PCU) lowered to the SIM. The PCU may either have its own thruster system or be guided by the ROV. Once the PCU is in position, the ROV may fly hydraulic and electrical jumpers over to the SIM. After this, the SIM is fully powered up and ready to begin a workover. One concern is the SIM lines tangling up with the lines of the ROV. To avoid this, the lines may be run as far a possible from one another on the ship.

The following section contains tentative procedures for operating the SIM. While the procedures presented herein be changed, they should provide background to the thought processes that occurred during the initial design process.

A) Connector Test Procedure

Connect the stack to the subsea tree.

Close the BHA shear ram.

Pump into the well control stack on the outlet below the BHA shear ram.

Increase the pressure in the chamber to the low-pressure (250∝300 psi) test pressure.

Hold for 5 minutes.

Release the pressure.

Increase the pressure to the working pressure or the MASP plus 25%, whichever is less.

Hold for 10 minutes.

Release the pressure.

B) Well Control Stack Test Procedure

Upon completion of the testing of the connector, begin testing the well control stack.

Test the upper shear seal ram. Close the rams and perform the low-pressure test (200–300 psi) for 5 minutes.

Release the pressure.

Test the upper shear seal ram to the working pressure or the maximum anticipated shutin pressure (MASP) plus 25%, whichever is less.

Release the pressure.

Test the gate vale. Close the rams and perform the low-pressure test (200–300 psi) hold for 5 minutes.

Release the pressure.

Test the gate valves to the working pressure or the MASP plus 25%, whichever is less.

Release the pressure.

Test the lower stripper packer. Repeating the same low and high pressure tests.

Test the upper stripper packer. Repeating the same low and high pressure tests.

Run the coiled tubing with the crown plug-pulling tool through the pipe rams.

Close the lower pipe ram on the coiled tubing. Perform the low pressure and high pressure tests on the lower pipe ram.

Open the lower pipe ram. Close the upper pipe ram. Perform the low and high pressure tests on the upper pipe ram.

Test the locator ram. Depending on what ram is used, the test will have to be tailored to test that particular ram functions. If it is a blind ram then pull the coiled tubing into the carousel module and perform the low and high pressure tests. If the ram is a locator ram, perform the test written for that ram.

Each of these tests should pass with no leakage prior to beginning the job. If any ram is leaking, the system may be pulled to surface and the problem addressed.

C) Well Entry Procedure

After the connector and control stack have passed their pressure tests, the process of well entry can begin. This procedure assumes that the tree contains a crown plug. Plugs produced by other vendors may require different tools and a different procedure.

Index the tool magazine to the pulling tool assembly for the top crown plug to the active position (over the wellbore centerline). This tool assembly consists of a GS running/pulling tool and a centralizer. The centralizer is attached to the tool string above the pulling tool (using a short stem bar in between the centralizer and the "GS") ensuring that the centralizer does not enter the hanger. If a stuck plug is suspected, the assembly may also include a shallow jarring mechanism.

Close the bottom gate valve.

Skid the injector back and lower the tool into the tool holder located just above the top H-4 connector.

Skid the injector forward and close the sealing piston.

Pressure test the stack to 200–300 psi by pumping seawater down the coiled tubing.

If no leaks are detected, increase the pressure to the working pressure or the MASP and hold for 5 minutes.

Bleed off the pressure in the stack.

Latch onto the active tool and pull test it.

Open the gate valve.

Make certain that the pressure is fully equalized across the plug. It may be difficult to equalize pressure above and below the upper plug when there is a substantial column of fluid above the upper plug or the bleed connection between "above" and "below" the upper plug is inadequate.

Lower the tool string to plug and engage the fish neck with GS pulling tool.

Jar up to release the secondary hold down mechanism and pull expander sleeve from behind the keys.

Continue jarring lightly to release the keys and pull plug from nipple profile.

Pull the crown plug and pulling assembly back up into the stack and unlatch BHA.

Circulate fluid down the coil and close the bottom gate valve.

Bleed off any pressure and open up sealing piston.

Skid injector back and raise tool back up into the magazine.

Index the magazine to the pulling tool assembly for the bottom crown plug to the active position.

Lower the tool into the tool holder.

Skid the injector forward and close the sealing piston.

Pressure test the stack to 200–300 psi by pumping seawater down the coiled tubing.

If no leaks are detected, increase the pressure to the working pressure or the MASP and hold for 5 minutes.

Bleed off the pressure in the stack.

Latch onto the active tool and pull test it.

Open the gate valve.

Make certain that the pressure is fully equalized across the plug.

Lower the tool string to plug and engage the fish neck with GS pulling tool.

Jar up to release the secondary hold down mechanism and pull expander sleeve from behind the keys.

Continue jarring lightly to release the keys and pull plug from nipple profile.

Pull the crown plug and pulling assembly back up into the stack and unlatch BHA.

Circulate fluid down the coil and close the bottom gate valve.

Bleed off any pressure and open up sealing piston.

Skid injector back and raise tool back up into the magazine.

Index the magazine to crown plug bore sleeve.

Lower the tool into the tool holder.

Skid the injector forward and close the sealing piston.

Pressure test the stack to 200–300 psi by pumping seawater down the coiled tubing.

If no leaks are detected, increase the pressure to the working pressure or the MASP and hold for 5 minutes.

Bleed off the pressure in the stack.

Latch onto the active tool and pull test it.

Open the gate valve.

Place the protective sleeve in the crown plug bore.

Pull the sleeve running/pulling assembly back up into the stack and unlatch BHA.

Circulate fluid down the coil and close the bottom gate valve.

Bleed off any pressure and open up sealing piston.

Skid injector back and raise tool back up into the magazine.

Index the magazine to the running/pulling tool assembly for the SSSV sleeve.

Lower the tool into the tool holder.

Skid the injector forward and close the sealing piston.

Pressure test the stack to 200–300 psi by pumping seawater down the coiled tubing.

If no leaks are detected, increase the pressure to the working pressure or the MASP and hold for 5 minutes.

Bleed off the pressure in the stack.

Latch onto the active tool and pull test it.

Open the gate valve.

Place the sleeve in surface controlled subsurface safety valve (SSSV) to keep it open.

Pull the sleeve running pulling assembly back up into the stack and unlatch the BHA.

Circulate fluid down the coil and close the bottom gate valve.

Bleed off any pressure and open up sealing piston.

Skid injector back and raise tool back up into the magazine.

Index the magazine to mission's first tool assembly.

Lower the tool into the tool holder.

Skid the injector forward and close the sealing piston.

Pressure test the stack to 200–300 psi by pumping seawater down the coiled tubing.

If no leaks are detected, increase the pressure to the working pressure or the MASP and hold for 5 minutes.

Bleed off the pressure in the stack.
Latch onto the active tool and pull test it.
Open the gate valve.
Run in Hole and perform the required work.

Exiting the well bore may be done in a similar manner as the entry. The sleeves may be pulled back to the same tubes from which they were deployed. New crown plugs need installed during every workover, so several tubes may be dedicated to crown plug operations.

D) Crown Plug Installation

Lower the tool string until the nipple profile is located.
Apply hydrostatic pressure to the top of the plug for setting purposes.
Keep pressure on and jar down on tool string to shear the pins and set the plug.
Pull up on tool string to verify that plug is set.
Pull upwards to release running tool.
Bleed off pressure.

E) Emergency Disconnect Procedure

Possible failures that may occur while operating the SIM are discussed below. Many of the possible scenarios require the need to perform an emergency disconnect. This section describes the recommended disconnect procedure.

Close the flow lines and isolate the well.
Stop the coiled tubing Injector and Reel.
Lock the brakes on.
Close the lower pipe slip rams and pull tension on the coil.
Close the upper shear seal ram and shear the coil.
Close the lower pipe slip rams.
Pull the coiled tubing up 20 feet to clear the upper gate valve.
Close the gate valve.
Lock down the injector and reel.
If leakage is observed above the gate valve, close the lower BHA shear seal rams.
Disconnect the control pods.
Unlatch the connector between the BOP module and the carousel module.
Pull the upper two modules to surface and mobilize a conventional workover rig.

If the injector failed, then the first six steps may be performed after the coil stopped moving. The next two steps may be moved to after unlatching the BOP module and the CT module. The gate valve is closed using an ROV and the hot stab panel on the BOP module. If a BHA assembly that cannot be sheared using a standard shear ram (downhole motor) is located in the BOP stack, the bottom shear ram will be the primary shear cavity.

F) Failure Analysis

The SIM may contain several dozen, interrelated, and articulated components, all controlled remotely by an operator(s) on the vessel through an, optical/electrical umbilical up to the surface. It is reasonable to expect a component failure to occur. Therefore, recovery options that affect mission performance must be considered.

Redundant MUX (yellow and blue) pods provide the opportunity to switch to an alternate control system without disconnecting from the well site. The hydraulic functions may be controlled by electro-hydraulic (solenoid) valves. The valves are commonly the cause (due to contamination) of an operation or function failure. Switching from one control system (yellow to blue pod) to a duplicate valve/circuit resolves this failure until the SIM may be retrieved and serviced. There are failures, however, that may occur which will demand the entire SIM be retrieved or the carousel/coil module only be retrieved and be repaired on the vessel. Some primary or critical functions also have a ROV operated, redundant control via a "Hot Stab Panel" located on the BOP module. Failure recovery options include three basic categories: RCS (Redundant Control System) switching from one pod to the other, RVO (Remote Vehicle Override) intervention using the ROV via the hot stab panel, and RTV (Return to Vessel) abandon the mission and bring the SIM to surface.

Many of the operating procedures used on surface coiled tubing units cannot be used with the SIM. An emergency disconnect may be performed instead and a conventional workover rig mobilized to fix the problem. Where it is possible, the SIM may have several levels of redundancy design to limit the risks associated with failures.

Well Head Connector Failure

Failed Latch
Re-verify the alignment of the SIM and tree with the SIM cameras and ROV.
Switch control pods and function again.
If it fails, pull up the SIM and try setting it down again
If it fails, return to vessel (RTV).
Failed Pressure Test
Unlatch and replace the gasket with the ROV.
Re-latch and pressure test again.
If it fails, RTV.
Failed to Unlatch
Use Secondary Unlatch function
Switch control pods and function again.
Function with ROV
BOP Failure
All the BOP functions can be operated with the yellow or blue control pod and can be operated with the ROV hot stab panel.

Magazine Failure

Sealing Piston Failed to Extend/Retract
Switch control pods and function again.
Function with ROV.
Close BOPs.
Disconnect at tool positioner and RTV.
Magazine Failed to Index
Switch control pods and function again.
Function with ROV.
Close BOP.
Disconnect at Carousel and RTV.
Control System Failure—Control Pod Fails
Switch to the alternate pod and continue mission.
Control Line Breaks
System will perform an emergency shut-in procedure.
Circulation Pump Failure
The current design uses two electric motors and two pumps. Each pump and motor should be sufficient to operate the down hole tool operations.
Coiled Tubing Failure—Coiled Tubing Stuck
Attempt to reciprocate the coil.
Determine the free point.
Release the BHA (if freepoint is near the connector).
Close and lock the BOP slip rams and pipe rams.
Stop pumping down the coil.
Depressurize the CT to check the integrity of the downhole check valves.
Perform an emergency disconnect.
Recover with conventional rig.
Broken Coiled Tubing
Perform an emergency disconnect.
Recover with conventional rig.

Leak in Coiled Tubing

If check valves are holding, attempt to assess the integrity of the tubing.

If deemed acceptable slowly pull out of the hole.

If unacceptable or check valves are leaking perform emergency disconnect.

Recover with conventional rig.

CT Slipping in the Injector Head

Attempt to increase the force squeezing the gripper blocks together.

If the CT still slips, shut down the injector head.

Perform an emergency disconnect.

Recover with conventional rig.

Stripper Leaking

The SIM design may utilize two strippers. Seawater is pumped in between the stripper so that the pressure between the strippers is greater than wellbore. If the pump fails, secure the well and retrieve the pump system CT Collapsed Near the Stripper Slackoff the coiled tubing (CT) until the stripper can seal around the CT.

Perform an emergency disconnect.

Recover with conventional rig.

CT Reel Motor Failed

Continue to pull out of hole (POOH) until the BHA may be disconnected. Pull the CT modules to the surface.

Injector Failures—Pump/Electric Motor Failure

The injector may be driven by two electric motors and two hydraulic pumps. If one of the pumps fail, the other one should provide sufficient power to slowly POOH. After the coiled tubing has been pulled out of the hole, the BOP may be closed and the CT module returned to the surface for repair operations. If both motors and pumps fail, then Perform an emergency disconnect.

Recover with conventional rig.

Chain Break, Roller Failure, Dome Leaks

Attempt to slowly POOH

If unable to POOH

Perform an emergency disconnect

Recover with conventional rig

Runaway Tubing

Use standard operating procedures and try to recover control. After the coil stops moving, the coil may be recoverable. If this is not possible or the pressure integrity of the system has been compromised, an emergency disconnect must be performed and will be done with a conventional rig.

Those skilled in prior art will appreciate that procedures will vary with design changes, and that the listing of steps with respect to a specific procedure or a specific analysis need not necessarily occur in the order set forth for this one embodiment.

The subsea intervention system may perform various types of reservoir management work, including production logging, perforating, and acidizing on subsea wells. A preferred general arrangement of the equipment is shown in FIG. 1. The blowout preventor module 10 includes a blowout preventor (BOP) 11 for safely controlling the well during servicing operations. The coiled tubing module 20 contains various tools 22 which are to be conveyed into the well, and a system for conveying the tools into the well. The two modules 10 and 20 may be connected and disconnected subsea using a standard H-4 connector 24. This allows the coiled tubing module 20 to be retrieved to add new tools or repair equipment while maintaining control of the well using the BOP module 10. This arrangement also allows a conventional BOP and riser system to be connected to the well via the H-4 mandrel 12 on the top of the BOP module. The body of the BOP thus need not be sized to accommodate the loads imparted on the BOP by a conventional BOP and riser system. The structural frame carries most of the load, preferably at least four times the load imparted on the BOP and most preferably at least ten times the load imparted on the BOP. Also, the BOP body may be replaced with two or more bodies provided their flanges accommodate the imparted loads. In one embodiment, the structural frame 15 carries the load, allowing for the use of a smaller BOP body and/or BOP stack. This embodiment may then operate with a slip joint, but may not result in significant weight savings. A slip joint may not be necessary if the BOP accommodates all the load.

The BOP module 10 may also include an H-4 connector 16 that latches onto the subsea tree 30, a multi-purpose shear ram 32, a lower gate valve 34, a pipe/a slip ram 36, a coiled tubing shear ram 38, an upper gate valve 40, and a closed loop hydraulic power system 42 with no discharge to the sea, including electric motors 44, hydraulic pumps 46, accumulators 48, and a pressure balanced hydraulic fluid reservoir 50. A control unit 52 including a computer 54 and valve manifolds 56 to operate the BOP 11 may also be included in the BOP module 10.

A suitable coiled tubing module 20 includes a spacer spool 60, a tool holding/latching device 62, such as a modified ram BOP, a gate valve 64, a lubricator sealing mechanism 66, including lubricators 68, a set of upper and lower strippers 70, a coiled tubing injector 80, a gooseneck 72, a reel 82 and level wind system 74, tool storage and tool transport system 76, and a closed loop hydraulic power system and control unit to operate the coiled tubing equipment. The coiled tubing module 20 may thus include all components within a structural frame 25.

The significant feature of the invention is that the reel 82 is not located above the injector. By moving the reel 82 down to a level substantially equal to the base of the coiled tubing module 20, the reduced center of gravity and the resulting distance to the gooseneck allowed for a standard reel level wind system to be used. The preferred embodiment, of the reel has a substantial horizontal axis, and accordingly the horizontal axis of the reel is also below the top of the injector. In a preferred embodiment of the center of gravity of the reel 82 is also lower than the center of gravity of the injector. During use of the two strippers 70, fluid is pumped between the packing elements at a pressure slightly greater than the wellbore pressure, thus reducing the release of hydrocarbons.

A significant feature of the subsea intervention system is that the axial spacing between the lower gate valve 34 and the tool holding/latching device 62 may be sized to receive the longest of the tools 22. The axial length of each of the tools is thus also greater than an axial spacing between the lower gate valve and an upper gate valve, if an upper gate valve is provided. The tool 22 may thus be loaded into the well without a second lubricator or pressure containing pipe between the BOP stack and the stripper. By using the BOP stack as a pressure vessel, the overall height of the subsea intervention is reduced.

The subsea intervention system may be lowered to the subsea tree 30 using wire line or wire rope 82 and a hoisting device 84 that may be easily actuated by an ROV. While the system may also be lowered on drill pipe, this would increase the deployment time considerably. Once the ROV has locked the bottom connector 16 onto the wellhead, the hoisting device 84 may be released.

Workover fluids may be supplied to the system from a surface vessel with an auxiliary line 88, which may be reeled tubing. The line 88 may be latched onto the top of the coiled tubing module 20, and a motion compensated traction device on the deck of the ship may maintain constant line tension.

In an alternative embodiment, a clump weight was located on the end of the line 88, and a flexible hydraulic jumper was run from the weight to the coil tubing module 20. The motion is thus accommodated by the flexible line bending. In a preferred design, a clump weight is not required. Moreover, if the subsea intervention system is only being employed as a "stiff wireline" unit with a wireline inside coiled tubing, the auxiliary fluid supply line may be replaced by a subsea water pump.

Both power and control signals for the intervention system may be carried using an umbilical 90 that is shared with the ROV. The power and controls within the garage or top hat 92 may be split between the ROV and the intervention system. The ROV may receive its power and control signals via a tether 96 with a constant tension reel system tether 98. The power and controls for the intervention system may be carried via a tether 100 with a constant tension reel system 102. The intervention system terminates at a junction box 103, that may be latched to the intervention system using the ROV. Multiple control and power wet mate connectors 104 may be run to the BOP module 10 and to the CT module 20. This system may be preferred over a dedicated umbilical system, since it reduces the number of lines running from the surface to the sea floor, as well as the savings by not requiring a separate umbilical, winch system, slip ring, and power conditioning equipment.

The tool storage and tool transport system 76 allows for storing multiple well intervention tools 22 in close proximity to the sea floor. The system 76 further provides for selecting a specific tool from the storage device 18 and subsequently moving the tool 22 from the storage device into the tool holding/latching device 62, a tool indexing system 76 to position a selected tool 22 in the run-in position, an injector positioning system 81 which may be activated to move the injector 80 from the run-in position as shown in FIG. 1 to an inactive position. Indexing to the desired tool may be accomplished by moving the tool storage device 18 and/or a tool 22 using a tool transport mechanism 76 preferably movable in two directions, e.g., both laterally and forward/backward. The tool transport system 76 may thus engage a running tool attached to each tool 22, and lower the tool into the tool holding/latching device 62. After connecting the coiled tubing to the tool, the tool 22 may be run into the well. Prior to removing the tool from the BOP module 10, the tool and lubricator or BOP stack may be flushed clean using the hydraulic system that pumps fluid into the bottom of the BOP stack, out the top of a lubricator or BOP stack, and back down the tree and into the flowline. After the tool is returned to the storage device another tool may be ran in the well, or the positioning system 81 may be activated to return the injector 80 to the FIG. 1 position.

Figure 2:
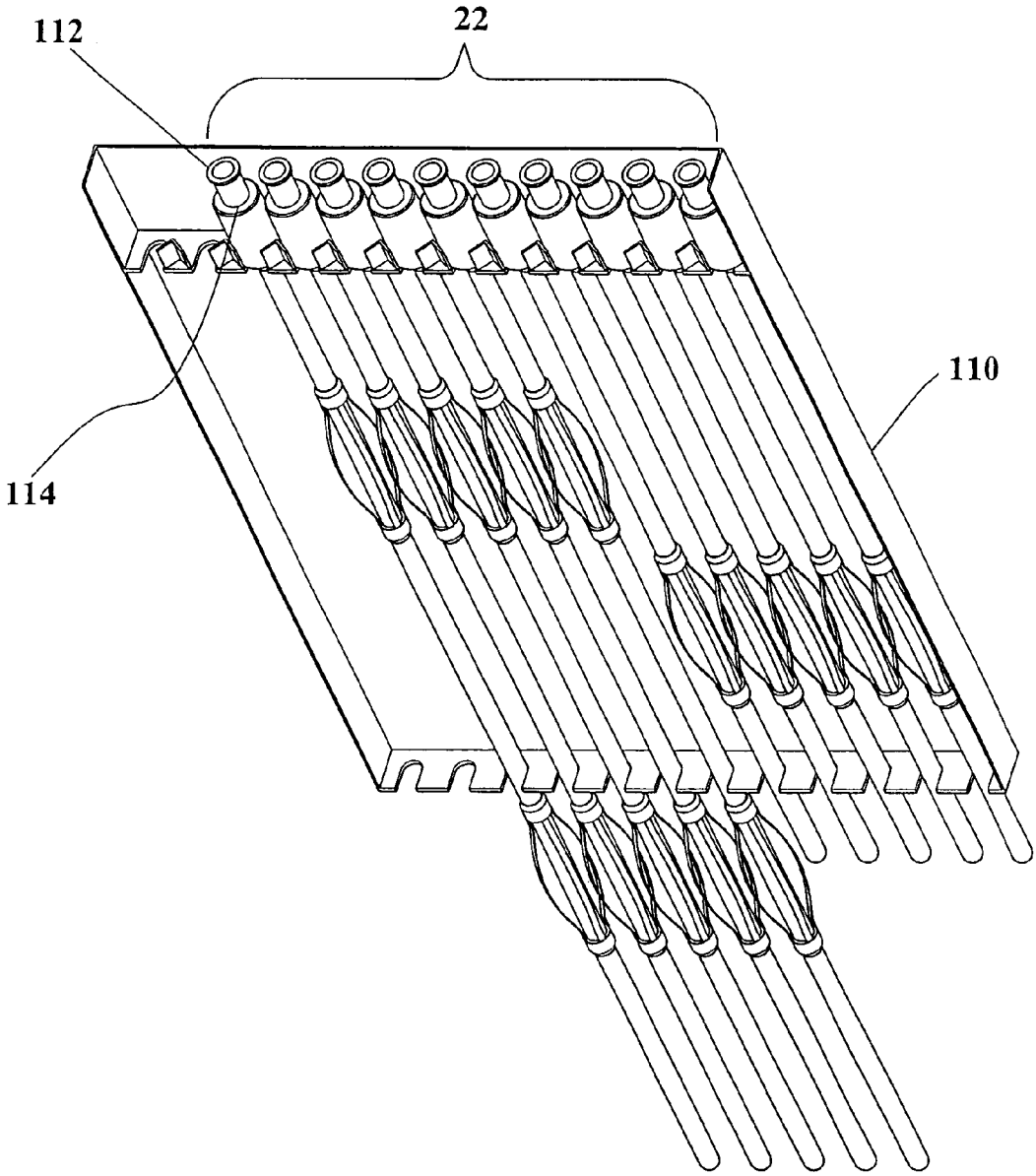
FIG. 2 illustrates one embodiment of a tool storage system.
Figure 3:
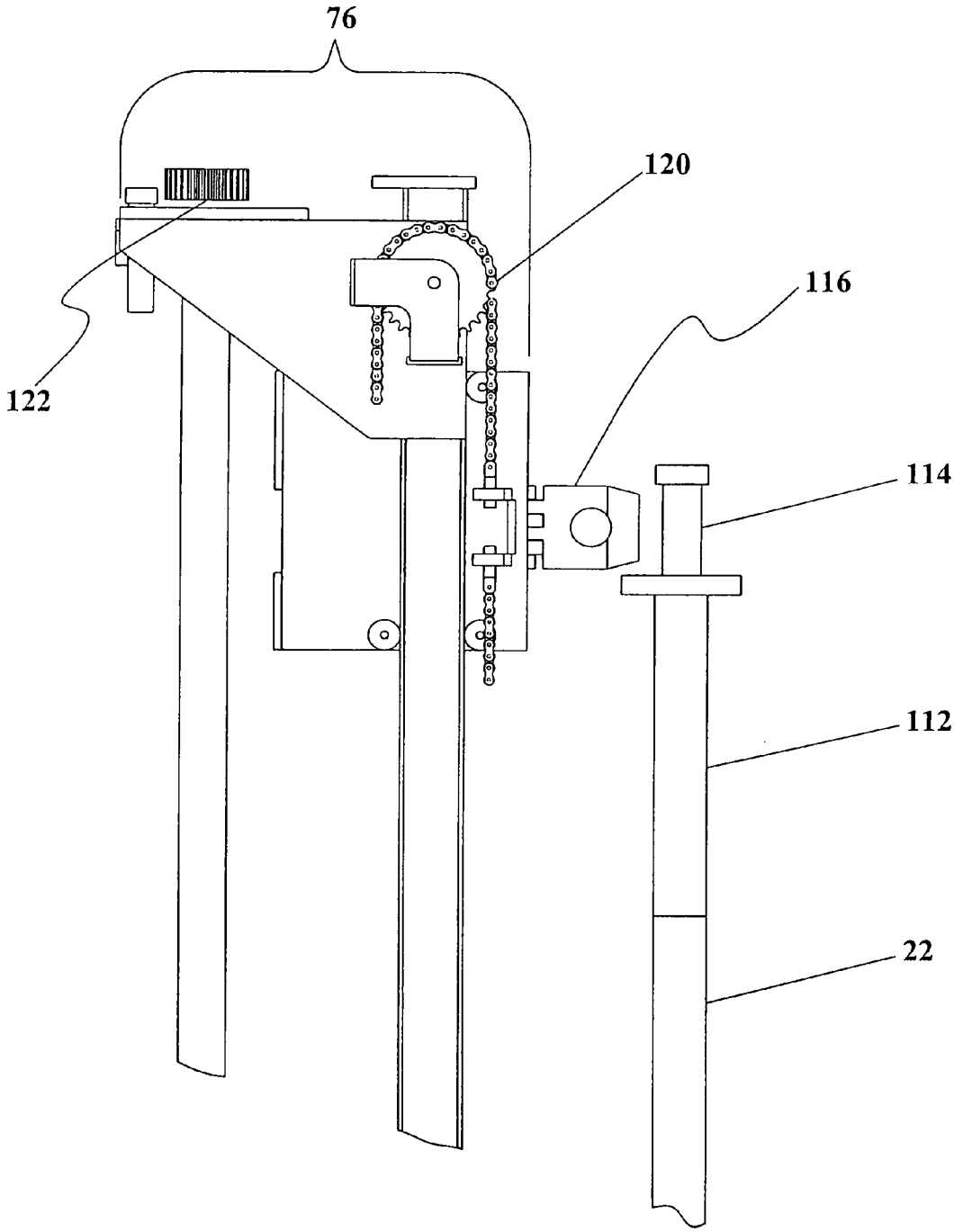
FIG. 3 illustrates a suitable tool transport mechanism.

For the embodiment shown in FIG. 2, the tool storage rack 18 may be similar to a pool cue rack. Tools 22 may be latched into a rack 110 which moves laterally to index to a selected tool, but an alternate and its bottom may remain stationary. Each tool preferably includes a deployment running tool 112 with a necked section 114 on the running tool 112 that may be grabbed by a jaw 116 on the tool transport mechanism 76, as shown in FIG. 3. For the embodiment, as shown in FIG. 3, the tool transport mechanism moves up and down utilizing a chain assembly 120 and traverses across the width of the tool rack 110 with a rack and pinion gear system 122. Vertical motion alternatively may be accomplished using a winch and wire rope. Traversing across the tool rack may be accomplished using a chain drive, or a series of tandem hydraulic cylinders.

The above design may be modified to allow tools to be built inside the BOP stack with the addition of a second a tool holding/latching device below the lower gate valve. If the second lower tool holding/latching device were added, tools may be lowered into the top tool holding/latching device using the tool transport mechanism. The lubricator sealing mechanism may be engaged and the coiled tubing may latch onto the tool and move it down into the lower tool holding/latching device. The lubricator sealing mechanism may be disengaged and the second tool lowered into the top tool holding/latching device using the tool transport mechanism. The coiled tubing may latch onto this tool and then run down and latch the first and second tools together. Finally, the coiled tubing may convey the entire assembly down into the well.

Figure 4:
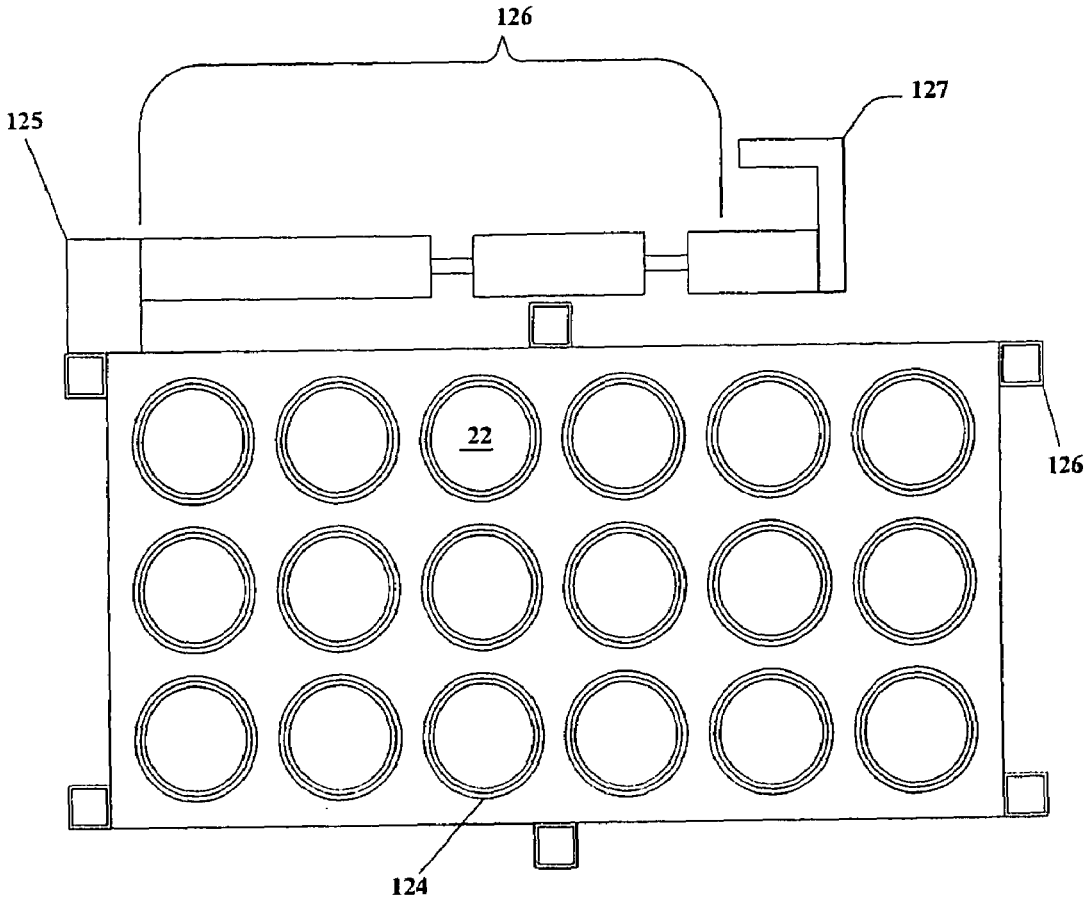
FIG. 4 illustrates a plurality of tools within a structural frame defining a tool storage rack.
Figure 70:
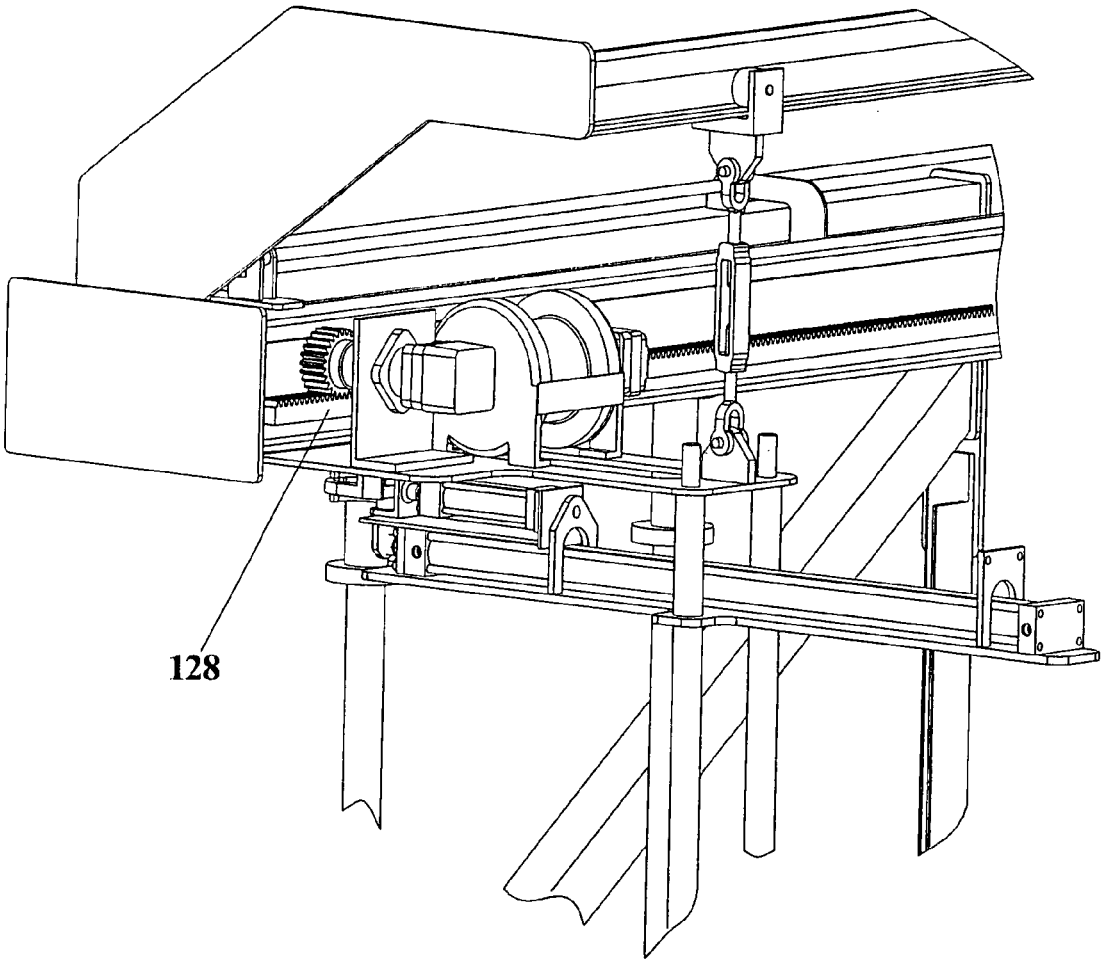
FIG. 70 illustrates a suitable rack and pinion mechanism for moving tools.
Figure 71:
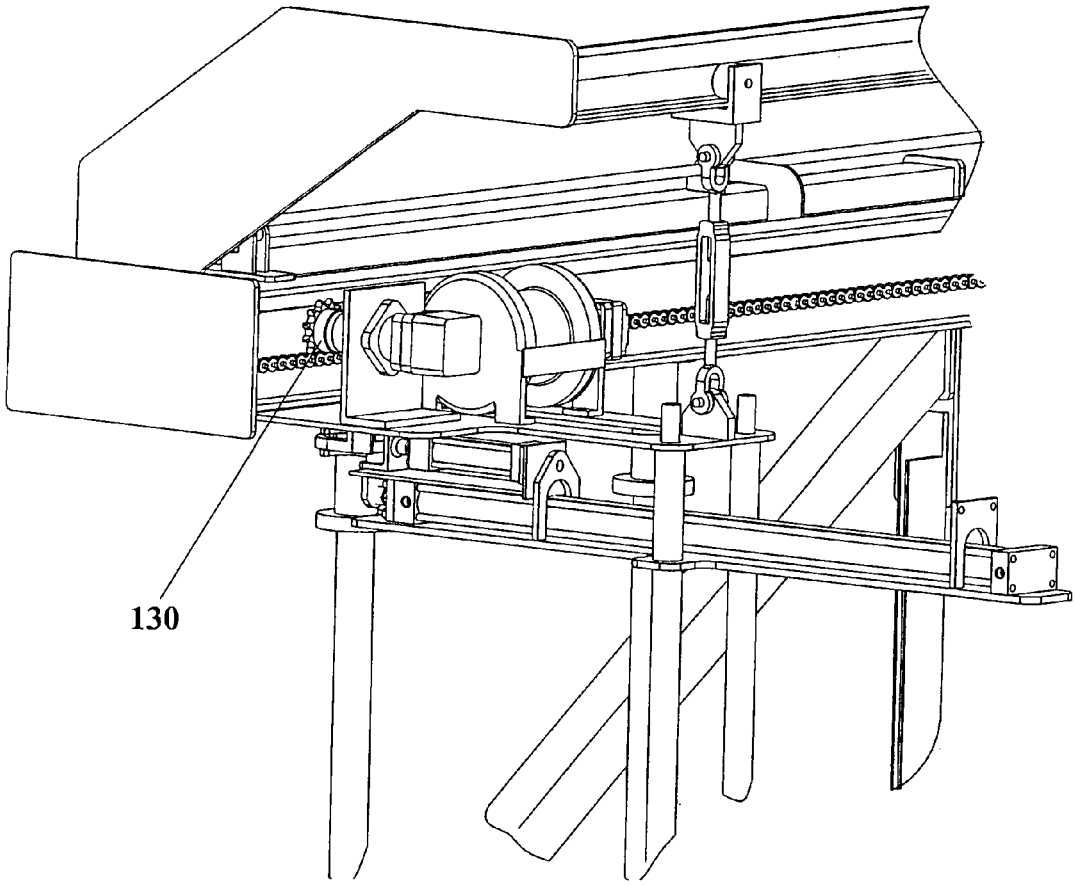
FIG. 71 illustrates a suitable powered winch for moving tools.

In the FIG. 4 embodiment, the tools 22 are stored in a series of open-ended tubes 124 that are secured to a structural frame 126. Bracket 125 mounts a series of tandem hydraulic cylinders 126 to the tool storage device 18. Another bracket 127 on the opposing end of the cylinders attaches to the structural frame of the coiled tubing module 20. Alternative drive systems include a single piston drive system with limit switches, a rack and pinion gear system 128 as shown in FIG. 70, a powered winch and chain drive system 130 as shown in FIG. 71, or other mechanisms for achieving linear motion to index the selected tool.

Figure 5:
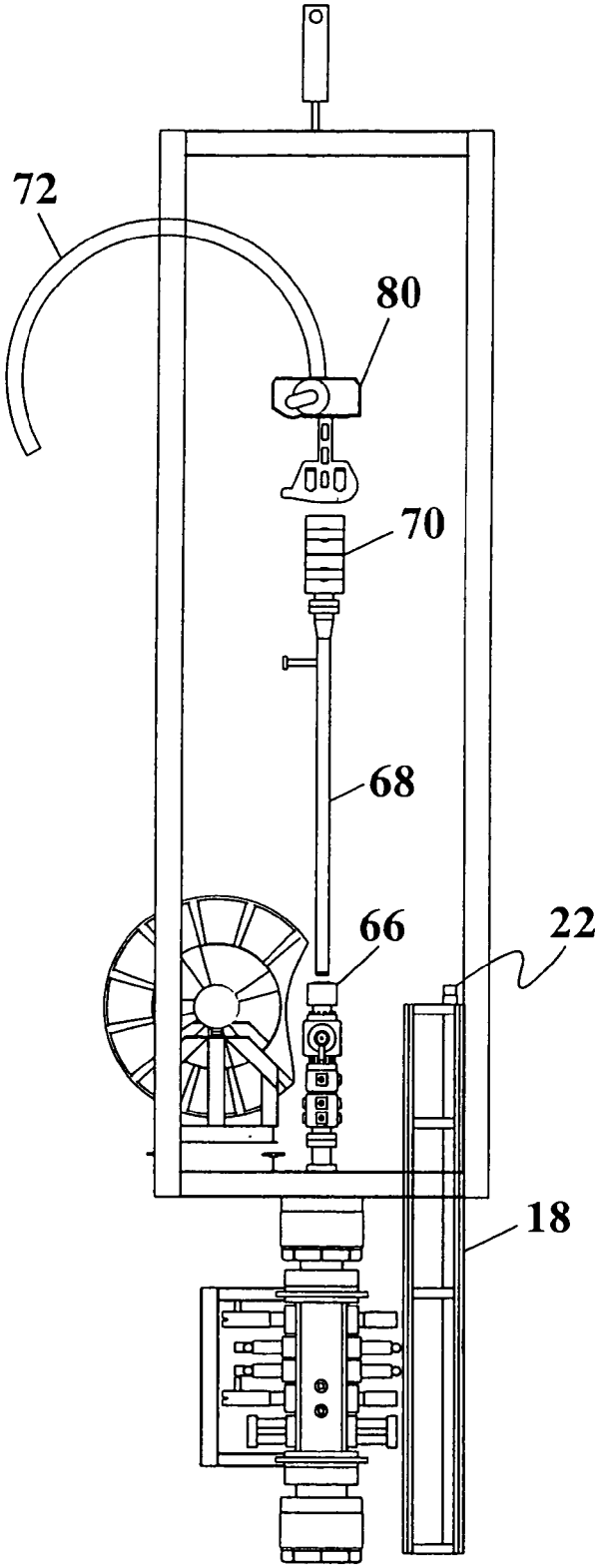
FIG. 5 illustrates a tool storage system, and the BOP and CT modules.

The tool storage system may be latched across the BOP and CT modules, as shown in FIG. 5. To load tools into the well, a lubricator sealing mechanism 66 may be retracted so that the lubricators 68, strippers 70, injector 80, and gooseneck 72 slide forward until the lubricator is lined up with the proper tool 22 in the tool storage rack 18. The coiled tubing may act as the tool transport mechanism and latch onto the tool and pull it up into the lubricator. The lubricator and other components may then move back over to the centerline of the BOP, which is the centerline of the wellbore. After engaging and pressure testing the lubricator sealing mechanism, the tool 22 may be run into the well.

The above design accommodates assembling tools in the BOP stack, using the tool holding/latching device. When building tools in the BOP stack, the first section of the tool may be lowered into and hung off in the tool holding/latching device. The gate valve may be closed and a second tool be picked up out of the tool storage system and pulled up into the lubricator. After resealing the lubricator, the gate valve may be opened. The two latched pieces may then be run into the well as an assembly. One disadvantage to this design is the lubricator is located between the BOP and the strippers and thus adds height to the system. The subsea intervention system may, however, use various types of tool storage and delivery systems. Since the tool storage system need not be positioned between the BOP module and the strippers, and the height and weight of the intervention system may be reduced.

Figure 6:
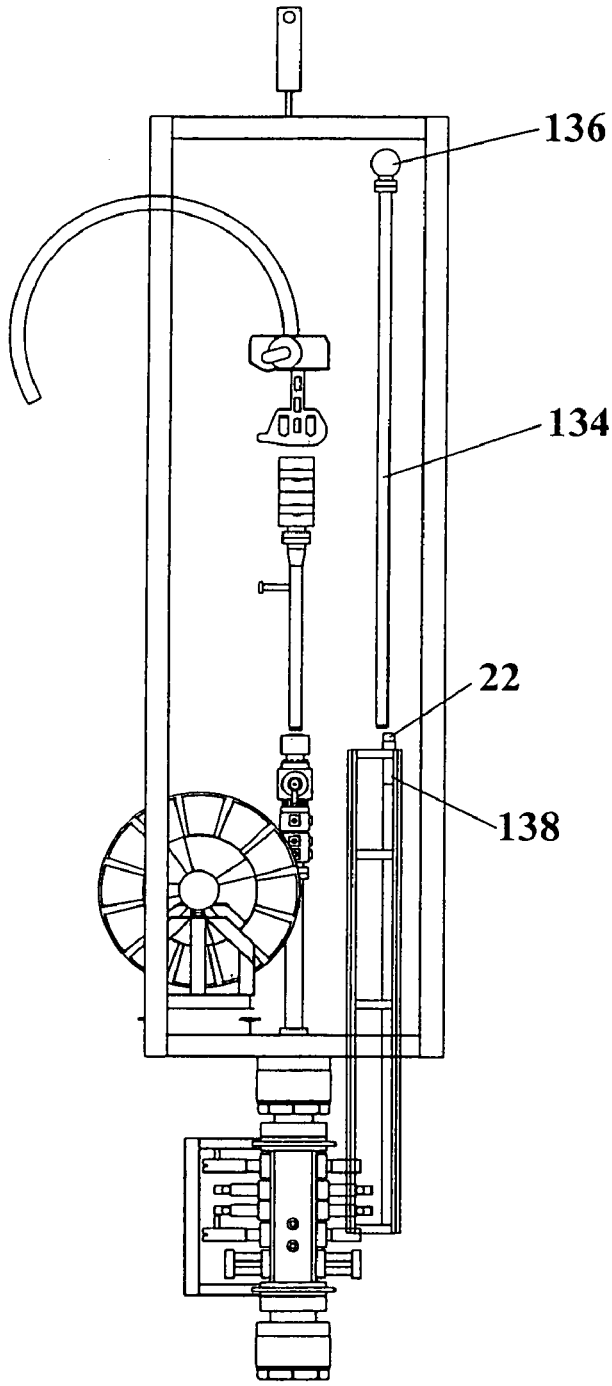
FIG. 6 illustrates an alternative tool storage system.

A preferred alternative, as shown in FIG. 6, may use the same tool storage device, but the tool transport mechanism is now independent of the coiled tubing. In this design, a second lubricator 134 is added. The lubricator, strippers, injector, and gooseneck as well as the lubricator 134 slide back and forth. In this design, however, the lubricator, strippers, injector, and gooseneck traverse a much shorter distance.

The tool transport mechanism as shown uses a wire rope and a hydraulic winch drive system 136. Alternatively, the tools may be raised and lowered using a chain drive mechanism, or other simple linear motion device as discussed above for the rack-type storage system. A running tool 138 may be latched and unlatched from the tool transport mechanism, and may be located at the upper end at each tool 22. The second lubricator 134 may not be required, but does allow tools to be assembled in the BOP stack. Assembling tools is also possible if another tool holding/latching device is installed below the lower gate valve. A significant drawback of this design is that the tool rack is raised and lowered into position to accommodate detaching the coiled tubing module from the BOP module. If building tools in the BOP is not required, the previously described system may be preferred.

Figure 7:
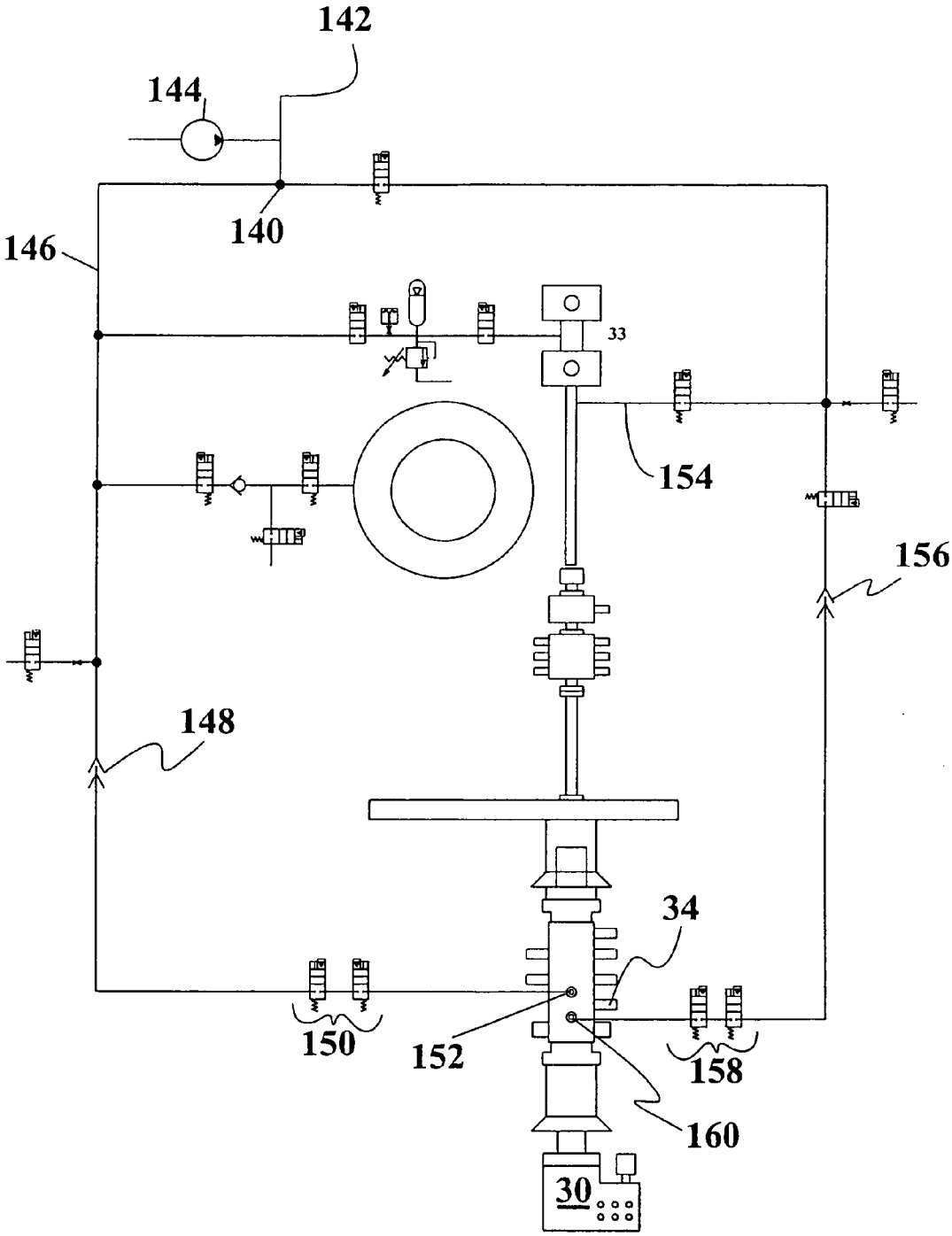
FIG. 7 illustrates a suitable flushing system.

The subsea intervention module is equipped with a system to flush the BOP stack, lubricator, and tools with fluid to remove hydrocarbons and minimize the risk to the environment. FIG. 7 shows a schematic for such a suitable flushing system. During flushing operations, the lower gate valve 34 is closed and the tool is attached to the coiled tubing. Fluid is supplied at 140 via the auxiliary fluid supply line 142 or subsea pump 144 and flows in piping 146 through a hydraulic wet connect 148, past a set of gate valves 150 and into a side outlet 152 just above the lower gate valve. The fluid then flows past the tool which it is connected to the coiled tubing and exits the lubricator along path 154 through a second hydraulic wet connect 156 through a second set of gate valve 158 and back into a side outlet 160 just below the lower gate valve. After entering the side outlet of the BOP, the fluid flows down into the tree 30 and into the flowline. Similar circuits may be provided for the various subsea intervention systems disclosed.

BOP Module

Figure 8:
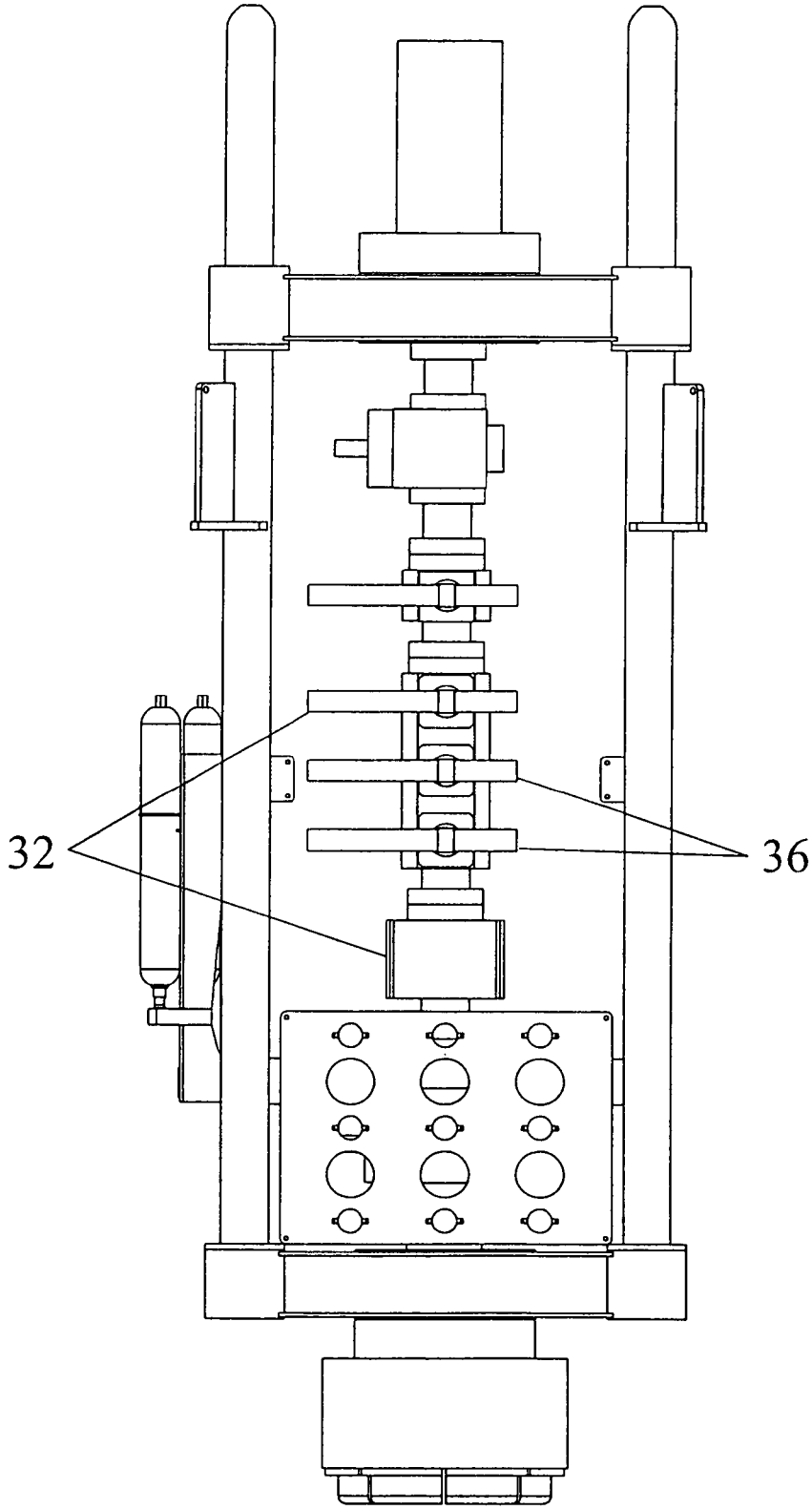
FIGS. 8 and 9 illustrate one layout for the BOP module.
Figure 9:
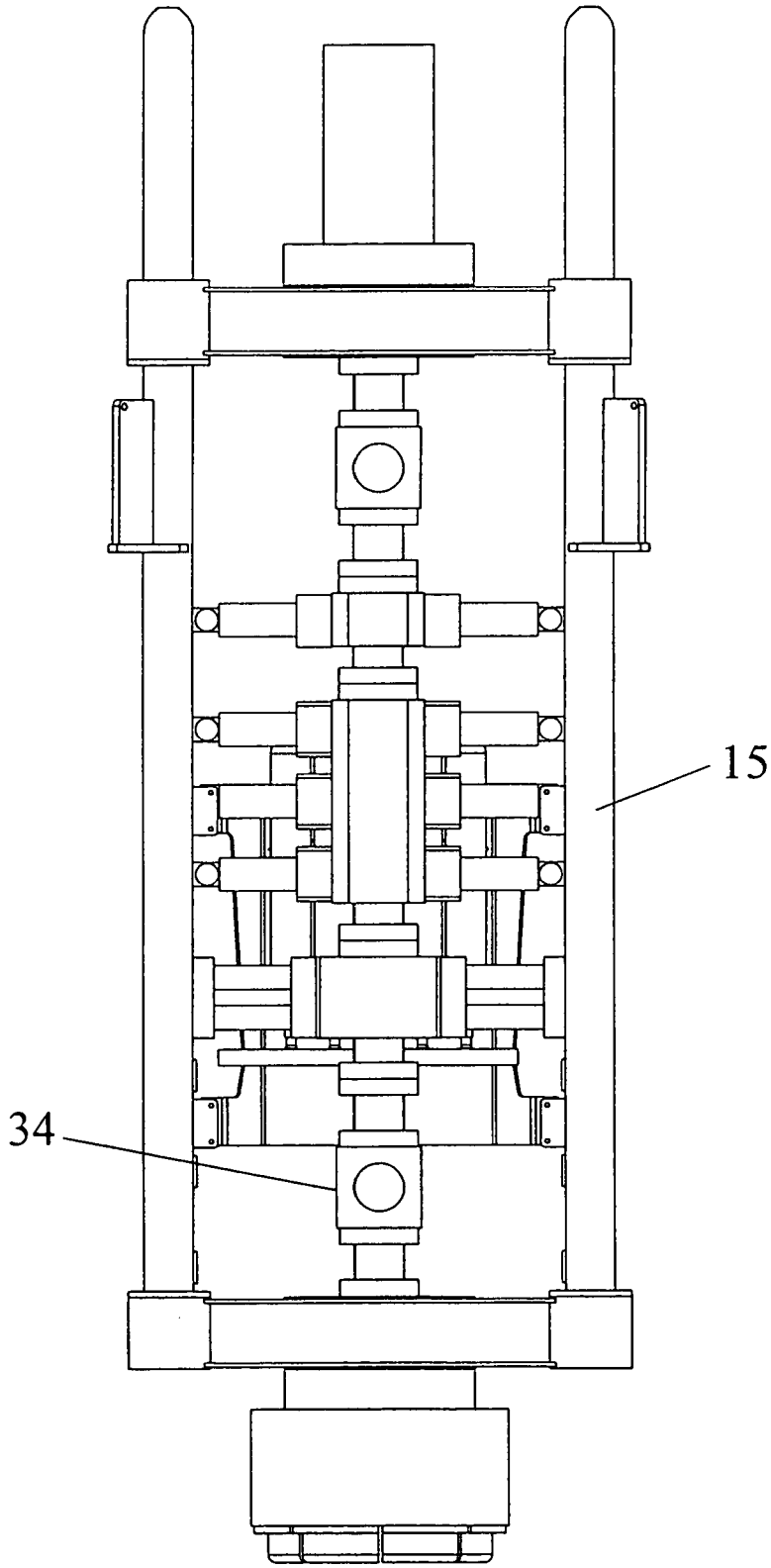

The BOP module 10 may be designed to provide pressure control while the SIM performs the workover operations. The BOP module may be used on wells with horizontal trees, an exemplary maximum expected shut-in tubing pressure of 5,000 psi, and in an exemplary water depth of 10,000 feet. FIGS. 8 and 9 illustrate one layout for the BOP module 10. The BOP module may consist of the following components:

- 18–3–4 inch 15M HD H-4 or E×F H-4 ABB Vetco Connector
- 7 1/16-inch—10 M Safety Valve (Ball/Gate)
- 7 1/16-inch—10 M Shear Seal BOP with 14" Operator
- 7 1/16-inch—10 M Pipe/Slip Ram BOP
- 7 1/16-inch—10 M Pipe/Slip Ram BOP
- 7 1/16-inch—10 M Shear Seal Ram BOP
- 7 1/16-inch—10 M Blind Ram BOP (Landing Ram),
- 7 1/16-inch—10 M Safety Valve (Ball/Gate)
- 18 3/4-inch—15 M ABB Vetco Connector Mandrel with H4 Profile Since the BOP stack frame may be designed to withstand only 2.5 million lbf ft of bending moment and the MASP is 5,000 psi, an E×F H-4 connector may be used instead of a HD H-4 connector. This will save about 11,000 pounds in weight for each connector.

The primary well control components for the BOP stack are the two shear rams 32, two slip/pipe rams 36, and a gate valve 34. In alternative designs, the blind ram may be replaced by a landing ram to allow tools to be staged into the well. The bottom shear seal was included in the stack to accommodate the shearing of a BHA assembly located in the BOP stack. This shear has successfully sheared 15.5 lb/ft 3.5-inch S135 drill pipe with 5,000 psi wellbore pressure and 2,600 psi operator pressure. If the coil must be sheared, the CT module 20 may be retrieved by unlatching the H4 connector between the module 20 and the BOP module. The BOP module 10 may be designed to remain on the wellhead, maintaining control of the well, until a conventional workover rig may be moved onto location. During the shut-in period, the safety valve provides a metal-to-metal sealing barrier for the well. Additionally, the safety valve maintains well control during movement of the tools. Once the conventional workover rig moves onto location, a conventional BOP stack may be latched onto the top of the BOP module 10. A hot stab panel allows the BOP module 10 to be functioned during the workover using an ROV. When the workover is finished, the SIM/BOP stack may be retrieved with the conventional stack by using an ROV to release the H4 connector on the bottom of the BOP module. During the workover, with the conventional stack on top of the SIM stack, the allowable tension in the riser/angle of deviation may have to be reduced to account for the additional distance between the flex joint and the wellhead. A detailed summary of the loads on the BOP module as discussed below.

BOP Actuators

Figure 10:
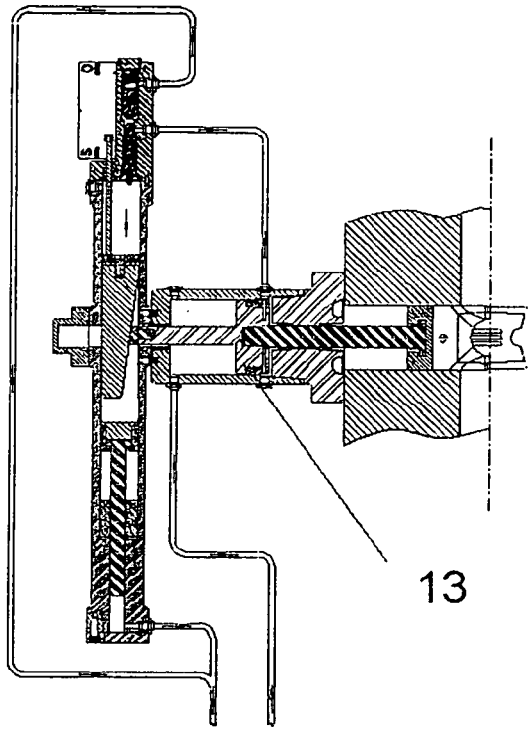
FIGS. 10 and 11 illustrate the BOP actuators in the closed and opened positions, respectively.
Figure 11:
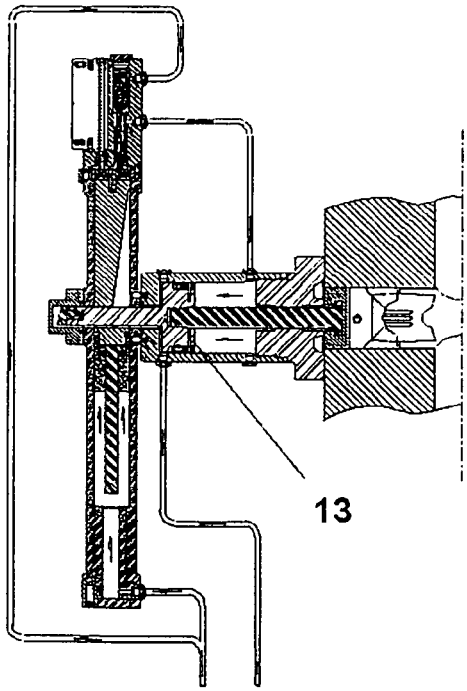

The SIM may utilize deepwater subsea BOP actuators. FIGS. 10 and 11 show the actuators 13 in the closed and open positions. Two hydraulic lines may operate each actuator, one to open and one to close. Hydraulic pressure applied to the closing port moves a piston to the closed position. As the tailrod of the piston clears a wedge, hydraulic pressure moves the wedge behind the tailrod and locks the piston in the closed position. The ram cannot open until after the wedge opens. During the opening cycle, hydraulic fluid enters the auto-lock cylinder and pushes the wedge away from the tailrod. After the wedge is fully open, a check valve opens and redirects the applied hydraulic pressure to the main piston. Two full position indicators are located on each actuator. The main piston's indicator shows whether the ram is open or closed. This indicator is easily visible with a camera for subsea applications. The other indicator is for the auto-lock wedge. The indicator may be positioned on the piston which cooperates with the wedge. When the wedge closes behind the tailrod, the indicator rod moves. The indicator rod protrudes out of the end cap of the auto-lock cylinder and is visible subsea with a camera.

The close position of the wedge may depend on the position of the main piston. Since the main piston is dependent on the position of the ram, there may be a slight deviation from the closed position of this indicator from each side. A marker has a clear area of engagement of the auto-lock wedge. The rams conventionally provide the amount of rubber and squeeze required to seal and for wear of the rubber.

BOP Frame

The BOP module 10 may be capable of withstanding the loads applied by a conventional rig and an 18 3/4-inch—15M, stack assembly. As shown in FIG. 9, the BOP frame 15 may consists of a top and bottom spider composed of a large central hub and W16×100 I-beams and four, 12-inch diameter posts with 1-inch wall thickness.

Since the BOP stack may be constructed of 7 1/16-inch—10M equipment, it is capable of carrying only a small portion of the expected workover loads. Assuming a well pressure of 5,000 psi and a tensile load of 100,000 lbf, the allowable moment transmitted through the stack is about 150,000 lbf ft. Based upon this calculation, the frame needs be about 20 times stiffer than the stack.

Coiled Tubing Module

Primary components of the CT module 20 may include a tool rack 18, a tool holder latching device 62, a tool transport system 76, a coiled tubing injector 80, a reel 82, and strippers 70. The CT module 20 may also include a bottom hole assembly (BHA) sensor 78.

Figure 12:
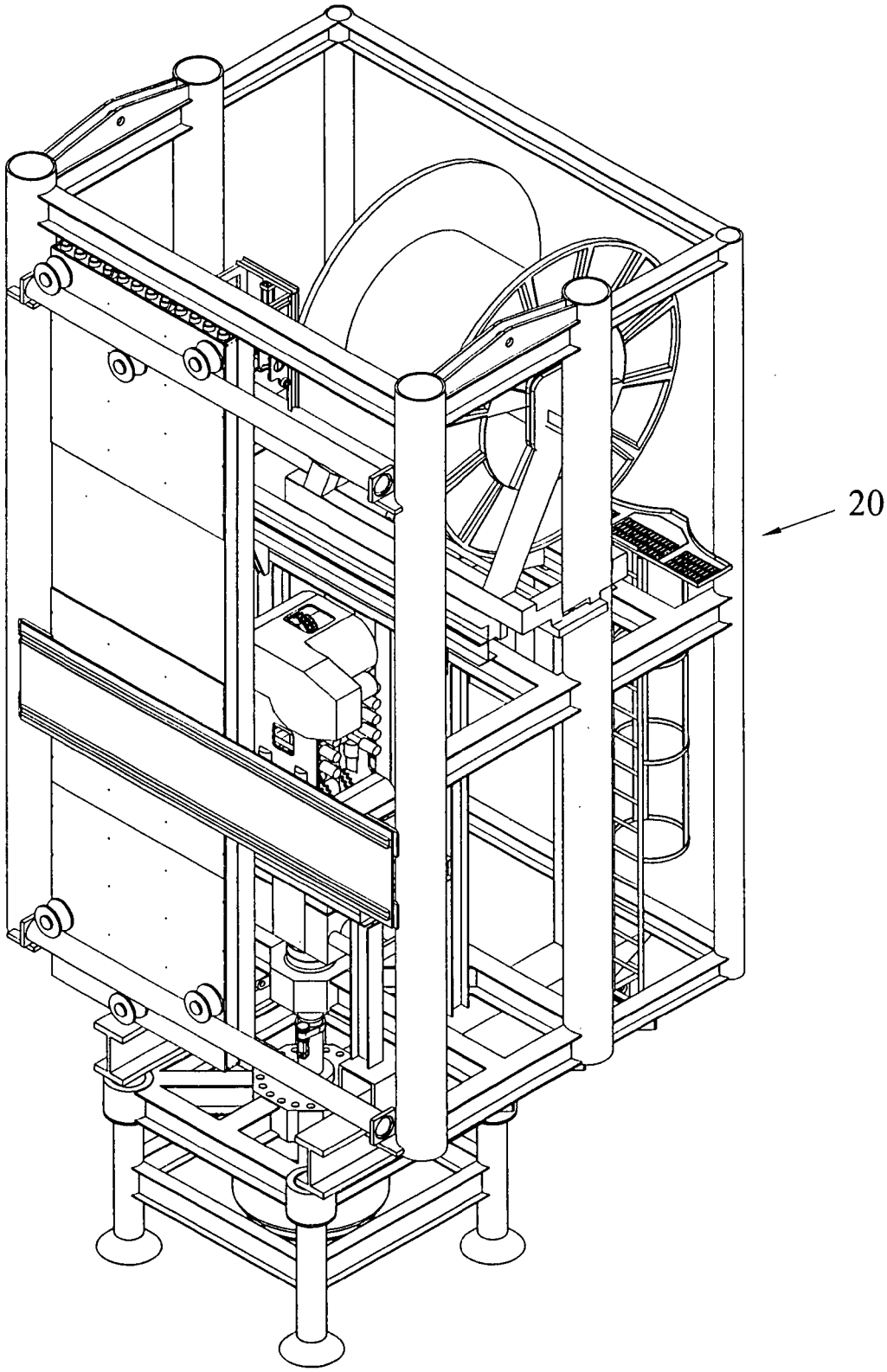
FIG. 12 illustrates a suitable CT module.

The frame 25 of the CT module houses two major components. FIG. 12 shows the basic layout of the module. The bottom section may consist of two large I-beams, an H-4 connector, a small spider structure, two 3¼" diameter hydraulic pistons, and a sealing mandrel. The upper section acts as a mounting frame for the active systems such as the injector and reel and has a skid pad structure and a sealing piston.

Tools may be loaded into the SIM by closing the bottom gate valve on the BOP stack, indexing the magazine to the correct position, and skidding the top section of the CT module, e.g., backwards 48-inches, with the hydraulic cylinders on the lower frame. The tool and tool holder may be lowered from the magazine into the BOP stack. After the top section is skidded back, the lubricant sealing piston 66 seals on the lubricator 68.

When the top section of the CT module is skidded back, it may generate a bending moment of about 1.3-million lbf ft. While this is well below the allowable moment of 2.5-million lbf ft, it preferably will be reduced to less than 800,000 lbf ft. Redistributing the mass and reducing the weight of the upper structure may accomplish this task. As explained below, the CT module frame 25 may be over designed for its purpose of providing a skeleton for housing the components. If even lower bending moments are required, the injector, reel, and strippers may be skidded instead of the entire upper frame. With additional design work, the moment should be reduced to 500,000 lbf ft or less.

Unlike the frame of the BOP module, the CT frame 25 need not support the loads produced by a conventional BOP stack and riser. It does, however, have to withstand significant loads encountered during the deployment of the SIM through the moonpool. Based upon the tests conducted on a larger version of the SIM, a bending moment of 440,800 lbf ft and a shear force of 24,200 lbf was applied to finite element model of the frame. The model predicted peak stress of about 12,000 psi and a maximum deflection of 1 inch. The deployment loads on the current SIM design will need to be verified using DeHoop's numerical model.

All components of the CT module 20 may be designed to operate on hydraulic power. The benefit of hydraulic power in this application was ease of speed and torque control for rotating components and force control for linear actuators. Electric motors 162 may drive the hydraulic pumps 164. The horsepower (input) requirement to the electric motors that power the injector and reel assembly is estimated to be 150 horsepower. Two 75 hp electric motors may drive two hydraulic pumps, which in turn power a single hydraulic motor on the injector. If one of the drive pumps or motors fail, the injector should still be operational but with diminished capacity. The use of multiple hydraulic motors to drive the injector prohibits the use of a closed loop hydraulic system and creates the need for a hydraulic reservoir. Since there are no lane cylinders in the system and there should be good heat dissipation, the pressure balanced reservoir with pressure compensators need only be about 200–300 gallons.

The fluid selected for the hydraulic control unit recognize environmental soundness and compatibility with existing hydraulic components. Due to a high viscosity index, the viscosity of this fluid need not vary considerably due to temperature changes compared to other oils. Like the BOP controls, all of the critical functions may be operated using either the yellow or blue pod or the ROV.

Tool Magazine

Figure 13:
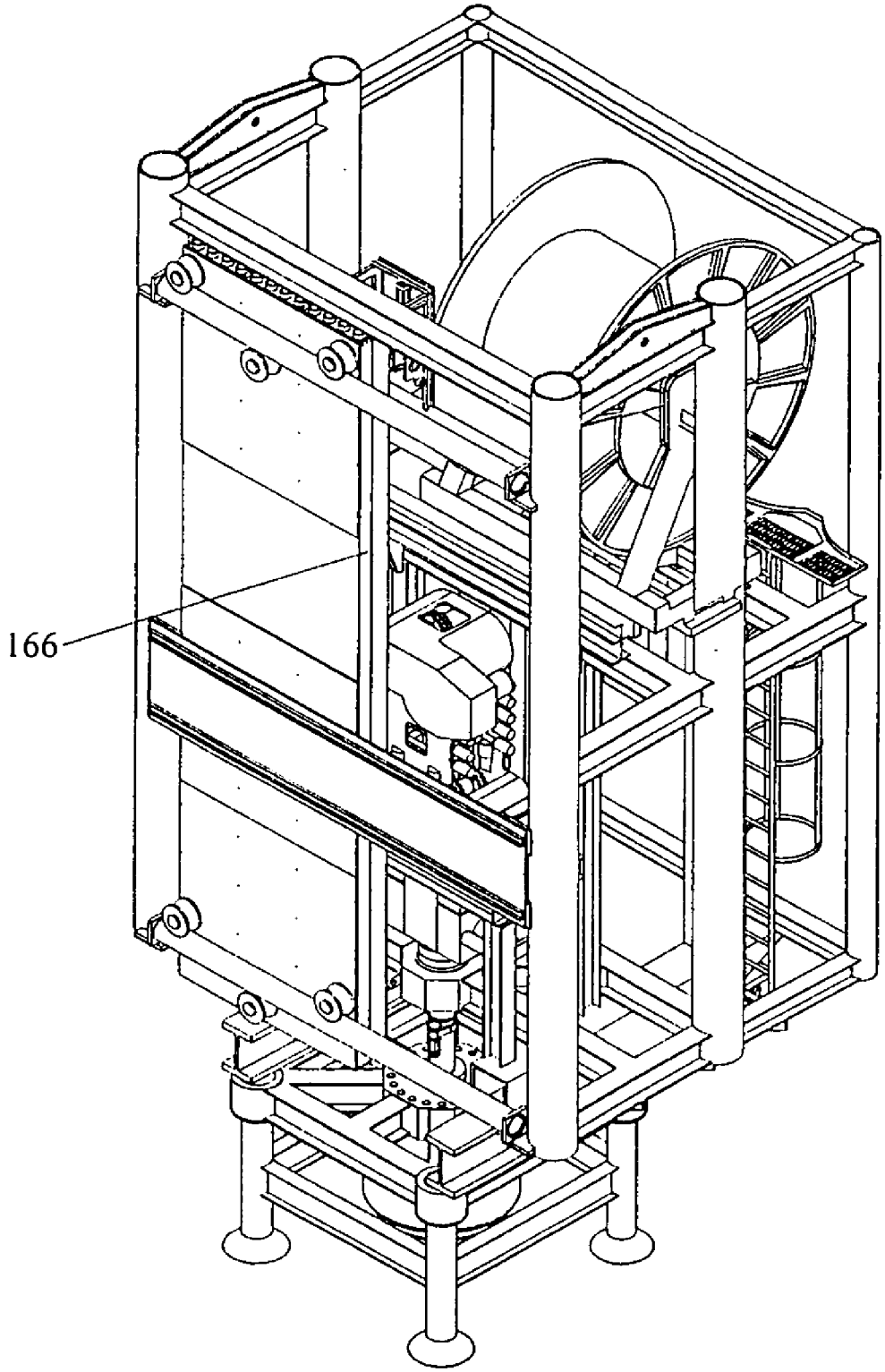
FIG. 13 illustrates a suitable tool magazine located in front of an injector.

The tool magazine 166 may be located in front of the injector, as shown in FIG. 13. All of the tools necessary to complete a workover may be loaded into the magazine while the SIM is on the deck of the ship. Plexi-glass panels may enclose the tools to limit the amount "gray fluid" that escapes into the sea. Two tandem hydraulic cylinders may move the magazine to the correct position, eliminating the need for encoders.

Figure 14:
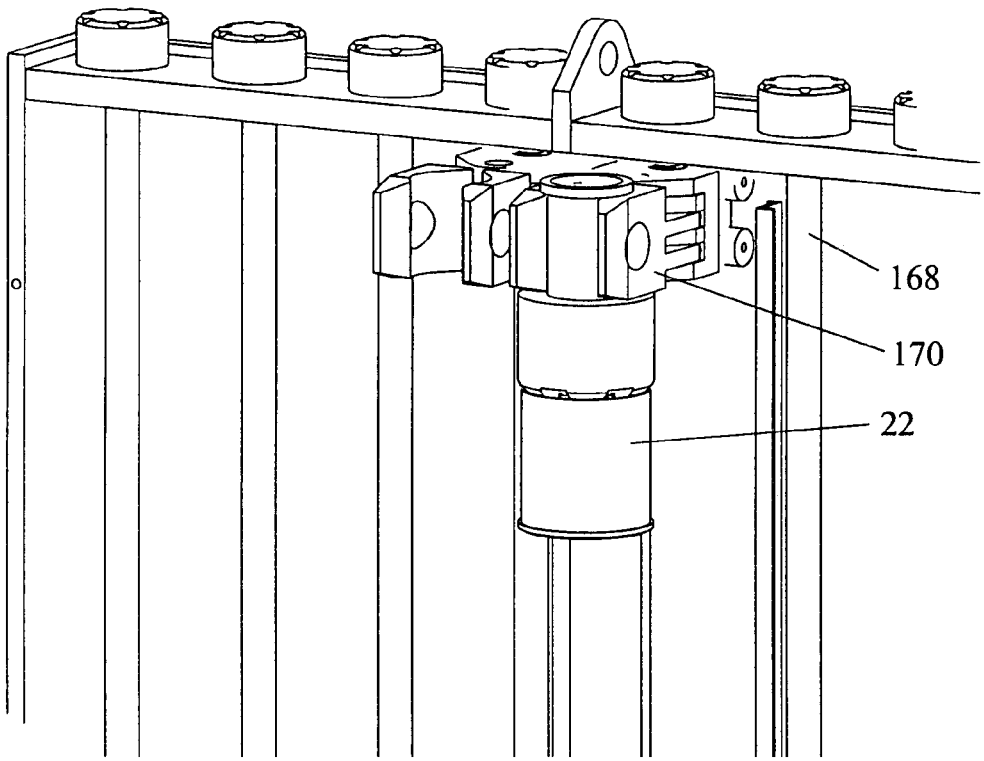
FIG. 14 illustrates the top of a tool holder assembly.
Figure 15:
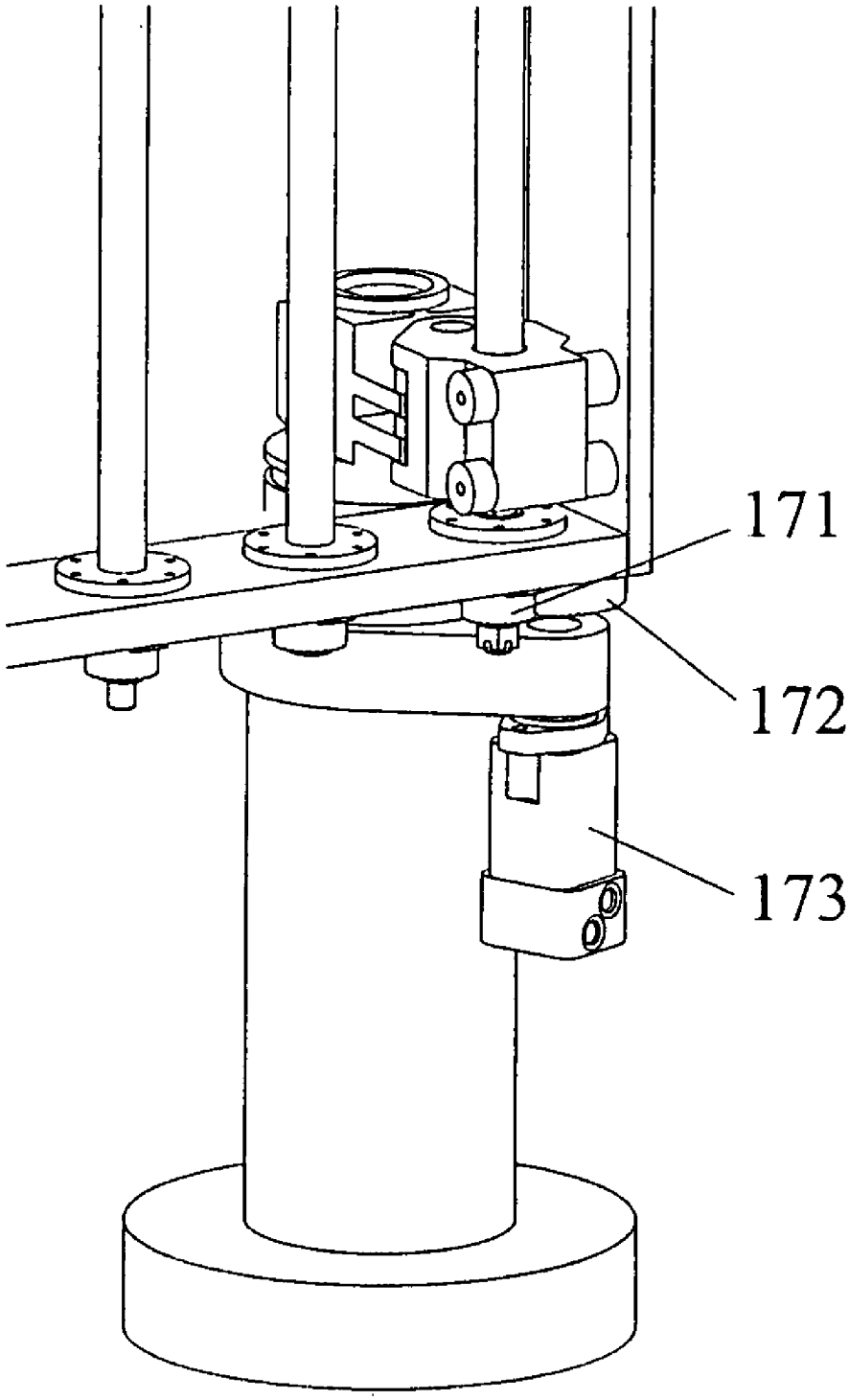
FIG. 15 illustrates a suitable guide mechanism.

In the magazine 166, twelve 1¾-inch 4-pitch lead Acme screws 168 may be provided. Attached to each lead screw 168 is a gripper system 170 which latches onto a fishing neck on the top of the tool holder assembly, as shown in FIG. 14. Each tool 22 may be rigidly held within its own tool holder assembly. A 2½-inch PD gear 171 and thrust bearing may be located at the bottom of each lead screw assembly. When the magazine has been indexed to the desired position and the top position of the CT module 20 has been skidded back, the gear 171 on the end of each lead screw assembly may mesh with a 5-inch PD drive gear 172. An Eaton Series 4000 drive mechanism 173 may drive the drive gear. The drive mechanism 173 is conveniently mounted to the sealing mandrel, as shown in FIG. 15. Once the tool holder and tool have been lowered into the I.D. of the sealing mandrel, the gripper may release the fishing neck on the tool holder, and the top portion of the CT module then skidded forward.

Coiled Tubing Connector and Tool Holder

| The coiled tubing connector was designed with the following specifications: | |
|---|---|
| Max Tool O.D.: | 3.125 inches |
| Min Yield Strength: | 72,300 lbf |
| Tool Connection: | 2⅜" PAC dsi Box x Pin |
| Max Working Pressure: | 10,000 psi |

There are three basic parts to the proposed coiled tubing connector for the SIM. The upper and lower parts of the connector are discussed below, while the tool holder will be discussed thereafter.

Figure 16:
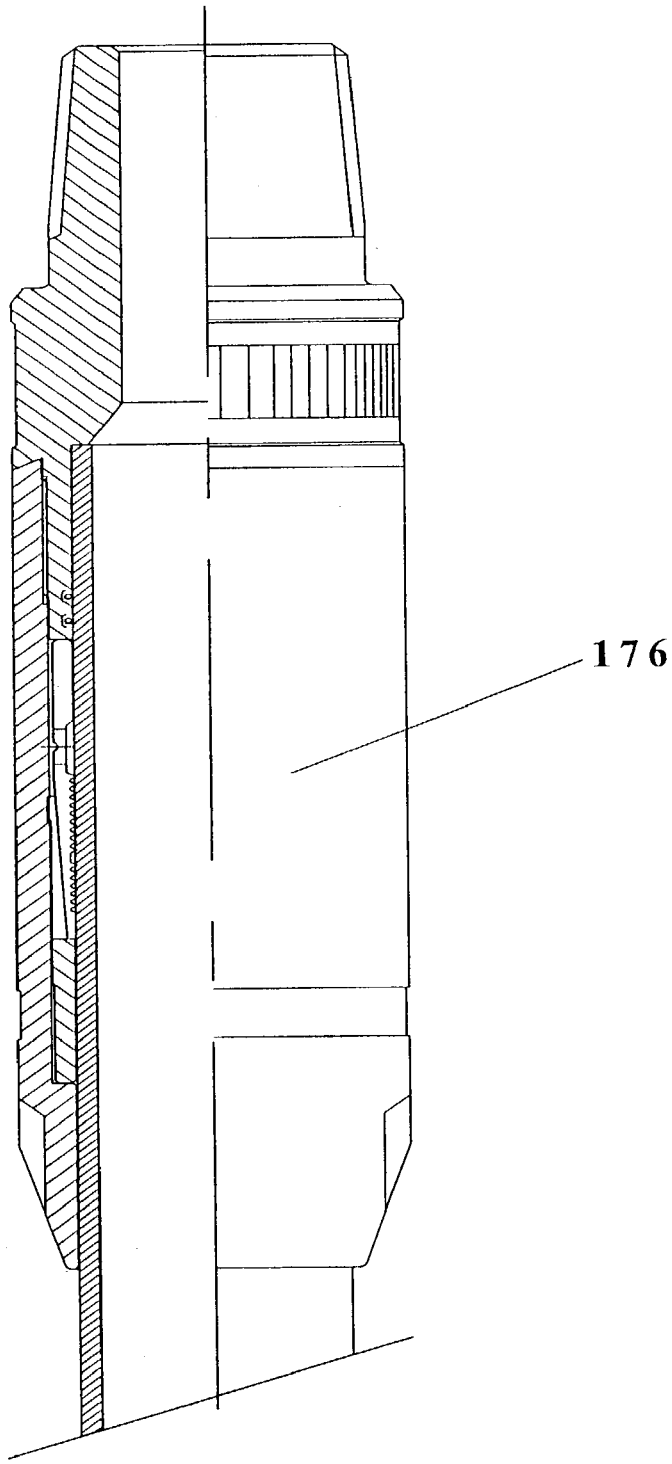
FIG. 16 illustrates a suitable connector.

The connection between the coiled tubing and the upper SIM connector may be a standard, field proven, PCE External Slip type connector 176, as shown in FIG. 16. The connector 176 allows the attachment of coiled tubing to the CT work string via the provision of a threaded connection. The connector utilizes two sets of helical wickers that grip the tubing in a wedging action. When the tension on the connection increases, the gripping force also increases. The special feature of this design are the two opposite hand sets of helical wickers on the slips and tangs that mesh the slip to the bottom sub in order to give excellent tensile properties and high torque resistance.

Figure 17:
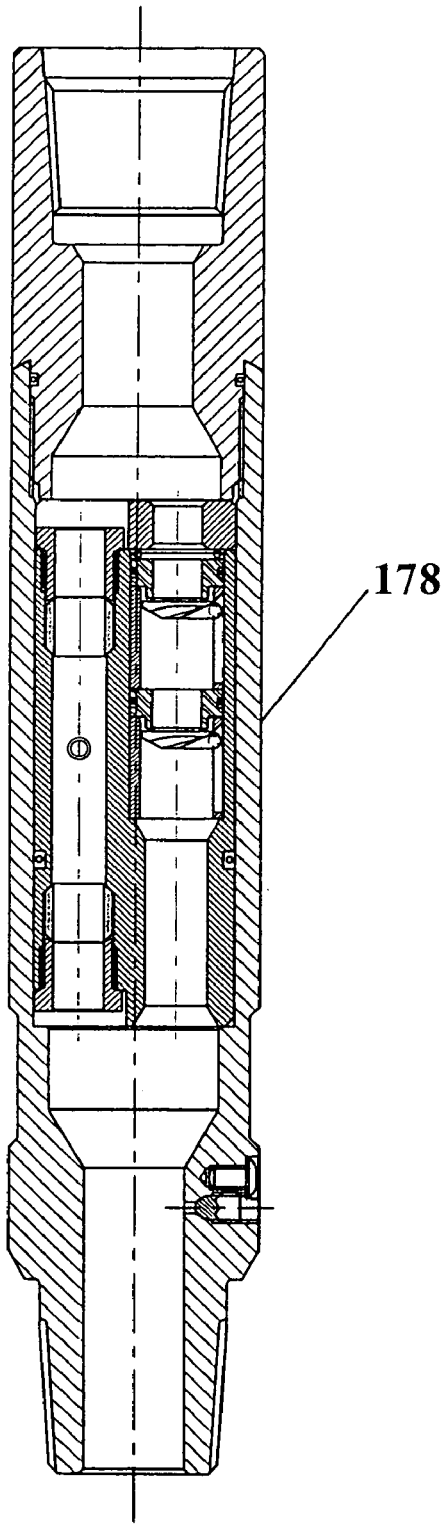
FIG. 17 illustrates a suitable check valve.

Below the connector, a PCE Twin Flapper Check Valve (TFCV) 178 with cable bypass may be provided, as shown in FIG. 17. The TFCV was designed especially for use with logging cable bypass operations. This component provides for routing fluid flow to the lower tool string in sufficient quantity to feed jetting stimulation tools and hydraulic manipulation tools, while also preventing the back flow of well fluids into the coil, in the event of failure or damage to the coiled tubing string or other SIM components.

The design of the TFCV 178 incorporates a dual sealing system in each flapper assembly for increased safety. A Teflon seat may provide the primary low-pressure seal, while at higher pressures, the flappers seal on a metal-to-metal sealing arrangement. The electric cable is packed off with dual rubber elements, forming a cavity. This cavity is then pumped with grease, creating a liquid seal around the cable.

Figure 18:
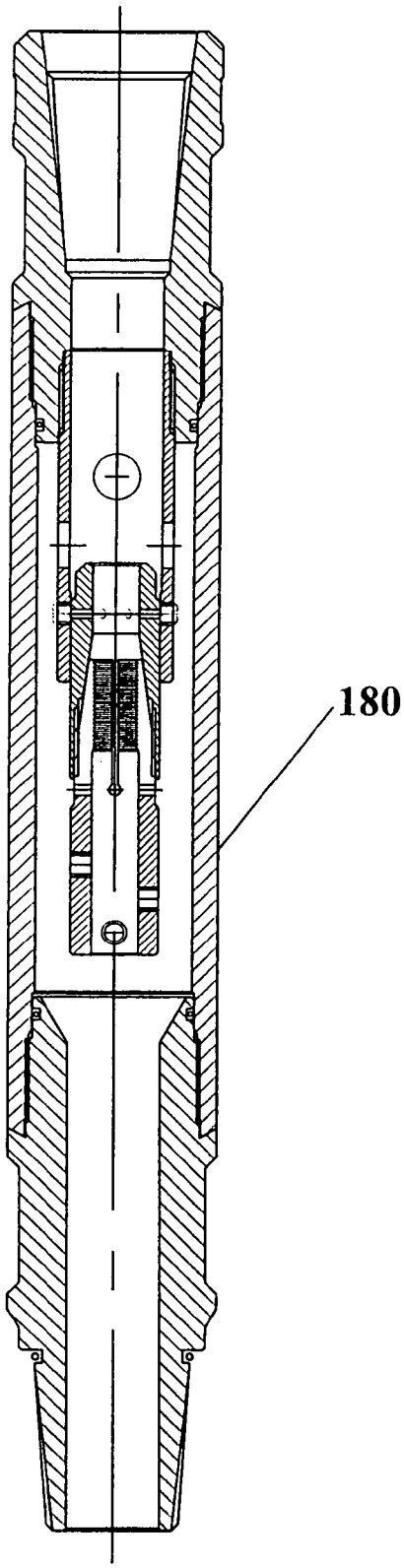
FIG. 18 illustrates a suitable device for anchoring the cable.

A cable anchor 180 is made up below the TFCV, to provide a method of securing the cable end prior to connecting the inner conductors to the tool string. FIG. 18 shows a suitable device 180 for anchoring the cable. The design may be modified to suit the conductor wire feed through when final details of the type of terminations required for the wet connect are defined.

The joint between the upper and lower components of the connector 176 provides the following critical functions:

- A means to activate a controlled disconnect and reconnect from and to the lower part of the tool.
- A means of accurately orienting the two parts to enable wet electrical connections to be made.
- A means to forth an electrical wet connection for up to seven separate conductors with the lower part of the tool string.

Figure 19:
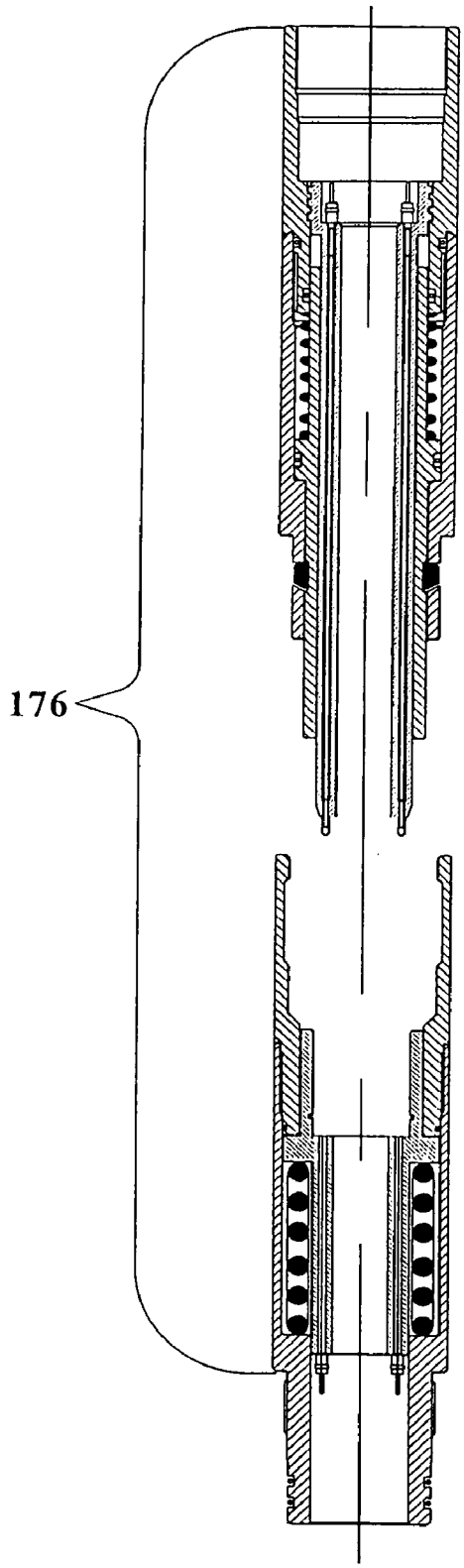
FIG. 19 illustrates a hydraulic mechanical connector.

Two different latch/unlatch mechanisms were considered: one was purely mechanical and the other required both mechanical and hydraulic inputs. In each device, the top section may be aligned with the lower section, with a roller located in the tool holder and helical guide located on the connection. The two pieces may be latched together by applying a downward force on the coiled tubing. The downward force may actuate four spring-loaded locks, locking the two sections together. After the tool has been locked, the injector may pull up with 2,000–3,000 lbf to verify the integrity of the connection. The hydraulic mechanical connector is shown in FIG. 19. To release the connection 176, the tooling tube is pressurized to a specified pressure and a specified over-pull is applied to the tool. The over-pull opens ports in the tool and allows the applied pressure to activate a piston, which releases the joint locking mechanism. After the hydraulic pressure has been bled off, the piston returns to its original position. In this state, the upper connector is ready to be relatched. This design provides a safety release if the coiled tubing string becomes stuck during a service operation. In the event that the top connector has been released during a service operation, the lower part can either be re-latched with the same connector or fished using the internal fishing neck on the lower part of the connector.

Figure 20:
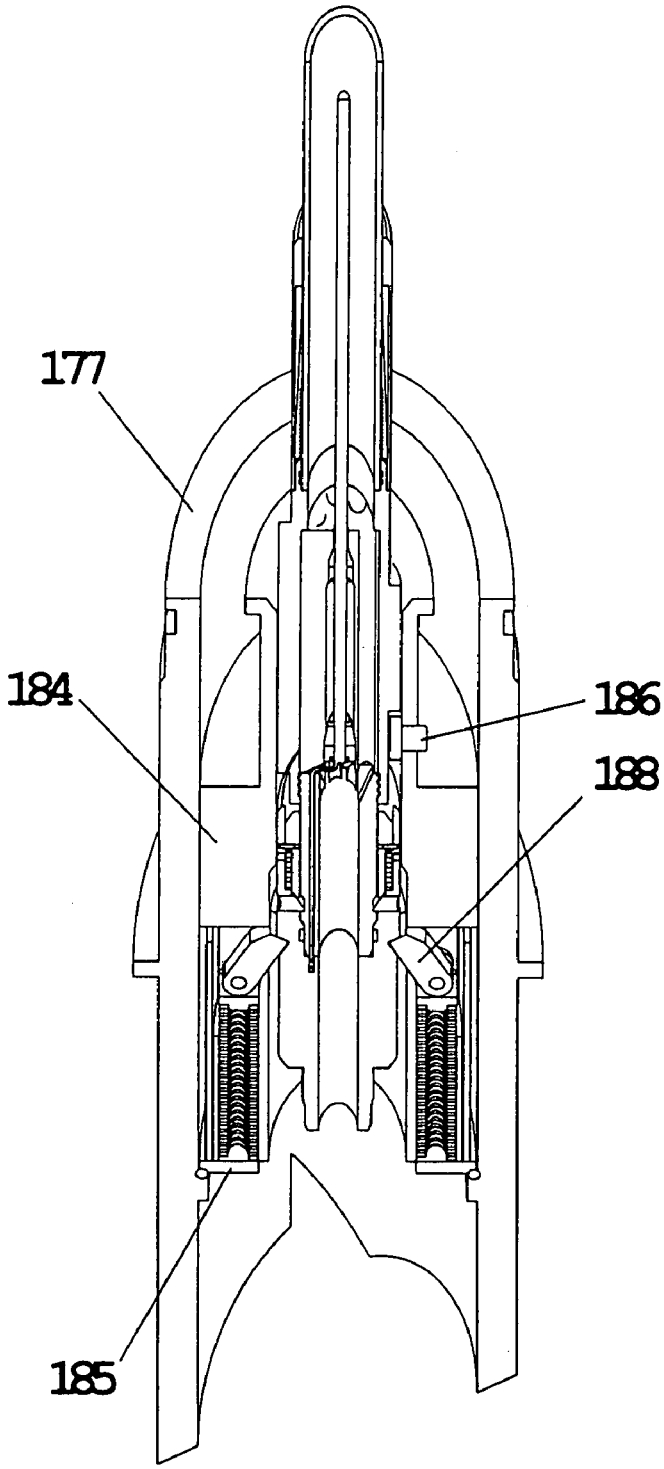
FIGS. 20 and 21 illustrate a latch/unlatch mechanism.
Figure 21:
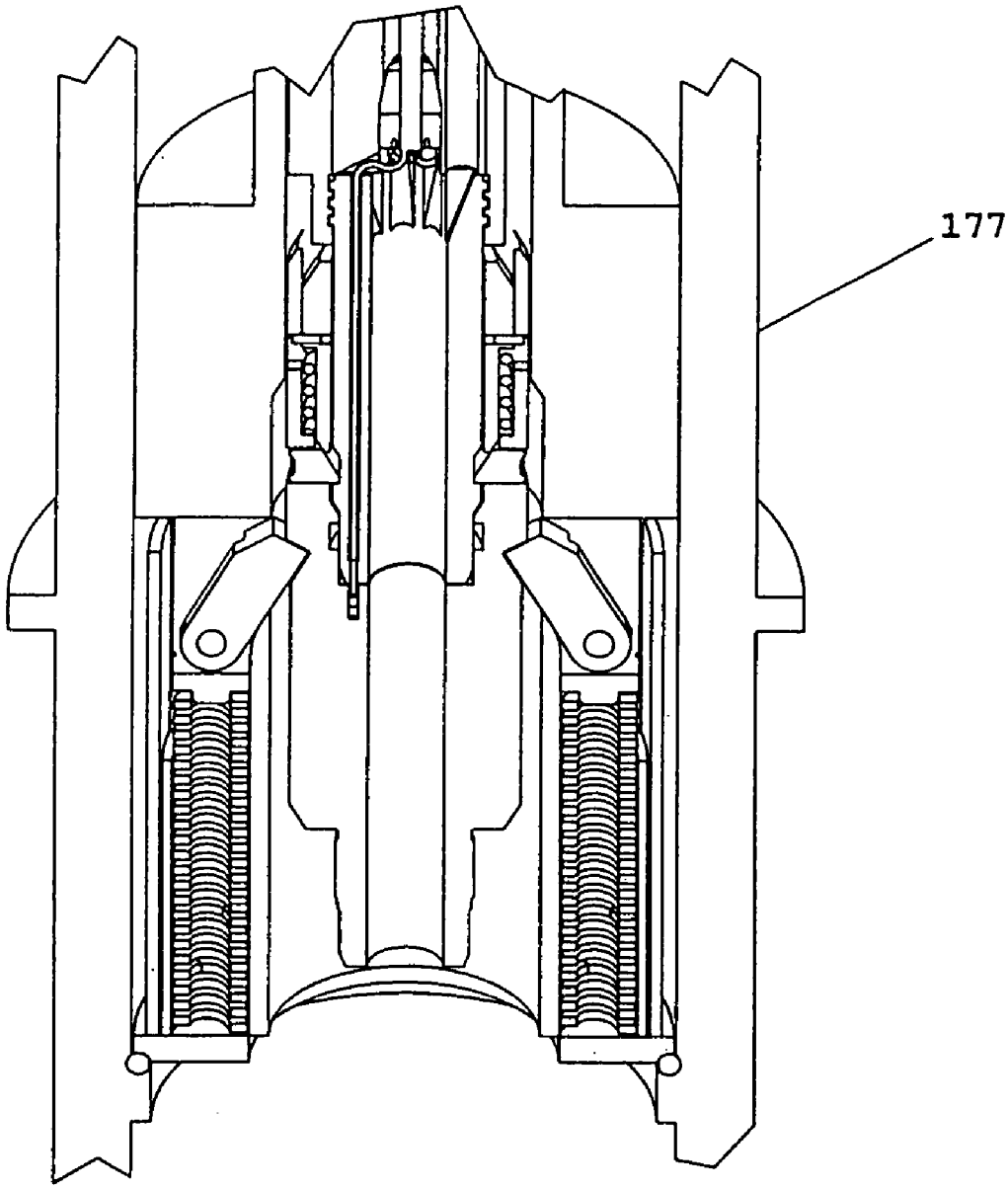

The second latch/unlatch mechanism 177 is shown in FIGS. 20 and 21. In this design, contact between a key on the holder and a release sleeve on the connection unlatches the connection. The connection may only be unlocked by the key in the tool holder.

Although there are a number underwater electrical connectors available, most cannot be readily made to fit into the restricted space of upper and lower connector and still provide a fluid flow path to the lower tool string. After speaking with a number of companies, one company which specializes in this type of connector indicated that they may have a connector which can be adapted to suit this application. This electrical connector has a history of use on subsea platforms and is capable of multiple make and brake cycles in silty seawater at a rated voltage of 950 v under light current (0.5 amp) conditions. An improved connection is disclosed in U.S. patent application Ser. No. 10/212,035, filed Aug. 6, 2002 and entitled Remote Operated Tool String Deployment Apparatus, and in U.S. patent application Ser. No. 10/136,362 filed Aug. 7, 2002 and entitled Remote Operated Coil Connector Apparatus.

Figure 22:
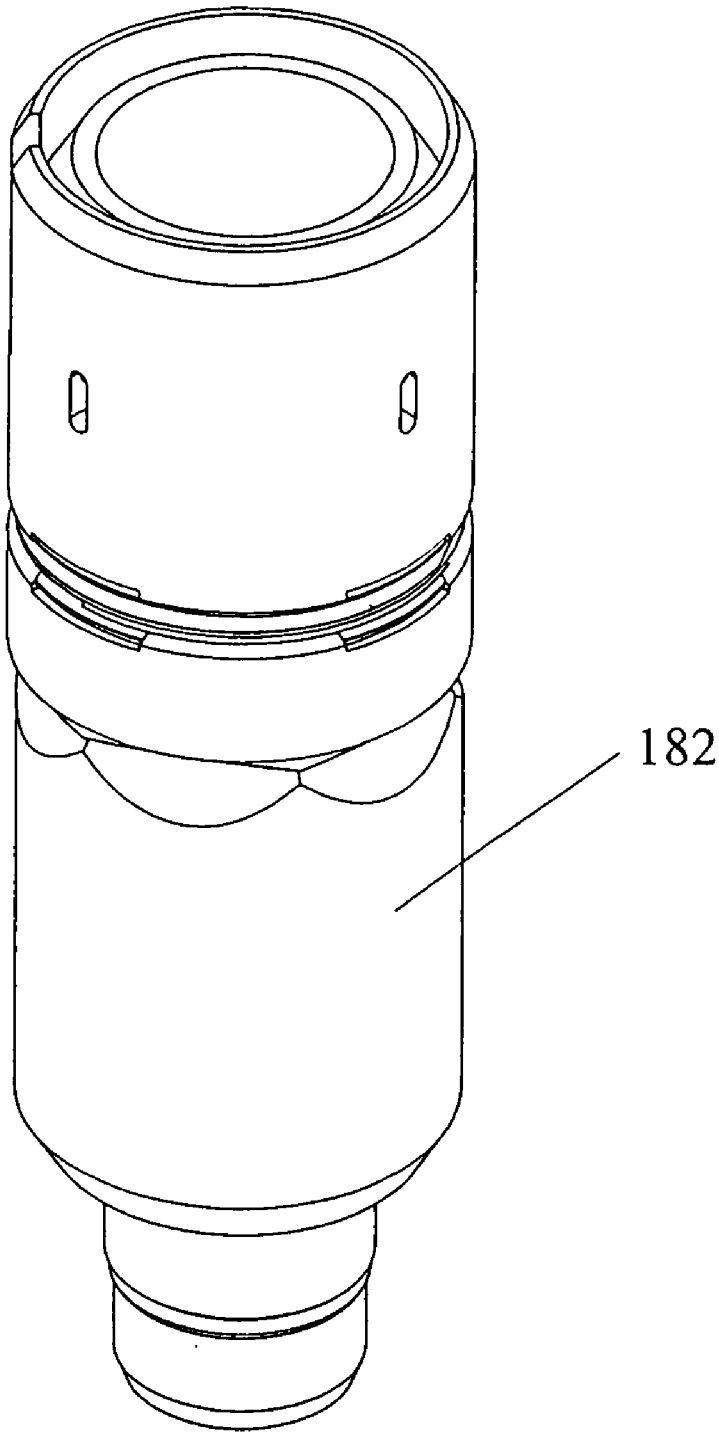
FIG. 22 illustrates a suitable adapter.

The lower portion of the connector 176 may contain the other half of the wet-connect and provide a means for attaching standard downhole tools. These two tasks may be accomplished by using an adapter 182, as shown in FIG. 22. The bottom of the tool adapter 182 may be a standard industry threaded connection. Intervention tools, or combination of tools up to 28 feet long, may be attached to this threaded connection 176 and the adapter 182, and the assembled intervention tools then installed into the tool holder.

Tool Holder

The adapter 182 shown in FIG. 22 rests on top of the tool holder 184. The tool holder 184 supports each well intervention tool in the carousel tubes and provides a uniform method of connecting the CT and control cable with any of the twelve available intervention tools. Each tool holder is supported on a thrust bushing 185 and is therefore free to rotate. Since the tool holders self-align to the coiled tubing connector via an alignment roller 186, radial orientation of the tool holder within the tool holder tube is not critical.

The spring-loaded latches 188 in the tool holder may support the weight of the tool and the downward force applied to engage the top and bottom sections of the connector. Increasing the load further pushes the latches out of the way, allowing the tool to be tripped into the hole. When the connector assembly is pulled back up into the tube, the spring-loaded latches resecure the tool in the holder. An assembled tool string, holder and adapter may be retrieved from or added subsea by an ROV.

CT Module

The CT module 20 may contain an injector, a set of strippers, a reel assembly, and a seawater pumping system. Placing the injector in a subsea environment creates technical problems. The solutions that were investigated were 1) placing a standard injector, with slight modifications, in an environmentally friendly chamber and 2) designing a marinized injector. The primary concern associated with marinizing the injector was that corrosion and lack of lubrication, or diluted lubrication, of critical components may cause premature failure of the injector.

The preliminary design specified that the injector be located inside a nitrogen gas containment dome. The top of the dome was sealed off by a low-pressure stripper and the bottom was open to the seawater. As the SIM descended to the wellhead, nitrogen was pumped into the containment dome to displace seawater. This concept was modified due to the large quantity of nitrogen required and the difficulty in regulating the level of nitrogen in 10,000 feet of water.

The nitrogen gas was replaced with oil and the containment dome was sealed from atmosphere and seawater on all sides. An oil with good environmental and corrosion inhibiting properties was chosen. Low-pressure strippers sealed the top and bottom of the injector. These strippers experience very little differential pressure and thus do not need to be nearly as robust as standard coiled tubing strippers.

The containment vessel was fabricated using structural steel channel as a support structure. This support structure enclosed the injector on six sides. Twelve, one eighth inch steel plates were bolted to the support structure. Gaskets sealed the plates to the structure. The plates were sized to minimize the load on the plates due to the hydrostatic head imparted on the plates by the oil in the containment vessel while the structure was above sea level. The plates also allowed access to the injector for maintenance and inspection. Pressure compensation was required to prevent any pressure differential between the seawater and the oil in the containment vessel. For that reason, a pressure-compensating device consisting of a modified bladder accumulator was mounted on the containment vessel.

Before the injector may be accessed, the containment vessel must he evacuated of oil. The quantity of oil in the containment vessel was calculated at 1,600 gallons. An oil reservoir with several times the volume of the containment vessel is especially required as support equipment on the deck of the boat. A transfer pump with associated hardware is also required to shuttle the oil between the reservoir and the containment vessel as a prerequisite to maintenance.

Other modifications to the injector are required to operate under high hydrostatic pressures. Most injectors incorporate a gear case to transfer power from the hydraulic drive motor to the injector chain. The gear case was designed as an oil-bath lubricator, and therefore the oil level in the gear case is typically only filled to approximately two-thirds the available volume of the gear case. For subsea operation, the air in the gear case would have to be evacuated completely. A pressure compensator would replace the usual vent.

Another area of concern was the rollers. With the HydraRig injector design, the rollers transmit the traction force from the skate to the tubing gripper. The rollers contain a set of needle roller bearings that are packed in grease and sealed with lip seals at the inner race of the bearings. A pressure-compensating device was added to equalize the pressure on both sides of the seals. In this case, the pressure compensator was located in the shaft of the bearing. The grease is fed from the pressure compensator in the shaft to the bearings through passages in the shaft. A simpler solution to this problem is to replace the needle roller bearing with a bushing and to increase the diameter of the shaft to reduce the bearing stress on the bushing.

Marinized Injector

While enclosing a standard injector in an oil-filled containment vessel was a quick and viable solution, the additional strippers and limited access to the injector created an objectionable package. Therefore, the preferred solution involved redesigning the injector to operate in a marine environment. A HydraRig model 5100 was evaluated as a possible candidate for marinization. Unfortunately, many of its components were designed near the maximum allowable stress limits for high strength alloy steels. When exposed to seawater, the highly stressed components may corrode, crack and fail. In addition to the corrosion problem, the stress level in the components needs to be reduced.

Beginning with the corrosion problem, one solution was to replace the alloy steels with corrosion resistant alloys. Unfortunately, the strength of corrosion resistant materials typically was not capable of competing with alloy steels for strength. Typical stainless steels would not handle the stress. The high strength requirements of some key components of the injector parts forced consideration of very expensive materials, such as MP35N and Inconel 71S. Parts such as the traction cylinder shafts, sprockets, and rotating shafts may be made from less exotic materials such as A-286 and 17-4PH. Anodic protection was selected for structural parts with stress levels that did not justify a material change.

The HydraRig 5100 injector is capable of applying more than sufficient amounts of force to the coiled tubing for the workover tasks that the SIM will be performing. The HydraRig 5100 injector was rated for 100,000 pounds lifting capacity. For 80 ksi tubing, 80,000 lbf should be sufficient to part the coiled tubing. This high force would be required at a low speed, however, and would require a small amount of horsepower. The HydraRig 5100 also has a rated speed of 180 fpm. A speed of 150 fpm is likely the highest speed that the SIM would operate. The force and speed of the injector will be limited by the control system. Since the SIM will only rarely operate at high speeds and/or loads, material substitution provide a good foundation for a marinized injector design. The required horsepower to be delivered to the primary mover of the injector system may be about 100 hp (75 kW).

Another serious difficulty with marinizing the injector is maintaining proper lubrication on the critical components. The principal cause of failure of injector chairs has typically been lack of lubrication. To minimize this problem, Hydra Rig has included a spray lubrication system for the chain on all injectors. The injector operator periodically activates a lube spray system. For this application, the lubricant would have to be applied before deployment. The lubricant would need to penetrate into bearing surfaces, displace any water in the bearing surface, and then setup to provide a barrier to minimize intrusion of water into bearing surface.

The chain manufacturer has recommended a lubricant designed for this application. The manufacturer claims the lubricant will stay on the chain in dynamic conditions under water for several months. The manufacturer has developed an application method where the chain would be sprayed with the lubricant before deployment of the injector. The lubricant was designed to penetrate the clearance spaces, displace any water in the spaces, and then set-up to prevent intrusion of water after deployment.

The injector assembly according to the preferred system is marinized and is either retrievable subsea or reliable enough so the chance of failure is very, very low. The injector is capable of passing an upset such as the BHA, without removing gripper blocks. If the injector is marinized with recommended corrosion resistant materials, testing will verify the lubrication vendors' claims. In spite of the expected difficulties, the preferred solution for the SIM system is a fully marinized injector that may be opened up to pass a BHA. Replacement of the injector subsea should also be possible, requiring that the injector be designed to wrap around the coil. Such a design will also facilitate changing out reel assemblies.

Compensated Roller Assembly

Figure 56:
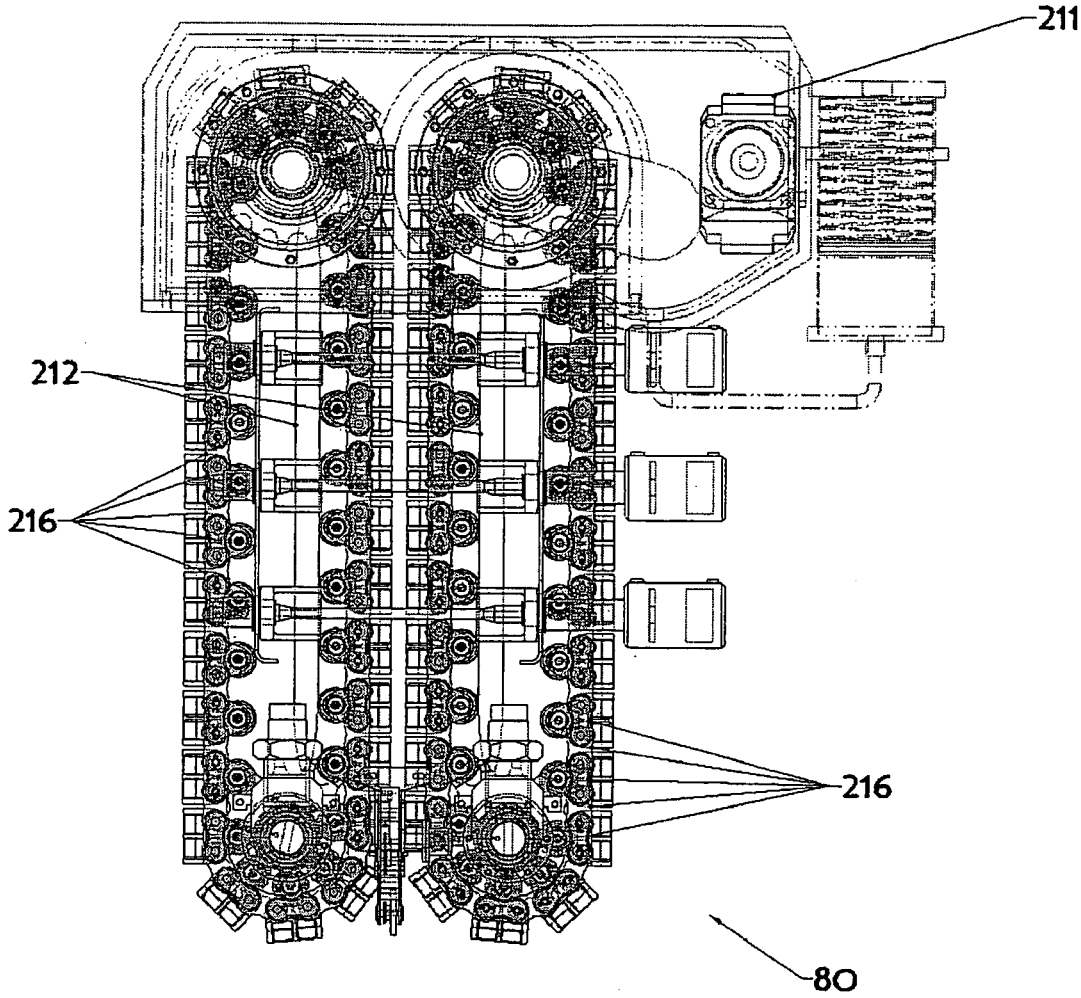
FIG. 56 is a cross sectional view of a conveyed coiled tubing injector according to the present invention, with two opposing chains.

An exemplary coiled tubing injector 80 according to the invention utilizes a traction assembly 212, as shown in FIG. 56, to engage the coiled tubing and thereby drive the coiled tubing into or out of the well. A typical traction device comprises opposing grippers 214 that move laterally with respect to the tubular, thereby pressing the chain link members 216 moving in an endless loop into gripping engagement with the tubing. Each chain link member 216 thus moves longitudinally with respect to the stationary grippers 214 to move the tubing with respect to the tubing injector.

Figure 57:
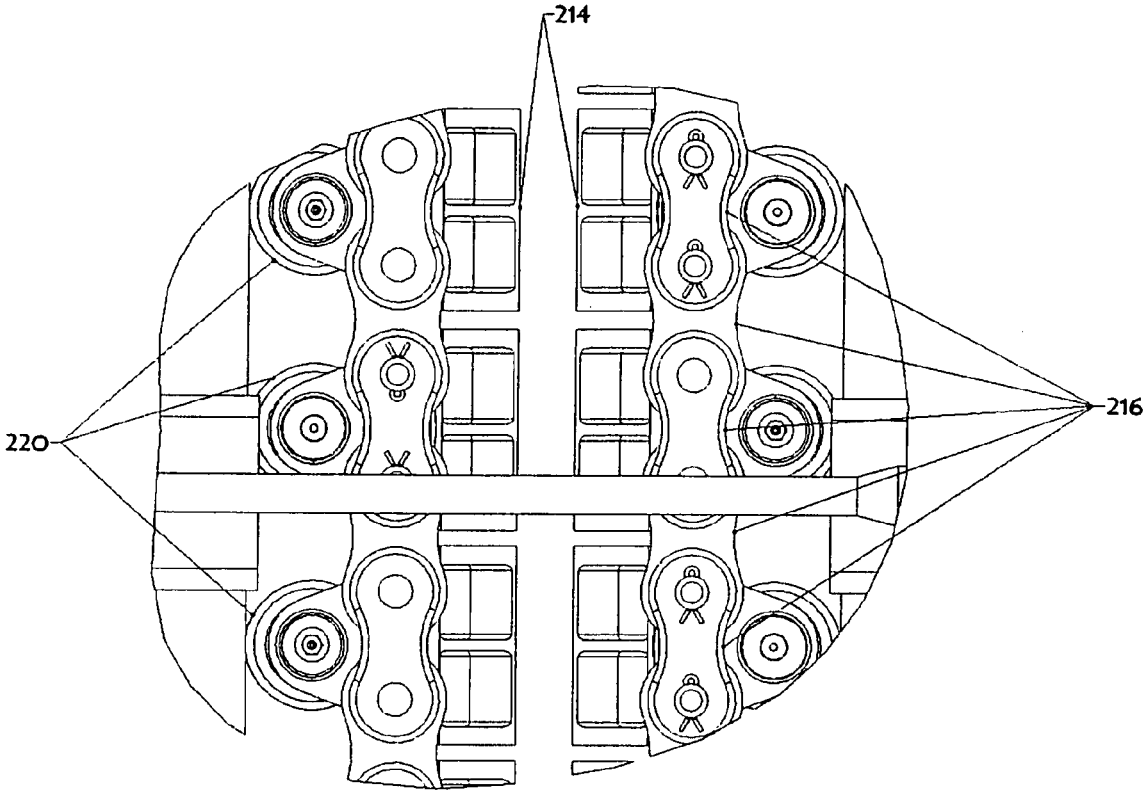
FIG. 57 is an enlarged view of a portion of the injector shown in FIG. 56.
Figure 58:
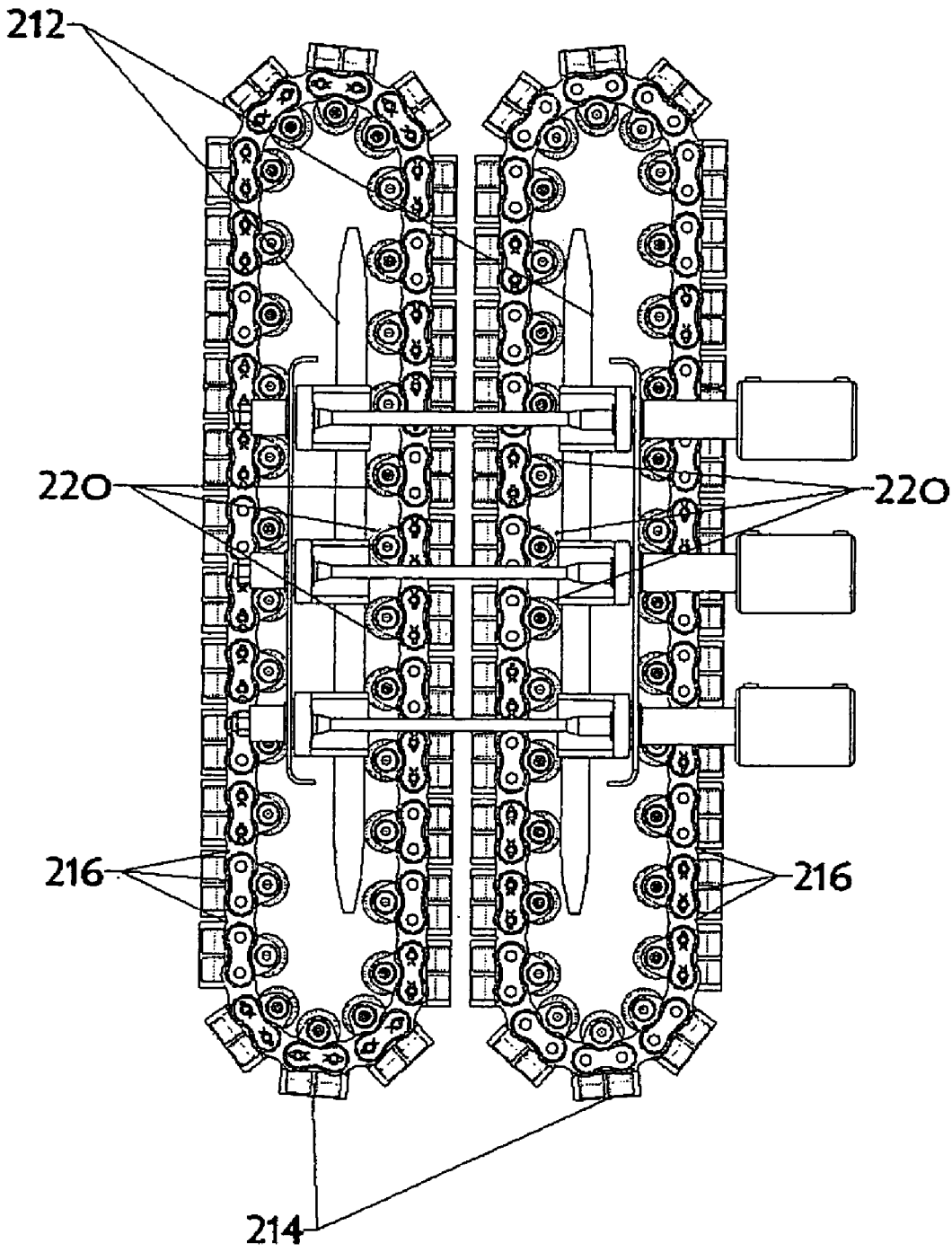
FIG. 58 depicts rollers attached to chain link segments, so that the rollers ride on the base of the gripper.
Figure 59:
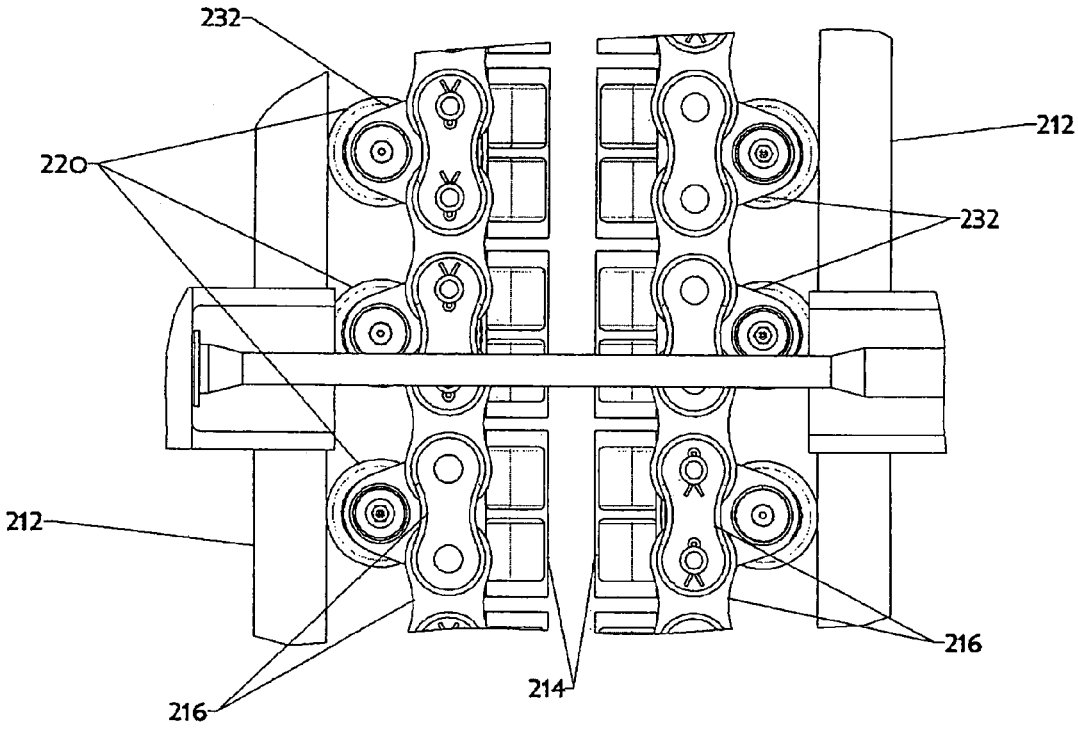
FIG. 59 is an enlarged portion of the assembly shown in FIG. 58.
Figure 60:
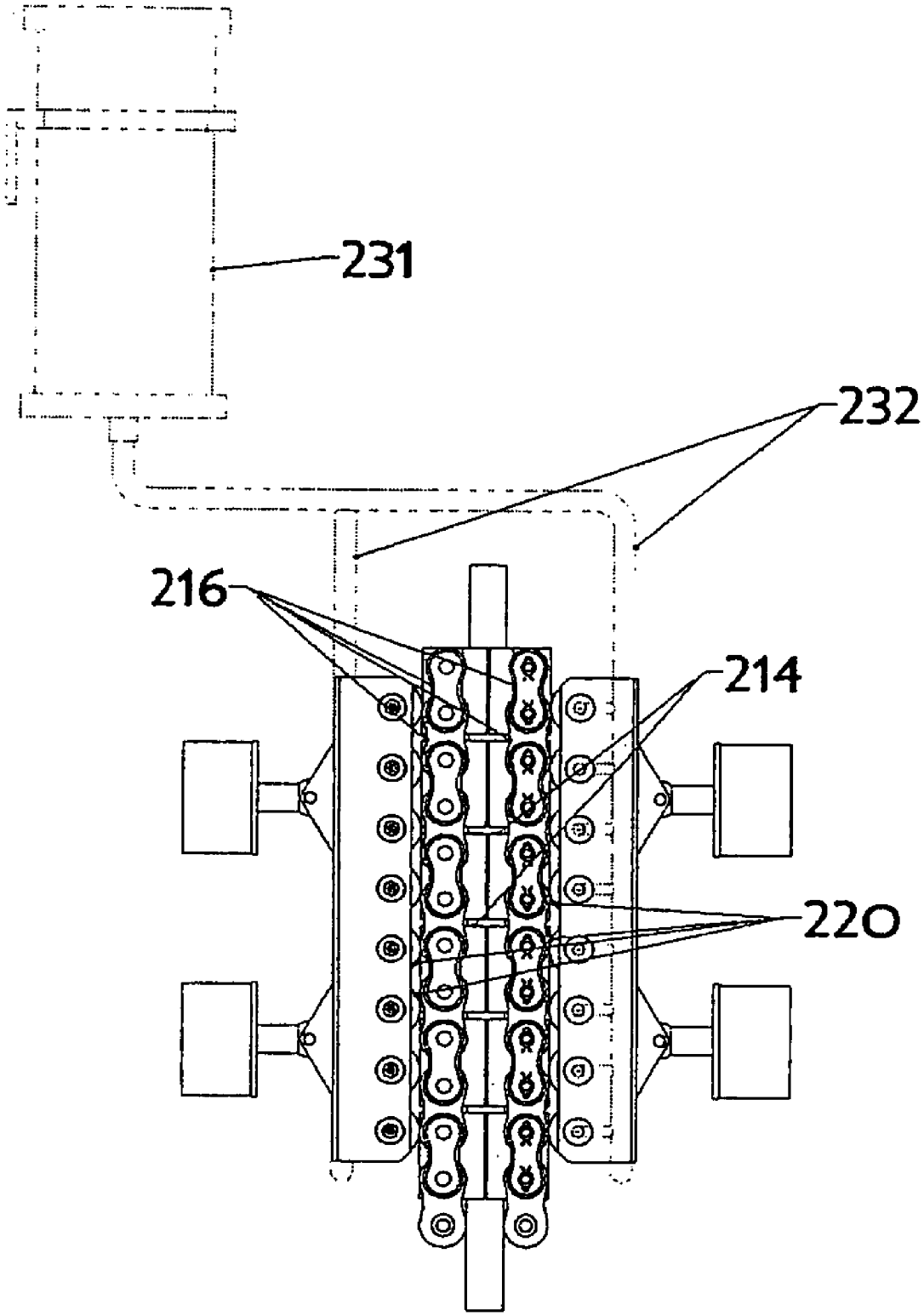
FIG. 60 illustrates rollers mounted on the carrier of opposing gripper blocks, so that the chain link members move relative to the rollers.

Roller bearings 220 provided on the chain link members 216 allow for a large lateral load to be applied from the grippers to the longitudinally moving chain links, preferably without inducing a significant longitudinal drag load. For the embodiment, as shown in FIG. 57, the rollers 220, as shown in FIG. 58, are attached to the chain link segments 216 and thus ride on the base or skate of the gripper 214. For the design, as shown in FIG. 60, the rollers 220 may be located in a carrier supported the gripper blocks, so that the chain link members 216 move relative to the rollers 220. The fluid powered or electrically powered drive motor 211 rotates the links of each endless loop chain.

Figure 61:
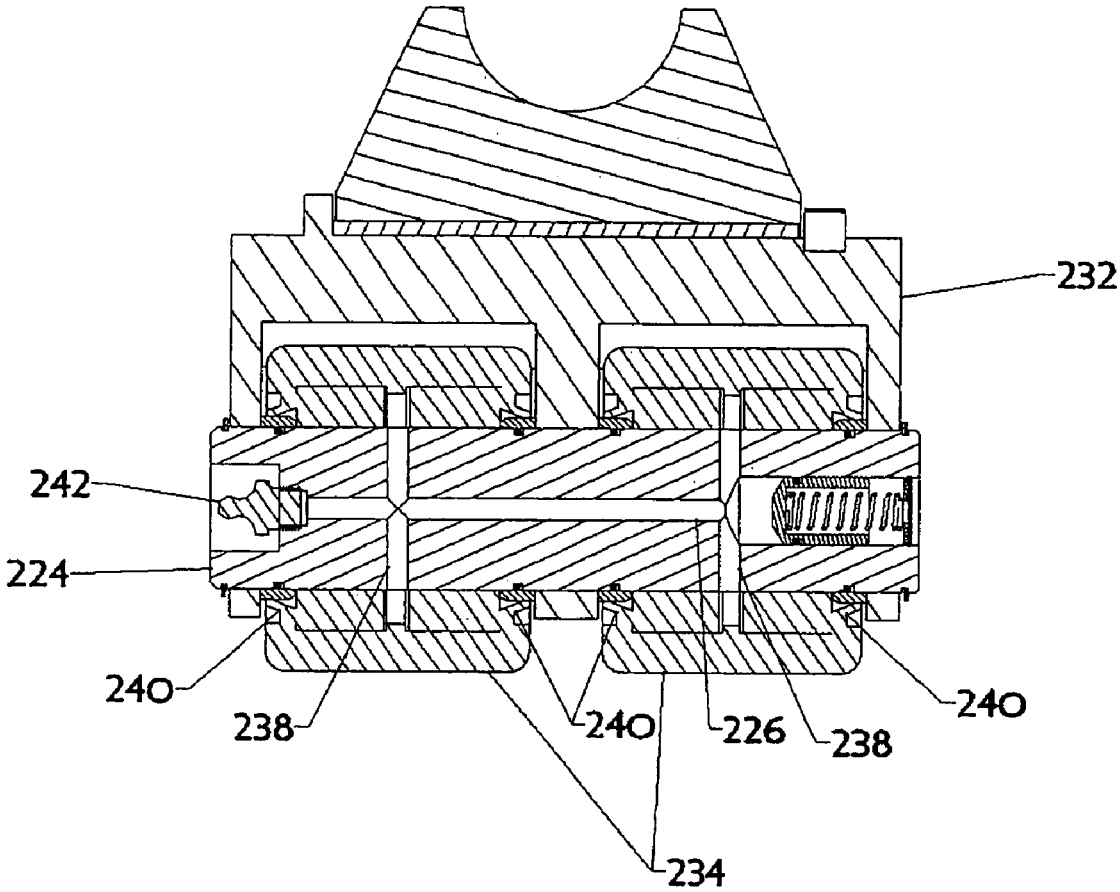
FIG. 61 illustrates a cross-section a roller or bearing with a pressure compensating device located within the shaft of the bearing.
Figure 62:
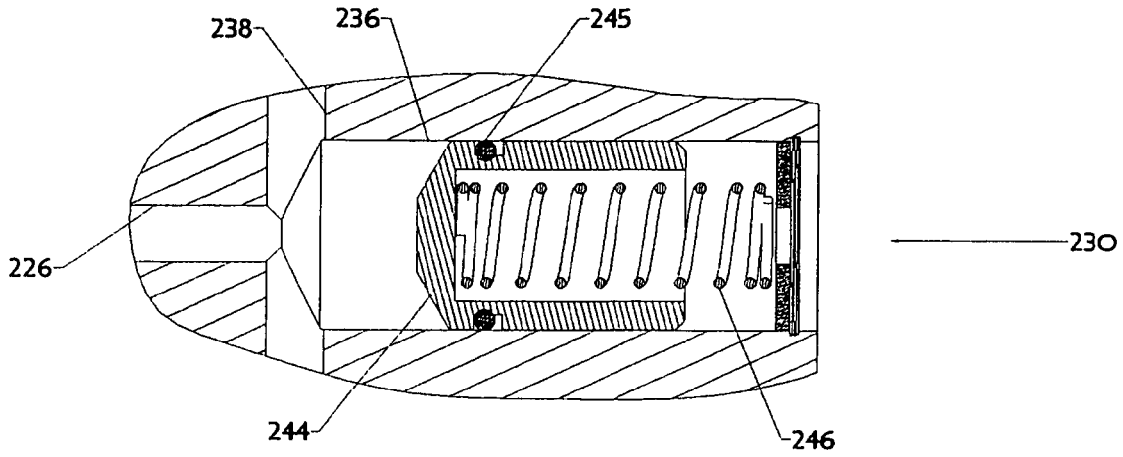
FIG. 62 illustrates in greater detail a portion of the roller shown in FIG. 61.
Figure 63:
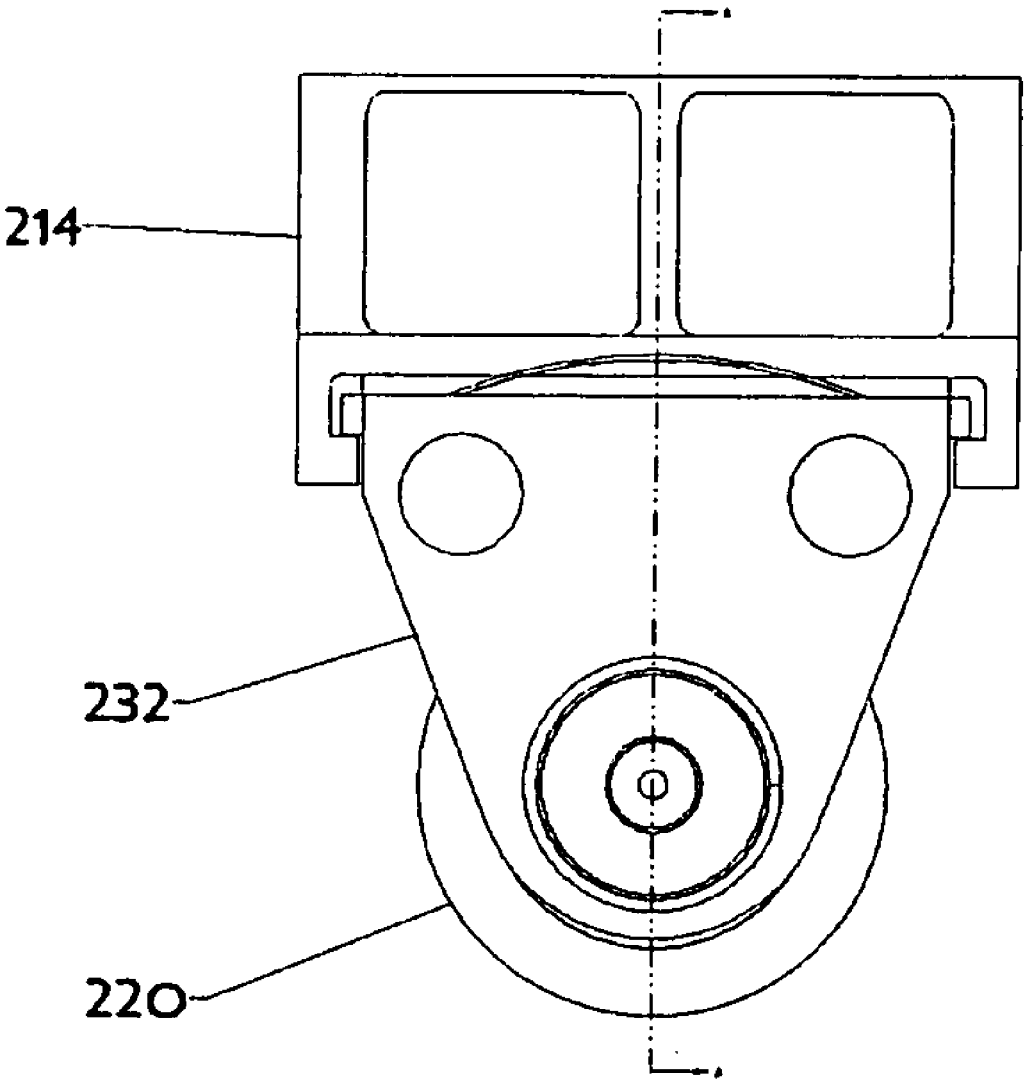
FIG. 63 is a side view of the roller shown in FIG. 61.
Figure 64:
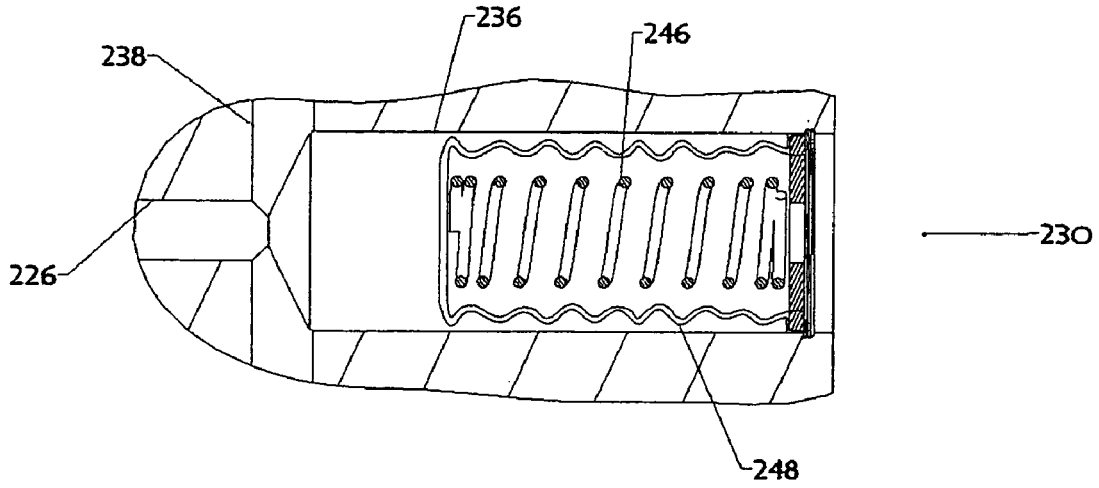
FIG. 64 illustrates a portion of a shaft with a diaphragm separating the lubricant passageways from the subsea environment.
Figure 66:
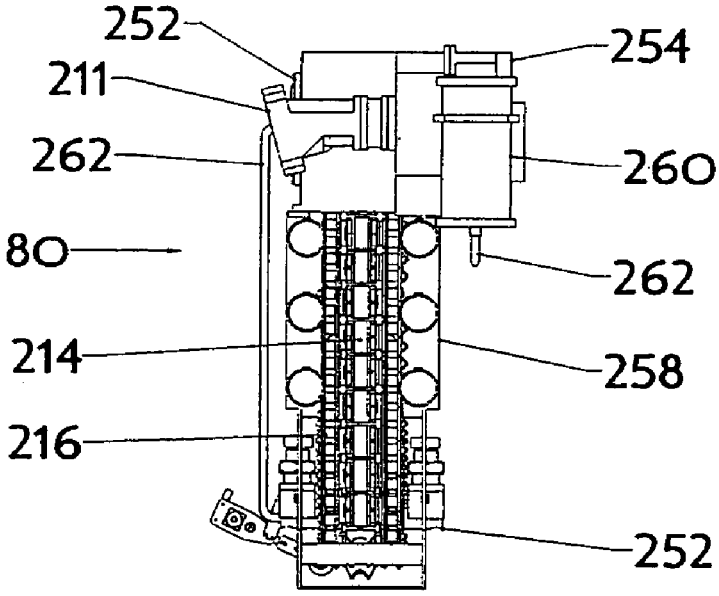
FIG. 66 is a side view of the injector shown in FIG. 65.

According to the present invention, differential pressure on the roller bearings 220 in the traction assembly 212 of a tubing injector 80 used in a subsea operation is reliably controlled to a desired low level. For the design, as shown in FIG. 61, a pressure compensating device 230, as shown in greater detail in FIG. 67, may be mounted in each bearing shaft 224, as shown in FIG. 66, and a lubricant provided to the bearing via a lube passage 226. The frame 232 of the bearing assembly may thus be secured to one of the chain link segments 216, and preferably a pair of rollers 234 are provided on shaft 224. Fluid passageways 226, 238 thus provide lubricant to the bearings, with the seals 240 sealing between the subsea conditions and the fluid within the lubricant passageways. A check valve, such as a lubricant zirc 242, may be mounted on the shaft 224 for filling the passageways 226, 238 with lubricant, and closing to seal lubricant from the surrounding environment.

Figure 48:
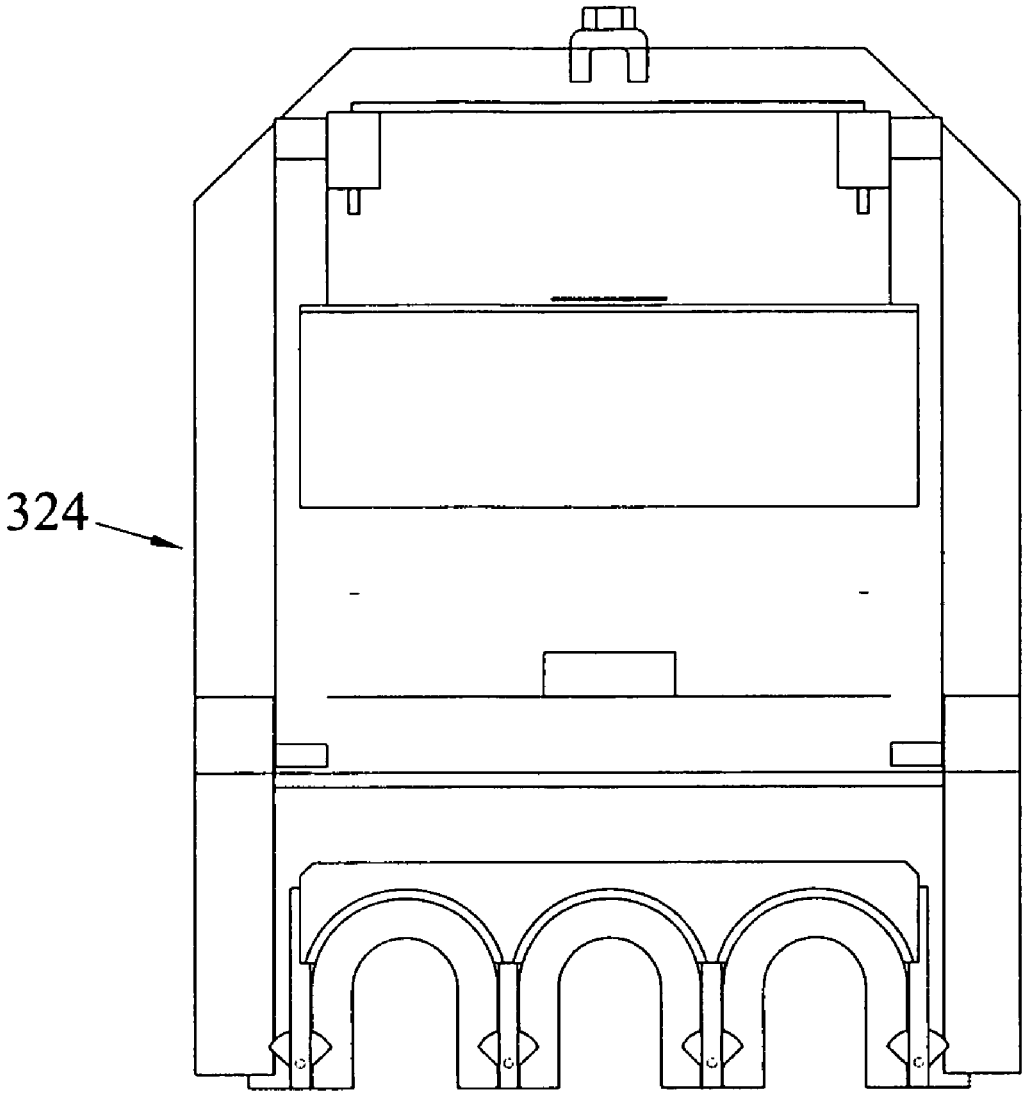
Figure 67:
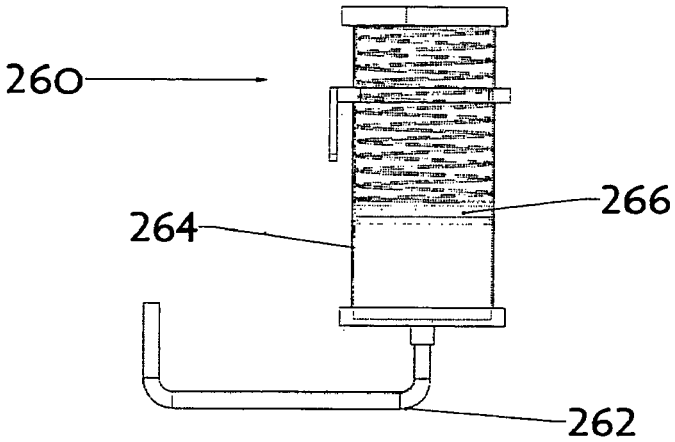
FIG. 67 is a picture view of a suitable pressure compensating system shown in FIG. 65.

FIG. 67 illustrates the pressure compensating device 230 shown as a piston 244 which moves within a cylindrical bore 236 provided in the shaft 224. The piston thus has one face exposed to lubricant pressure in the fluid passageways 226, while the opposed side of the piston is exposed to the subsea environment. A seal 245 preferably seals between the piston and the shaft. FIG. 67 also illustrates a biasing member, such as coiled spring 246, which may operate to provide a selected bias on the differential between pressure in the lubricant passageways and the subsea environment. In an alternate embodiment, as shown in FIG. 48, a diaphragm 248 is provided in the cylindrical bore 236, with one side of the diaphragm assembly exposed to the lubricant and the other side exposed to the subsea environment. A selected bias, such as spring 246, may be provided in the diaphragm assembly.

Since the bearings are sealed either directly or indirectly to the shaft, the differential pressure on the lubricant in the interior of the seal may be controlled to be higher than, equal to, or lower than the pressure of the sea water the exterior of the seal.

Figure 44:
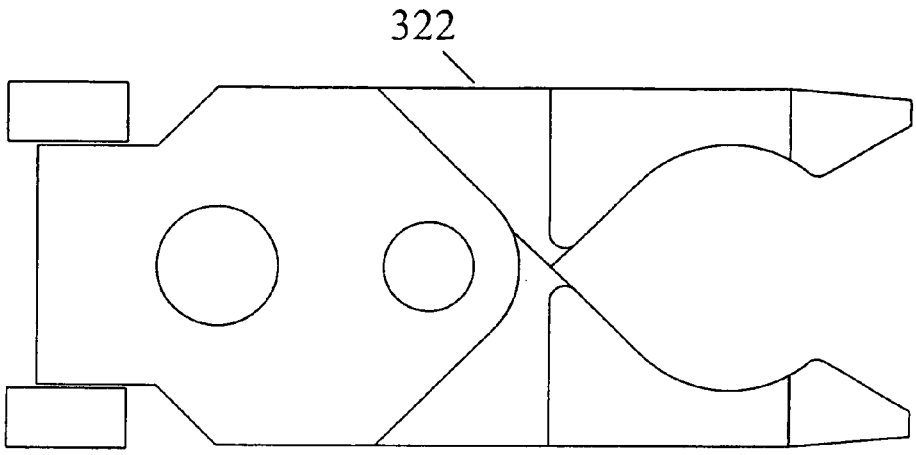
Figure 45:
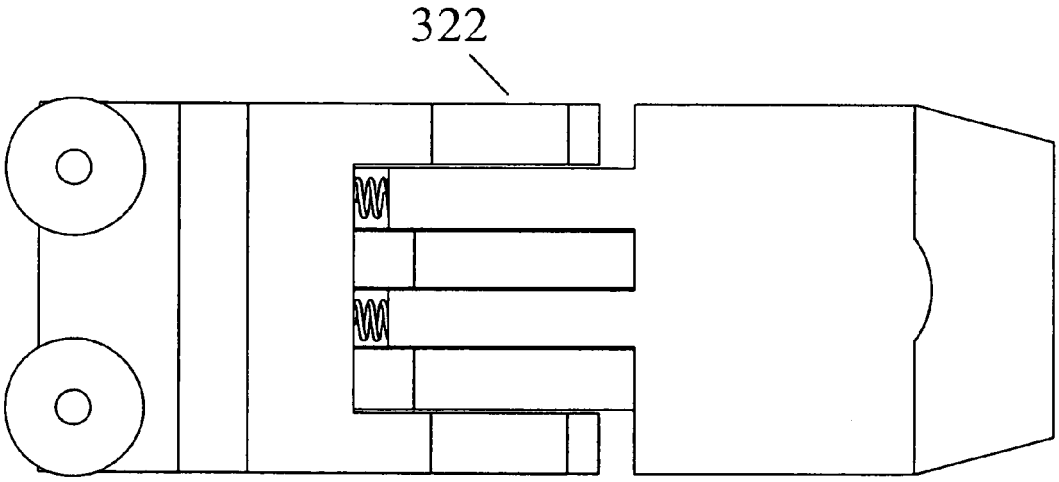
Figure 65:
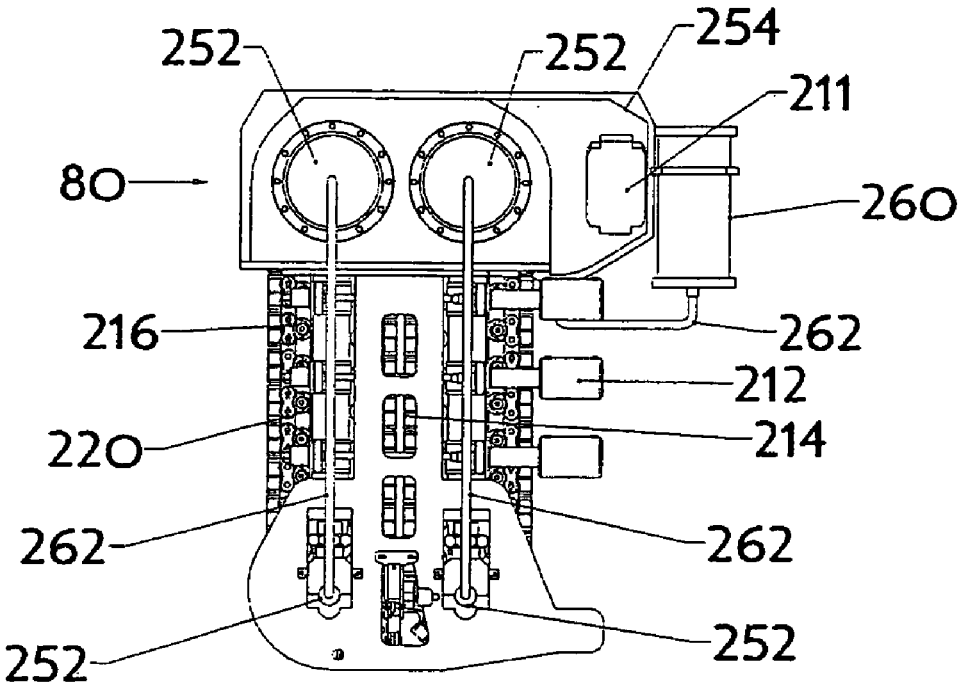
FIG. 65 is a front view of a coiled tubing injector according to the present invention with opposing chains.

For a coiled tubing injector with cam roller bearings mounted on support bars behind the traction chain, as shown in FIG. 65, the pressure compensating device may be configured to cooperate with the roller shaft of the bearing, as discussed above. A significant advantage of the coiled tubing injector according to the present invention is that pressure compensation to each bearing may be easily provided with a pressure compensation device in the shaft of the bearing. Alternatively, a remotely positioned subsea pressure compensation device 231, as shown in dashed lines in FIG. 44, may be connected to each roller bearing shaft by a tubing or hose 232 to accomplish pressure balancing.

A coiled tubing injector 80 is thus for functioning in a subsea environment. An exemplary injector 80 according to the invention utilizes a traction assembly 212, as shown in FIG. 65, to engage the coiled tubing and thereby drive the coiled tubing into or out of the well. A typical traction device comprises opposing grippers 214 that move laterally with respect to the tubular, thereby pressing the chain link members 216 moving in an endless loop into gripping engagement with the tubing. Each chain link member 16 thus moves longitudinally with respect to the stationary grippers 214 to move the tubing with respect to the tubing injector.

The coiled tubing injector of this invention may also be used to perform pipeline maintenance operations. The pipeline version of the coiled tubing injector may be landed on the seabed and attached to an access valve in the pipeline using a lightweight connector. The pressure control system may consist of a gate valve, a shear ram, and a set of strippers. Tools and/or fluid may then be conveyed in and out of the pipeline using the coiled tubing. Because the coiled tubing may be used to pull the tools back from where they were launched, there is no need for a pigging loop. The use of coiled tubing also allows various fluids to be pumped into the pipeline, which would be especially beneficial for removing sand or paraffin.

Figure 68:
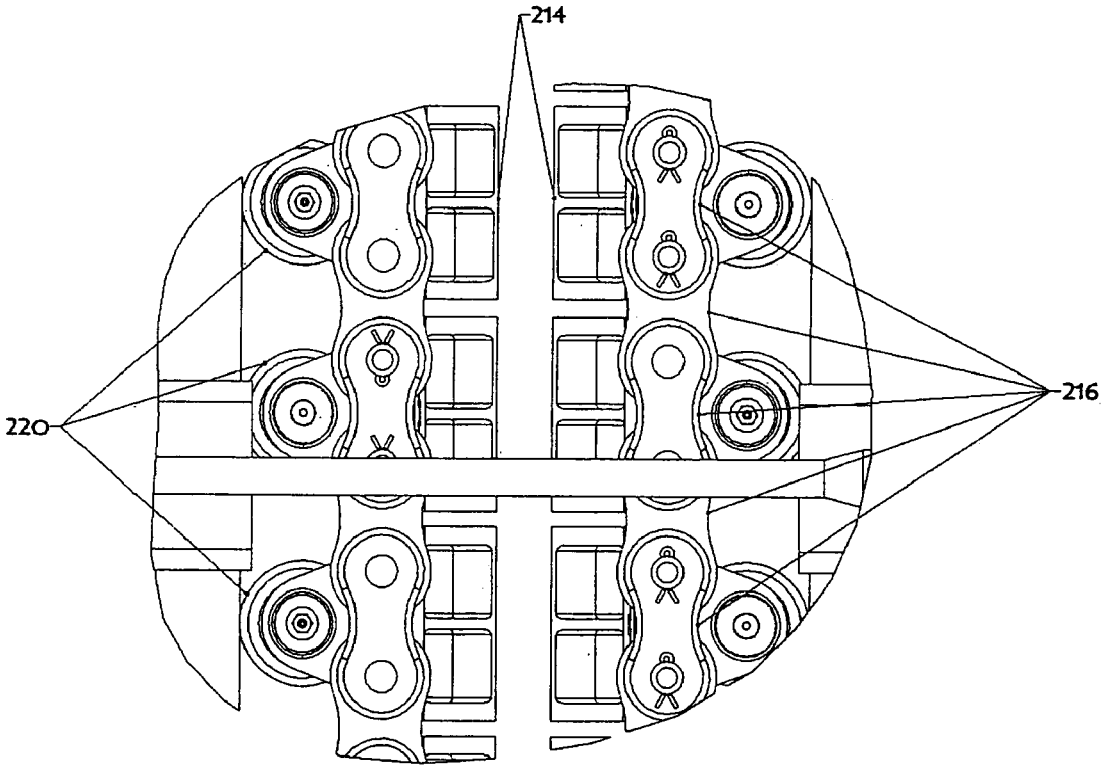
FIG. 68 is an enlarged view of the traction system of the injector shown in FIG. 65.
Figure 69:
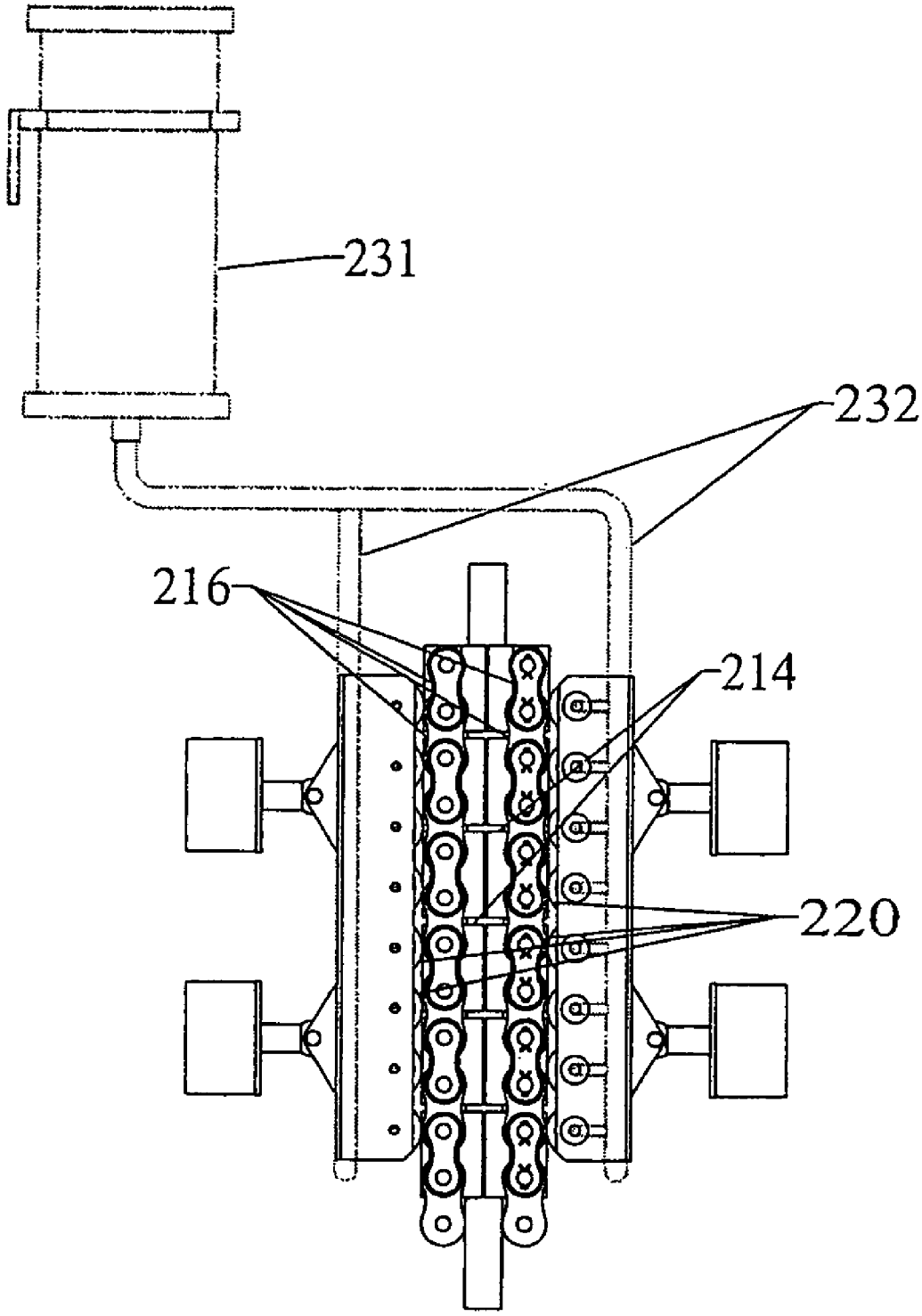
FIG. 69 illustrates rollers mounted on the carrier of opposing gripper blocks so that the chain link members move relative to the rollers.

Roller bearings 220, as shown in FIG. 68, are provided on the chain link members 216 allow for a large lateral load to be applied from the grippers to the longitudinally moving chain links, preferably without inducing a significant longitudinal drag load. For the embodiment, as shown in FIGS. 65 and 66, the rollers 220, as shown in FIG. 68, are attached to the chain link segments 16 and thus ride on the base or skate of the gripper 214. For an alternate design, the rollers 220 may be located in a carrier supported the gripper blocks, so that the chain link members 16 move relative to the rollers 220. The fluid powered or electrically powered drive motor 211 rotates the links of each endless loop chain.

Bearing assemblies 252, as shown in FIG. 65, and the injector gear case 254 preferably are both sealed to prevent sea water intrusion. The outboard bearing assemblies 252 guide the endless loop chain with respect to the body 258 of the injector. The gear case 254 transmits energy from the drive motor 211 to the endless loop chain using a plurality of gears housed within the gear box.

A pressure compensating device 260, as shown in FIG. 67, is provided for compensating pressure within each outboard bearing assembly and within the injector gear case, and preferably to all components of the injector which are sensitive to pressure differentials. Conventional tubing or other conduit 262 may be used to interconnect the pressure compensating device 260 with the bearing assemblies 252, with the gear case 254, and with other pressure compensated components. The compensating device 260 may include a compensator housing 264 attachable to the injector housing, and a piston or a diagram within the housing 264 for separating the lubricant from substantially subsea fluid pressure. Air space in the gear case 254 of the drive unit and in the outboard bearing assemblies 252 may be evacuated with fluid lubricant prior to deployment.

The pressure compensator 260 is designed to balance the internal pressure of fluid in the gear case 254, the bearing assemblies 252, and other components which are plumbed back to the compensator 260. The compensator 220 thus allows for these components to experience only a selected pressure differential that may be slightly above, equal to, or slightly below the pressure of the sea water surrounding the injector.

An alternative design may provide a pressure compensation device, such as a piston or a diaphragm, in a bore in the shaft of each outboard bearing assembly 252. A seal on the piston may isolate the lubricant from subsea conditions. One face of the piston is exposed to lubricant and an opposing face to subsea conditions. A spring may exert a selected bias on the piston. For compensation within the gear case, it is a particular benefit that the compensator device to be structurally separate from the gear case housing, then plumbed to the interior of the gear case.

Strippers

Figure 23:
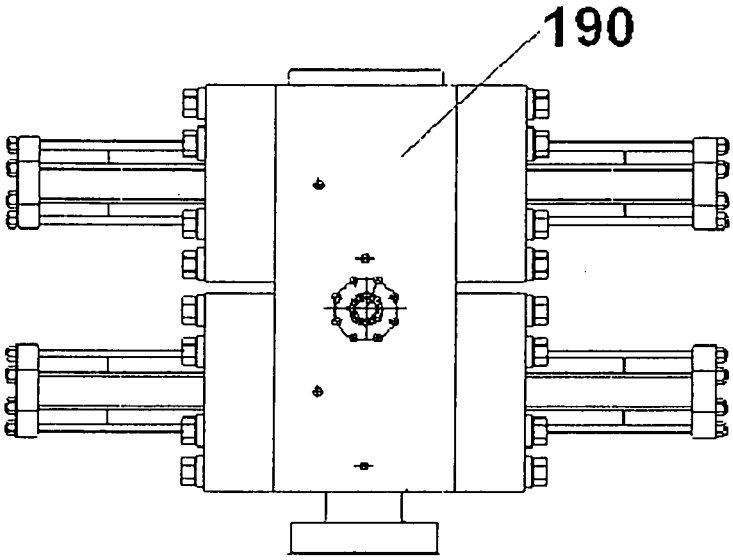
FIG. 23 illustrates a suitable ram-type stripper.

Two stripper designs are discussed each having distinct benefits. The first design includes a Sidewinder Stripper Packer. This tool 190 is designed to minimize the height by activating the packer around the coiled tubing with a BOP ram type of actuator. The design is shown in FIG. 23. Unique features of this tool allow the operator to fully retract the packer and bushings, providing a full through bore to run tools through during service and maintenance procedures. Some redesign work will likely be necessary to retract subsea. The Sidewinder has a 5.12-inch bore capable of sealing on the coiled tubing while it is stripped in and out of the well at full working pressure. The unit has hydraulic ram change features that speed up the process of changing out the packer elements and bushings, which decreases the maintenance time required after each job.

Figure 24:
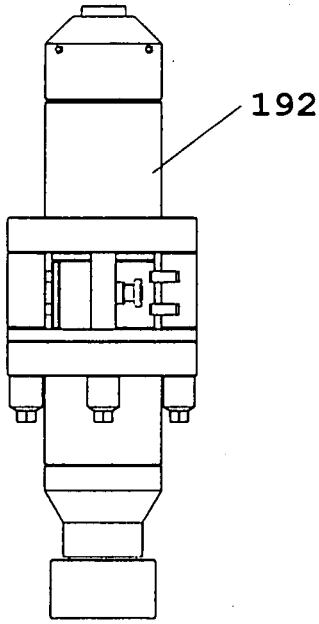
FIG. 24 illustrates a suitable over/under tool.

The second design is a combination of the Sidewinder discussed above and the Texas Oil Tool's Over/Under. The Over/Under tool 192 is a side-door type stripper with two packers. Both of these packers are relatively easy to change. The top packer is slightly more difficult because there is no packer element access window. The packers may be changed even with coiled tubing through the tools, as shown in FIG. 24.

The SIM preferably has two packer elements. During typical operations, both packers will be closed. Seawater will be pumped in between the packers at a pressure slightly greater than the wellbore pressure. This will cause a very small amount of seawater to seep into the well, but will prevent wellbore fluids from leaking into the sea.

Comparisons of weight, height, operation, and ease of use can be made between the designs. The weight of a single Sidewinder is 4,000 lbs and the weight of the Over/Under is 1375 lbs. The Over/Under has a height savings of 15-inches. Also, the upper section of the stripper packer may be mounted as close to the chains as possible. The Sidewinder would have to have a bushing extension built to extend the support to below the chains. When in use, the two stripper packers are comparable. The Over/Under type has been used for a longer period of time. When the unit is pulled back to surface, the packers and bushings have to be changed. To do this on the Over/Under, the door is open with pump up through the window. For the upper packer in the Over/Under, the split cap is removed and the piston pumped to expose the packer. To change the packers on the Sidewinder, bonnet bolts on each actuator are removed then hydraulic pressure applied to retract the packers and bushings.

The method of running the coiled tubing and the drop in drum with the coiled tubing connector made up and tested on the reel would enhance the use of the Sidewinder features. To pull the end of the coiled tubing with the connector on it through the Sidewinder stripper, the actuator is simply opened by applying hydraulic pressure. The Sidedoor stripper requires all of the packers and bushings to be removed manually. The Sidewinder strippers will be used because they offer the most flexible and robust design.

Reel Assembly

A typical coiled tubing system incorporates a reel, a gooseneck and an injector, but the typical layout is not preferable for a subsea coiled tubing unit. Placing the reel at the base of the CT module allows substantially standard equipment to be used.

As coiled tubing is paid out or reeled in, the reel translates back and forth on a skid frame 194. A double helix lead screw 195, similar to a typical level wind, may synchronize the translation motion with the rotation of the reel. Four load cells 196, located above the injector, may sense the behavior of the coiled tubing coming off or going onto the reel and provide feedback to help control the reel. Using a feed back loop, the reel 82 may make automatic adjustments, or be manually adjusted by the operator. A simple guide mechanism may guide the coiled tubing into the injector. A suitable feed-back and control system should be developed.

Using the on-top design with HydraRigs drop in drum design allows the reels to be changed out quickly and easily in between workovers. If reels are made up with wireline inside and the BHA connected a reel change out should only take a few hours.

Some components in a conventional reel system are not well suited for the subsea environment. In some instances, only a material change may be necessary. In other cases, the components may need design modifications. Conventional bearings are not suitable to work in saltwater conditions. Bearings may be sealed and pressure balanced or replaced with a sleeve.

Circulating System

The SIM was originally planned to have the end of the coil tubing capped. Since there was no flow, a bank of accumulators provided a volume of fluid to the coil at a regulated pressure. If the input pressure to the injector is 5,000 psi, the accumulators could be charged with the same hydraulic fluid and pump. A collector ring, mounted on the other end of the coil, allowed logging signals to be passed through the reel. Leaks in the tubing could be detected by monitoring the pressure in the tubing.

There are two very important reasons to circulate with the SIM. First the BOP stack should be flushed before each tool change out to minimize the amount of hydrocarbons released into the ocean. Secondly, most of the commercially available coiled tubing tools are flow activated. To minimize environmental damage and eliminate the need to redesign the downhole tools, the preferred version of the SIM should provide some ability to circulate seawater.

Most flow-activated tools operate with a flow rate of less than 0.6 bbls/minute. Before the circulating pump can be properly sized, the maximum anticipated shut-in pressure (MASP) must be determined. At this time, the recommended power to be supplied to the circulating system is about 125 hp. This should allow the SIM to pump down a well with pump pressure of 5,000 psi and a flow rate of about 0.8 bbl/min. Unfortunately, a commercially available pump for performing this task could not be located. There is, however, precedence in the ROV industry of using pressure intensifiers to pump seawater at high pressures. A major service company has developed high pressure and high flow intensifiers used in fracturing operations. It is reasonable to assume that the two technologies may be combined to provide the flow and pressure that the SIM would require. The fluid circulation system within the SIM of the present invention may circulate seawater through the coiled tubing to the selected downhole tool to operate the tool, and also preferably may flush the tool in its position while substantially in its running position substantially aligned with the borehole, including immediately subsequent to running the tool out of the well. In a preferred embodiment, the circulation system allows for flushing the well tubing string and/or the tool with seawater. A surface controlled power control unit (PCU) may be used to control operations of the subsea pumps which provide fluid to the circulation system. In other embodiments, a selected inert or "active" fluid, such as nitrogen or a chemically active injector fluid, may be transmitted by a flow line from the surface to operate and/or flush the tool.

The alternative solution to the circulation problem is to provide a separate hydraulic line, such as coiled tubing. A manifold with coflex tubing may be attached to the end of the coil. The weight of the manifold helps control the line as it is lowered into the sea. An ROV then attaches coflex line to a manifold on the SIM. This would not only allow the operator to pump fluids other than seawater, it would also reduce the subsea power requirements to about 150 hp. The biggest drawback to this solution is the increased chance of tangling the hydraulic line with the PCU of ROV umbilical lines.

Power System/Umbilical

The power distribution system of the SIM may be evaluated as a surface system, a transmission system, and a subsea system.

The surface system may use a 440 volt 3 phase alternator and a transformer to step the power up to 4160 V 3-phase. The alternator may be capable of producing in excess of 300 Hp. The sizing of the power generation equipment was based on the power requirements of the subsea equipment with the addition of a 20% reserve capacity. In addition to the alternator, two reels may be required. The first reel would spool the hoist cable, which would raise and lower the SIM to a total depth of 8000 feet. The second reel may spool the power cable. This reel would be equipped with a four-conductor collector ring for the power cable and a swivel for the fiber optic cable, which would be the main control link to the SIM. The fiber optic cable would consist of a bundle of fiber optic strands, which would transmit data and video from the control pods on the SIM to the surface. At the power reel, the fiber optic cable would be separated from the power cable and fed to the control room on the boat.

The transmission cable may be a series of cables. The innermost cable may be the fiber optic system described previously. Around the fiber optic bundle, a four conductor copper cable may transmit the electric power to the SIM. The power requirements of the subsea system and the 8000-foot deployment depth would require a 1/0 cable. This conductor wire system would be surrounded by an armor system, which would protect the conductor. The armor cable also would support the weight of the cable since copper has a low tensile strength. The whole system would be encased in a tough flexible plastic case for additional abrasion and gouge protection. A transmission cable will likely be custom made for this application.

The subsea system may consist of electric motors, motor control pods, control pods, and lights. Six electric motors were specified to run various components of the SIM. The motors selected for this application were developed for subsea use in ROV applications. Since the motors may be wired for 4160 volt, a large subsea transformer would not he required for the motors. Two motors were chosen for each system application to provide a redundancy for the system, which would enable at least a reduced performance mode if one motor of each system failed. In addition, the start-up power surge could be minimized if the motors were staged. This would reduce the size of the power cable required to start and run the motors, as well as, improve the lire of the motors and other power distribution equipment. The motor power rating and system applications are listed below.

- 2.75 Hp submersible motors for injector and coiled tubing reel pumps
- 2.15 Hp submersible motors for BOP control system pump
- 2.75 Hp submersible motors for circulation pumps Two motor control pods may be used to enclose motor starters, ground fault breakers, and thermal overloads for each motor. The pods may be sealed to prevent moisture from contaminating the electric circuits and designed to withstand pressure at depth. The transmission cable may terminate at a bus in the motor control pods. From the bus, the power may be distributed to each of the motor starters. Two pods were specified to provide redundancy in the event of a fire or high voltage arcing event in one pod. Each pod may control one motor from each power system application.

The motor starters for the individual motors may receive 24-volt control signals from the main control pods. Control of the operation of the various motors on the SIM may be one of several functions of the control pods. PLC's in the control pods are the termination points of the fiber optic system in the transmission cable. Two control pods would provide redundancy to the overall system. The last major draw on the power system at the SIM would be the lights used for twelve cameras. The power draw for each light would be 500 watts. The total power draw would be 8 Hp.

Ideally, most of the control and power system to operate the SIM will be located on the Power Control Unit (PCU) 198. The electric motors and hydraulic pumps are located on the PCU. With this configuration, only a low power line need be run between the PCU and the SIM.

With some combination of material substitution, redesign, and special lubricants, it is feasible to create a marinized injector. Even with these changes, the injector will require an intensive maintenance program to maintain an acceptable level of system reliability.

The power control system may be comprised of both a surface unit and a power control unit (PCU) 198. The surface unit may consist of a standard 3-Phase 480V generator and a transformer that steps the voltage up to 4160V. An umbilical consisting of conductor lines and fiber optic lines transmit power and control signals from the ship to the PCU. Jumper lines run from the PCU and provide the SIM with electrical and hydraulic power. Most of the power/control system has either been developed for current drilling MUX systems or ROV applications.

Based upon the engineering calculations and finite element analysis performed, a bending moment of 2.5-million lbf ft may be accommodated by the SIM using a simple frame structure. While it may be possible to design a system to handle higher moments, the weight will have to increase significantly. Since current BOP stacks do not transmit their load through the frame, the BOP stack/frame assembly will have to be tested to verity its correlation to finite element models.

The initial engineering work and scale model testing indicates that the SIM may be deployed from a proposed Candies ship with a 11 m×11 m moonpool and a 300 tonnes Huisman type crane. Based upon the model testing, the ship should be capable of deploying the SIM in 98% of the sea states off Angola and Congo and 99% of the sea states off Nigeria and Equatorial Africa. The ship may be guided to and latched onto the subsea tree using two work-class ROV's docked with the SIM and a 3.25" hoist line. If the ocean currents near the wellhead are less than 2 knots, the SIM should not overload a horizontal tree connection.

About 78% of the subsea trees are vertical. Because the allowable loads are so low, the SIM would require major and expensive design changes to accommodate vertical trees.

Figure 25:
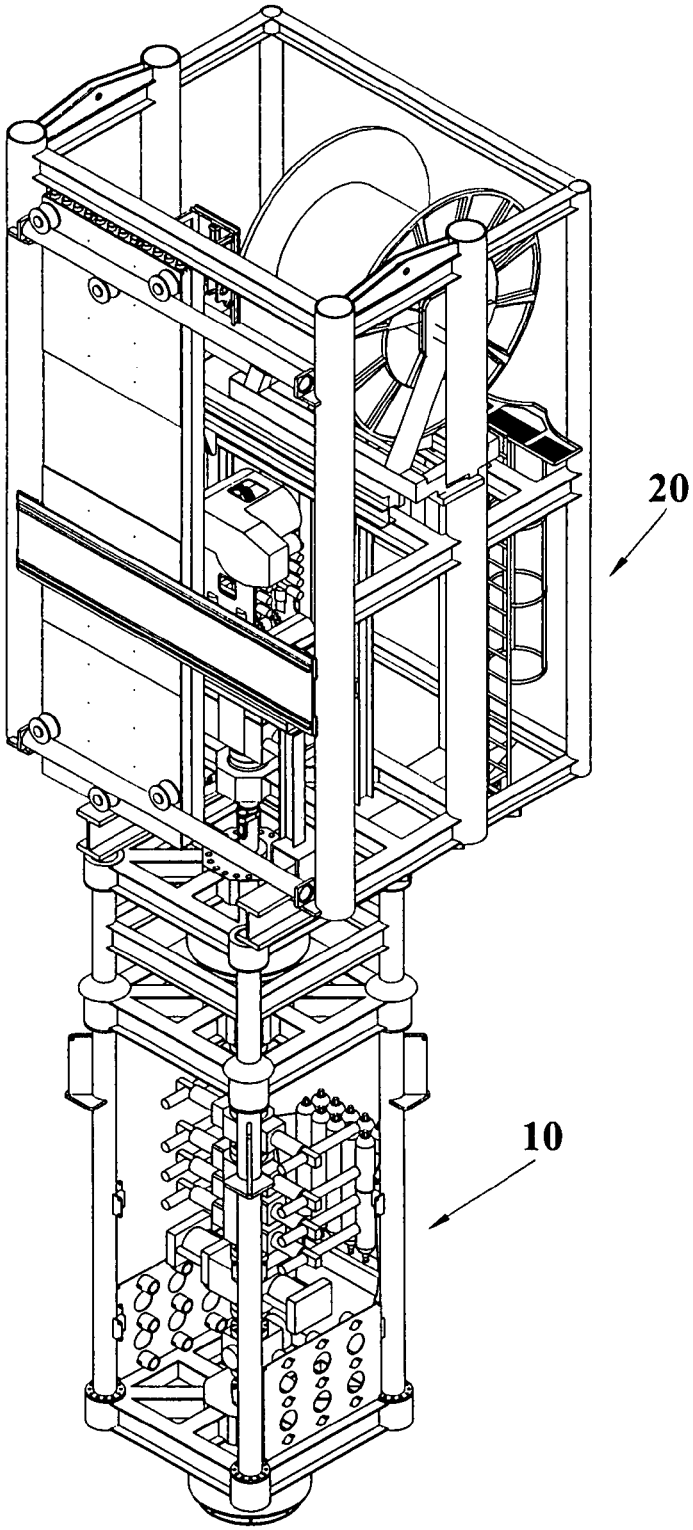
FIG. 25 shows one SIM according to this invention.

FIG. 25 shows one SIM design. This design produces a moment of about 1.3 million lbf ft each time the top module slides back to load a new tool. This, however, should not be critical because the stack frame and wellhead are designed to withstand a 2.5 million lbf ft moment. The moment can also be reduced to about 500,000 lbf ft by proper distribution of the mass of the top module and a simple redesign.

The following table list the typical missions for a SIM with various circulating capabilities. The goal in this phase of the project was to determine the feasibility of a SIM that could perform the tasks listed in the No-Circulation column. Based upon the work performed, a SIM that can perform the tasks in column 1 of the following table is feasible. The estimated cost to design and manufacture such a system is $20 million. Some critical components, e.g., marinized injector, coiled tubing connector, and BOP frame, may need further design and testing work.

| No Circulation | "Open" Circulation | "Closed" Circulation |
|---|---|---|
| Well Logging | Sand Removal (washing milling) | |
| Mechanical Plug-Back | Scale Removal (washing milling) | Cemented Plug-backs |
| Move Sliding Sleeves | | |
| Down-hole Choke Manipulation | | |
| Re-perforate | Perforation Wash | Acid Washing |
| Tubing/casing Patch | Hydrate Removal (chemical | |
| Dump Bailing | | Perforation Squeezing |
| Remedial Concentric Screen Installation | Expandable Screen Installation | |
| Insert Safety Valve Installation | | |

This invention system may be used for introduction, at a subsea location of various selected tools into a subsea well, or alternatively into a pipeline. A BOP/control module and the SIM module may be combined and the assembly lowered subsea for use on a conventional horizontal tree. Alternatively, the BOP/control module may first be lowered onto the horizontal tree, then the CT module lowered onto the BOP module. The system may use any selected number of tools, e.g., twelve different tools, which may each be selectively positioned over the centerline of the well for use. The assembly as shown in FIG. 25 desirably has a relative low height, since the tool magazine is positioned in parallel with the injector head and the stripper, and also preferably with the tubing reel. The tool magazine may be selectively translated right and left, and also aft, for positioning a selected tool over the well centerline, and for removing a previously used tool to the tool magazine for storage. Each tool may be raised and lowered with respect to the BOP by a powered threaded rod, which in an exemplary application has a twenty-nine foot stroke.

Figure 26:
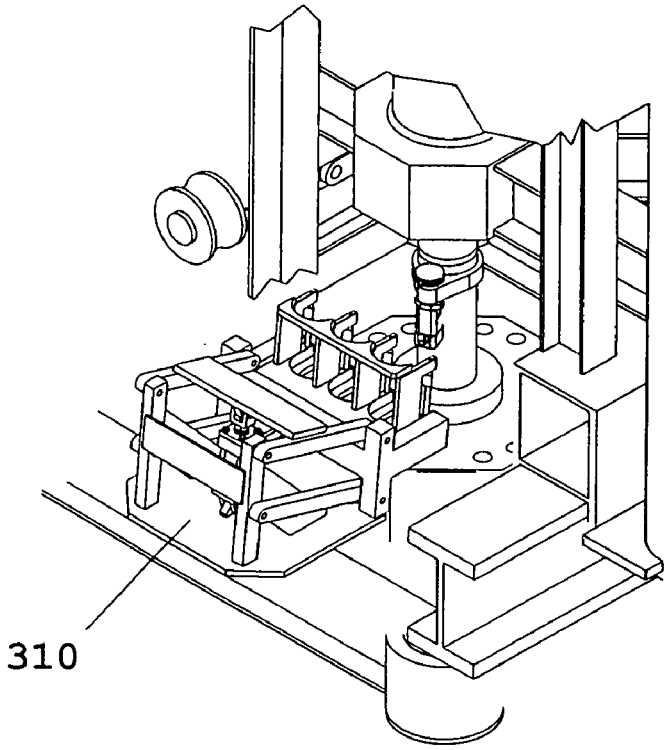
FIG. 26 depicts a suitable tool drive gear with tool changers.
Figure 27:
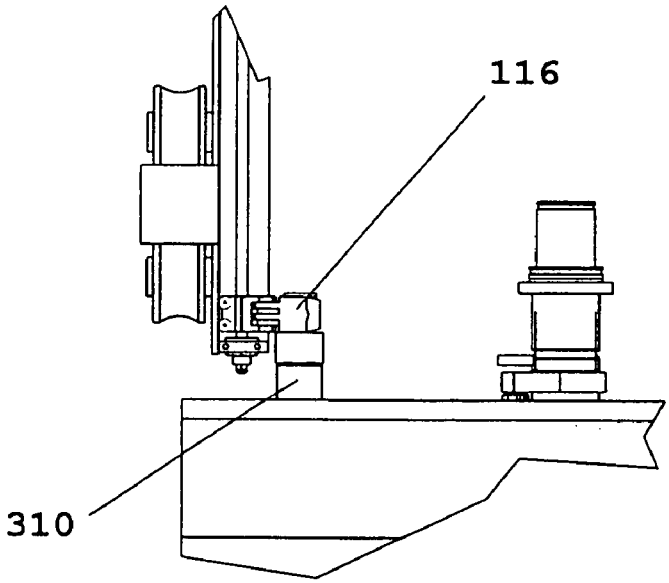
FIG. 27 is a side view of the assembly shown in FIG. 26.
Figure 28:
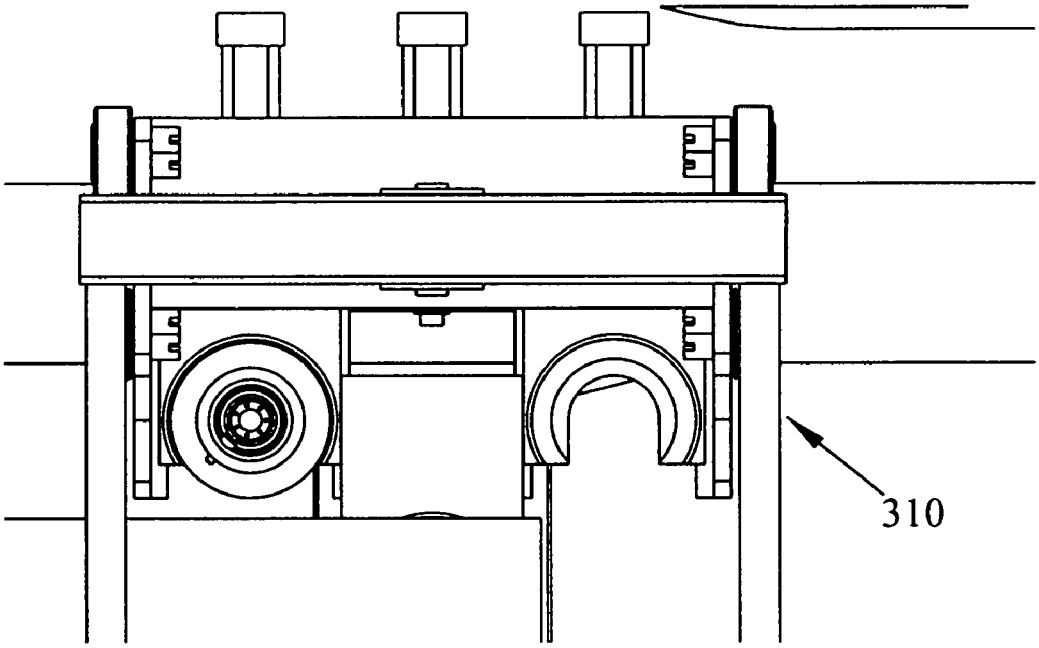
FIG. 28 is a top view of the assembly shown in FIG. 26.
Figure 29:
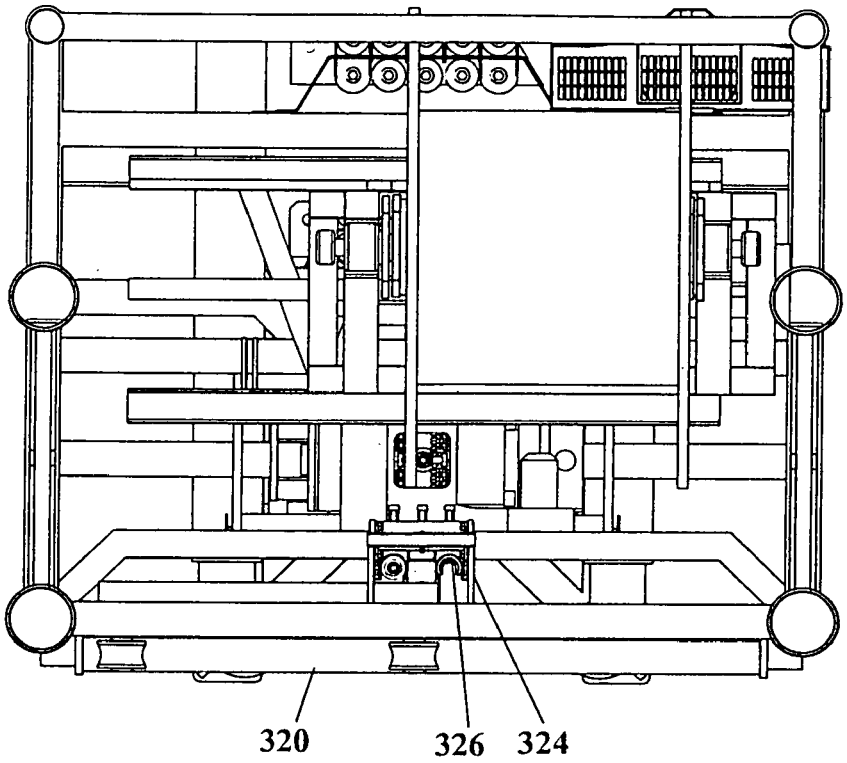
FIG. 29 is a top view of an alternate embodiment showing a tool changer, which is shown in further detail in FIG. 30.
Figure 31:
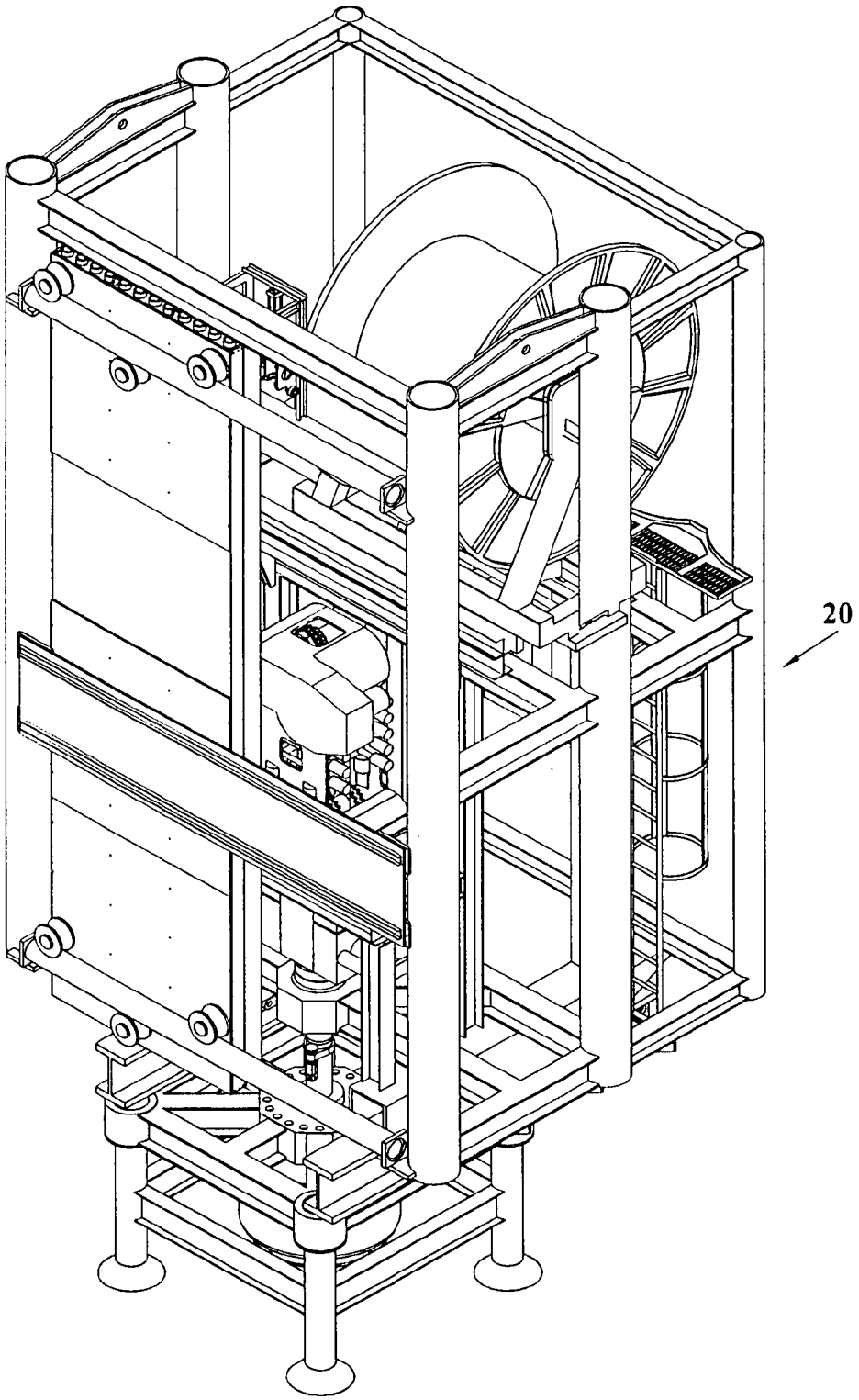
Figure 32:
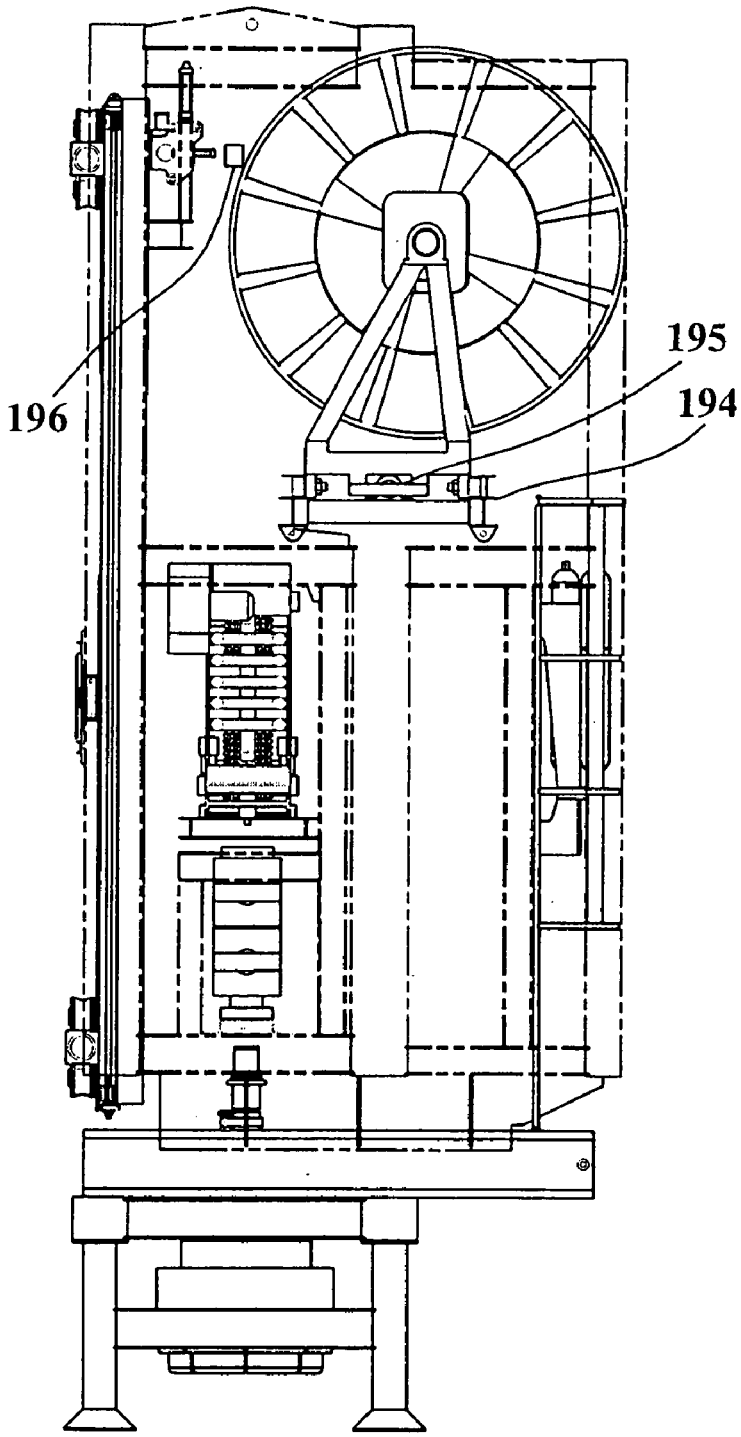
FIGS. 32 and 33 are side views and front views of the same module, respectively.
Figure 33:
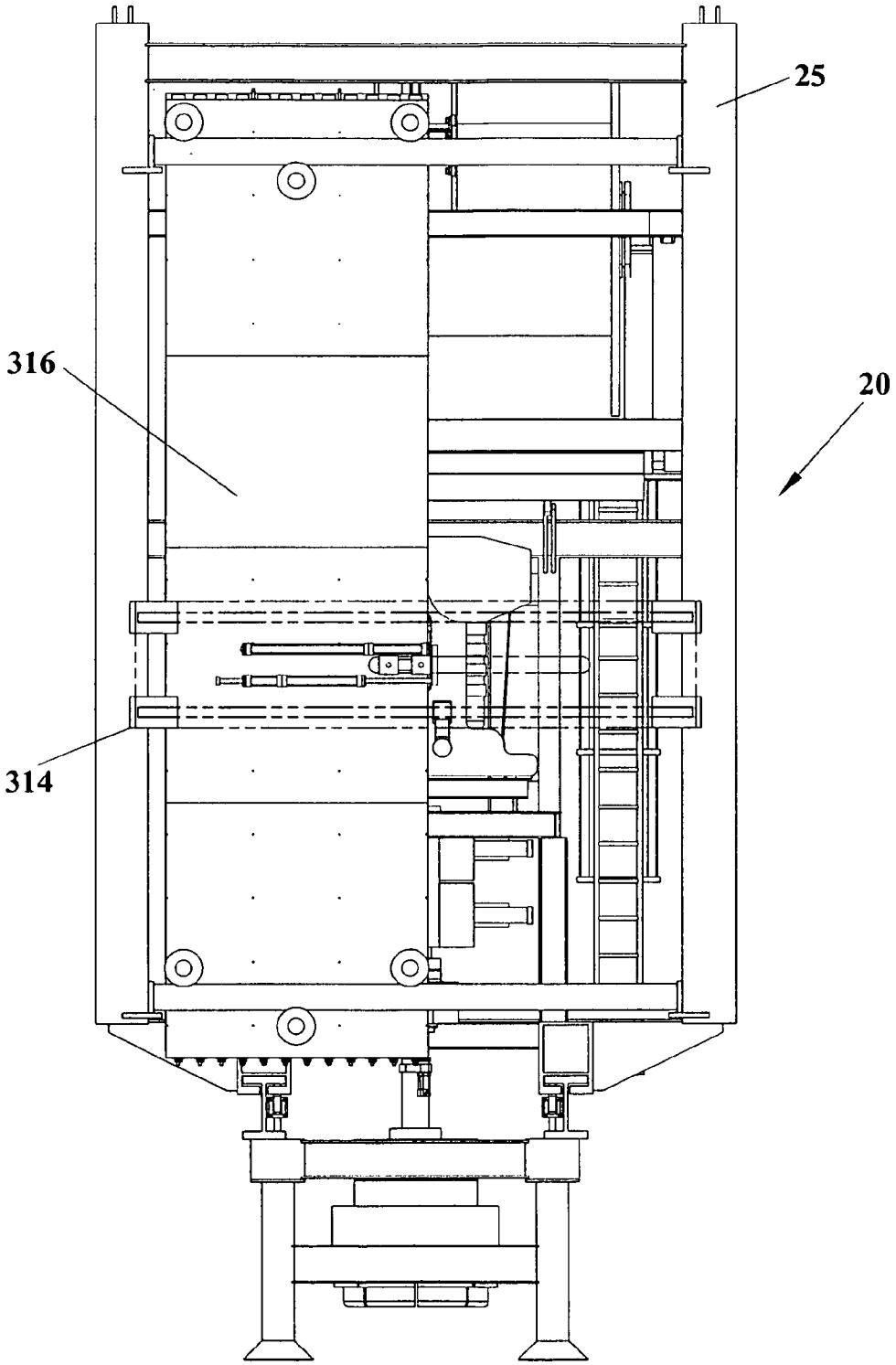

FIG. 26 depicts the tool drive gear and the fly down tool changer 310 generally shown in FIG. 25. FIG. 27 is a side view of the assembly shown in FIG. 26 and FIG. 28 is a top view. FIG. 29 a top view of an alternate embodiment showing the position of the tool changer 310, which is shown in further detail in FIG. 30. FIG. 31 is a pictorial view of the CT module 20, while FIG. 32 is a side view and FIG. 33 a front view of the same module.

Figure 34:
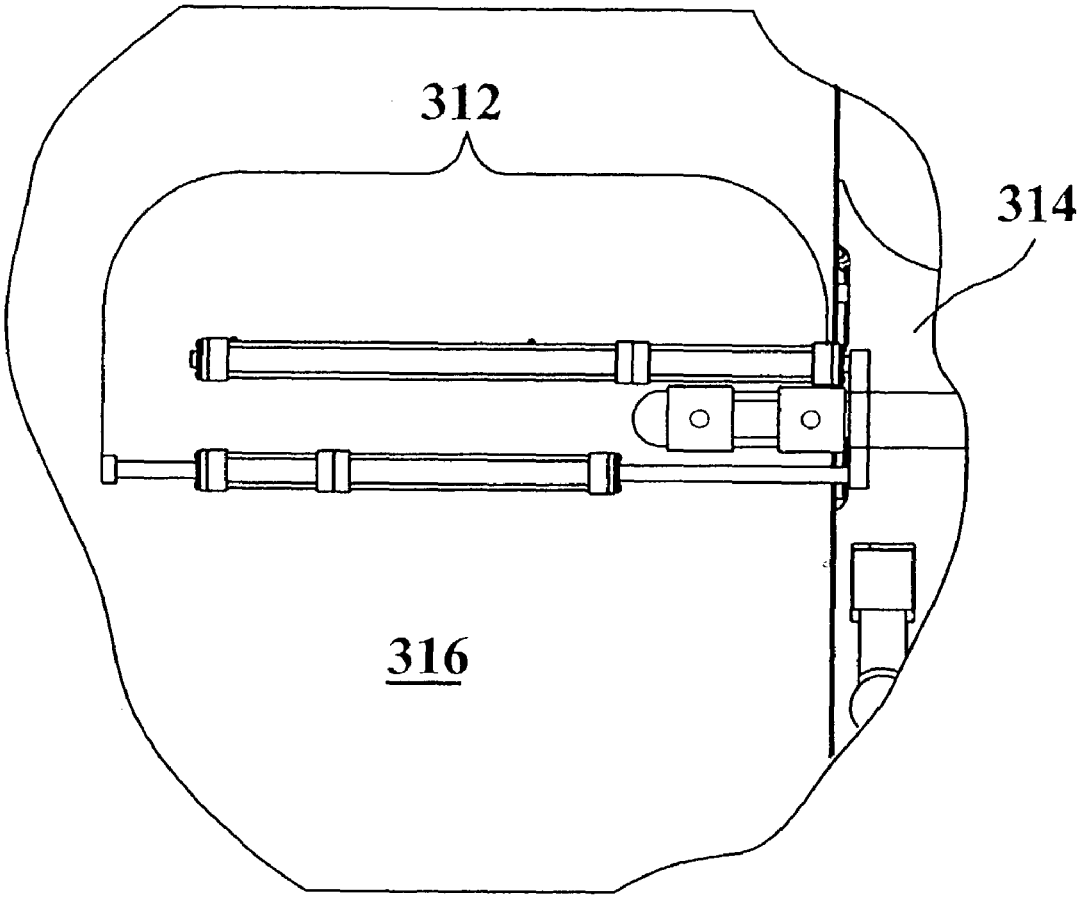
FIG. 34 depicts in side view a 4-cylinder assembly and the position above the tool holder magazine.
Figure 35:
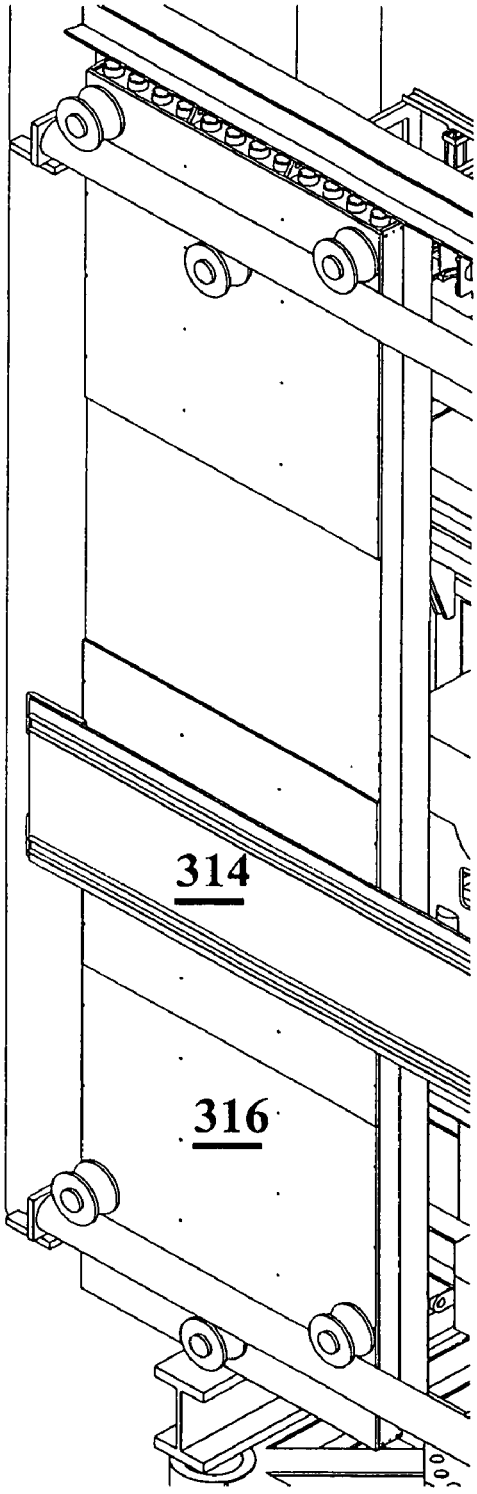

FIG. 34 depicts a four cylinder assembly 312, each with a different stroke length, with one end of the four cylinder assembly fixed to the guide 314 and the other end fixed to the magazine 316 to obtain the desired stroke length for positioning a tool over the well centerline. It should be apparent to those skilled in the art that selective activation of the plurality of cylinders or other actuators, each of which is activated a discreet linear distance, may result in multiple discreet positions for the position of the tool positioning system. High reliability is achieved since the system does not rely upon any of the actuators to occupy more than two axially spaced positions. FIG. 35 illustrates the magazine 316 and the guide 314.

Figure 36:
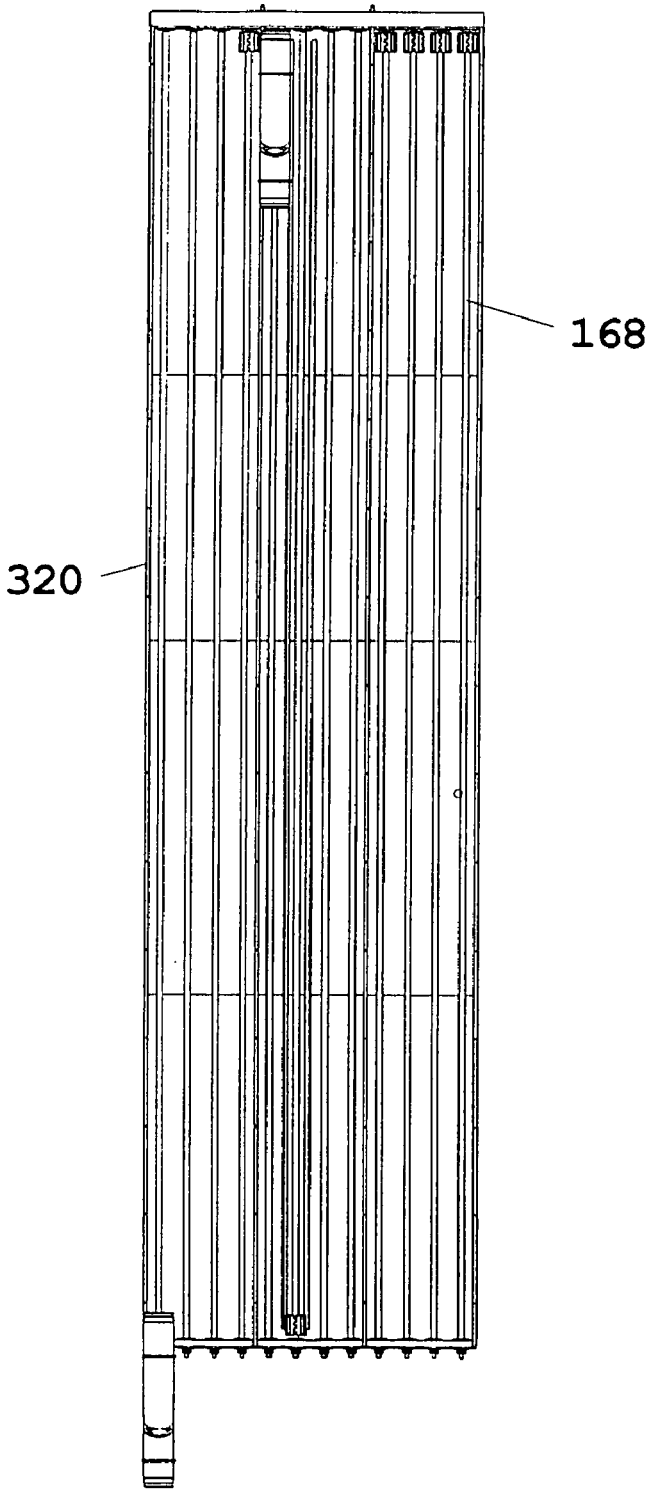
FIG. 36 is a side view of the tool magazine generally shown in FIGS. 35.
Figure 37:
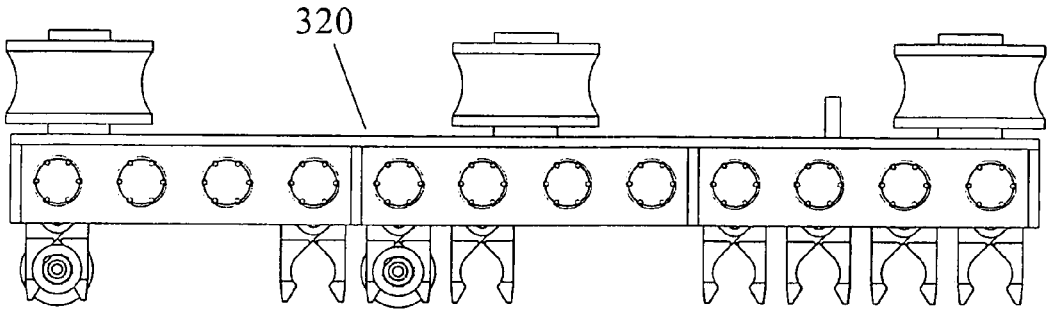
FIG. 37 is a top view of the tool magazine.
Figure 38:
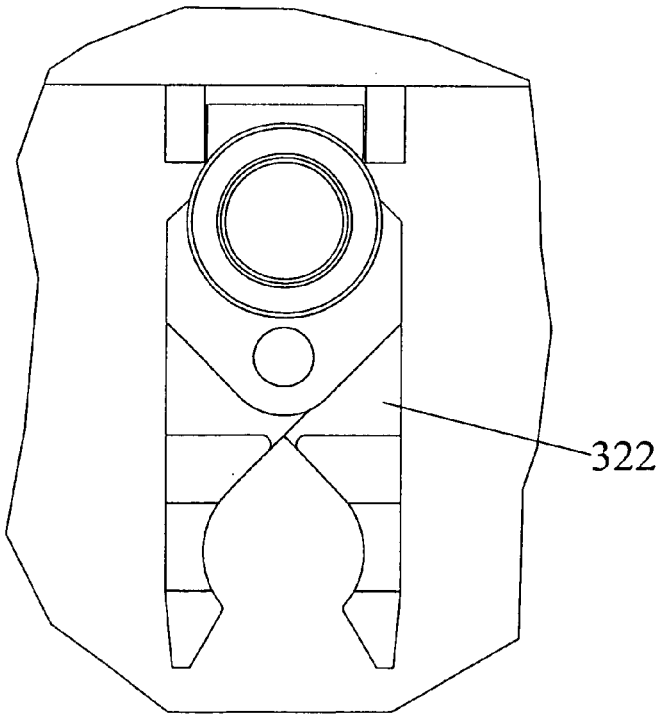
FIG. 38 is a top view of the draw assembly, which is also illustrated pictorially in FIG. 39.
Figure 39:
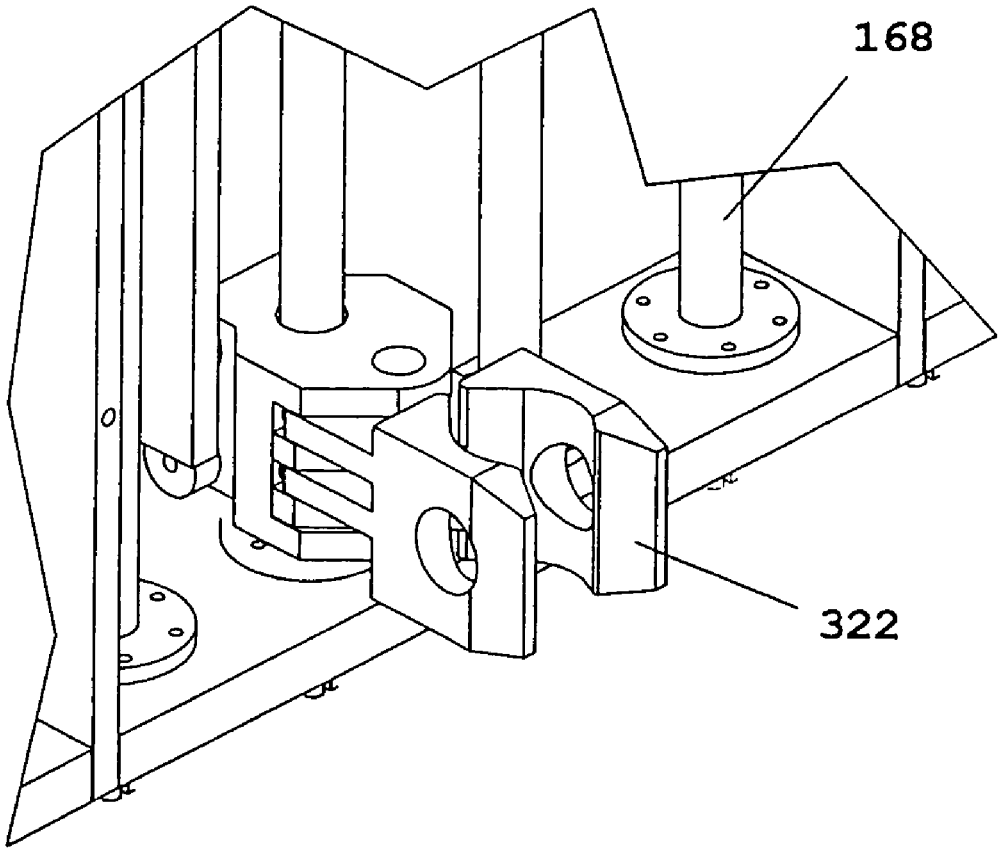
Figure 40:
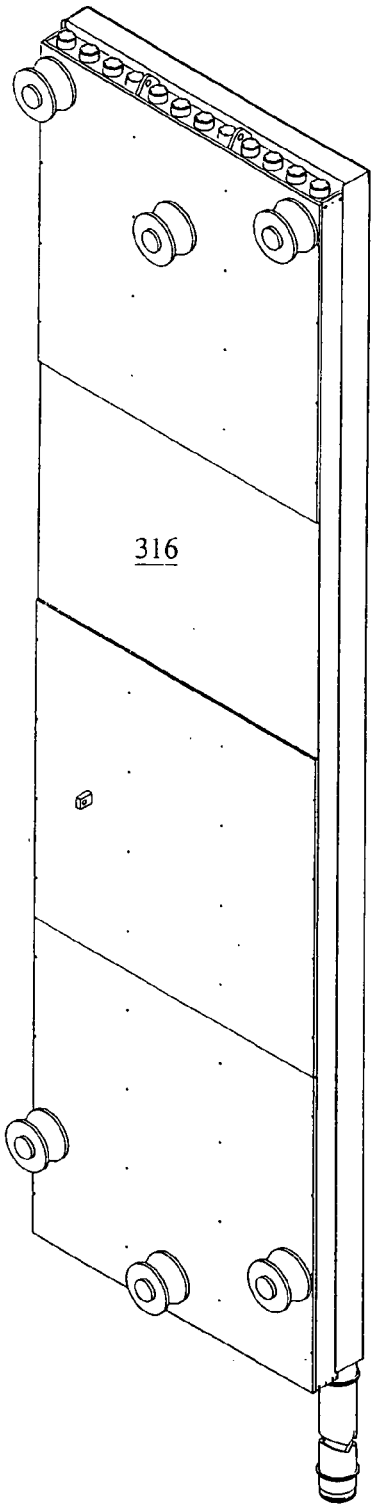
FIGS. 40 and 41 are pictorial views of a tool magazine, while FIGS. 42–45 better depict a tool grip jaw.
Figure 41:
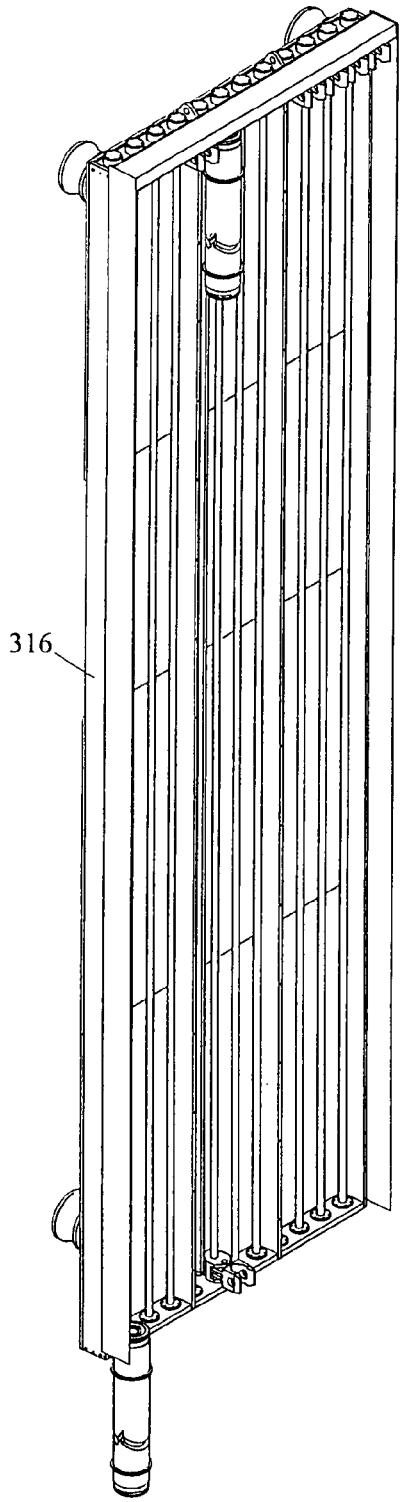
Figure 42:
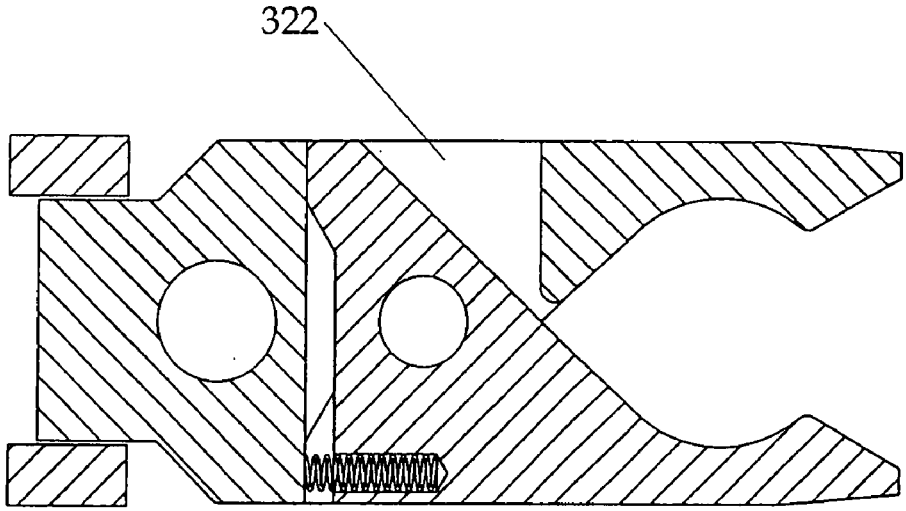
Figure 43:
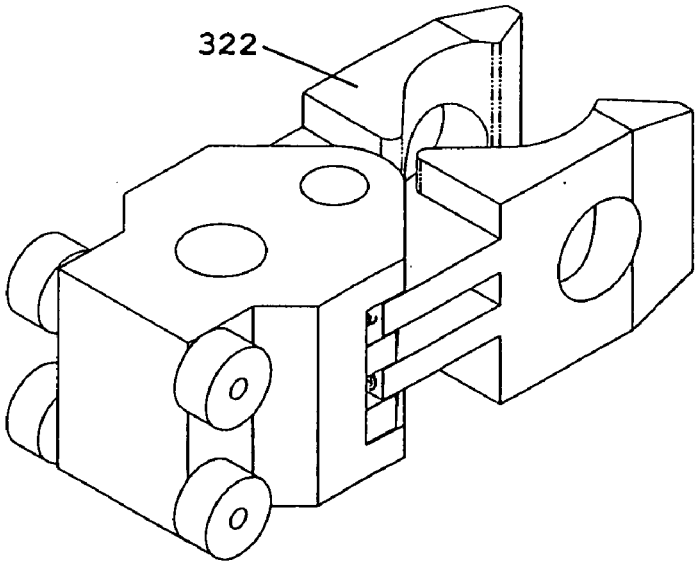

FIG. 36 is a side view of a tool magazine 320 generally shown in FIG. 25, and FIG. 37 is a top view of the tool magazine. FIG. 38 is a top view of the jaw assembly 322, which is pictorially illustrated in FIG. 39. FIGS. 40 and 41 are pictorial views of the tool magazine, while FIGS. 42–45 better depict the tool grip jaw assembly 322.

Figure 46:
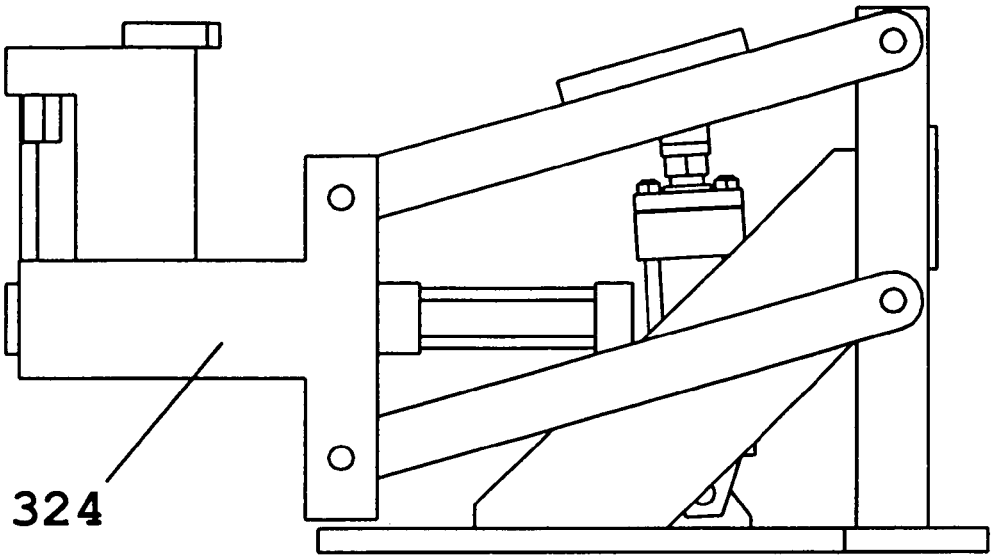
FIGS. 46 and 47 illustrate the tool changer, which is illustrated pictorially in FIGS. 46–50, and in a side view in FIG. 51.
Figure 47:
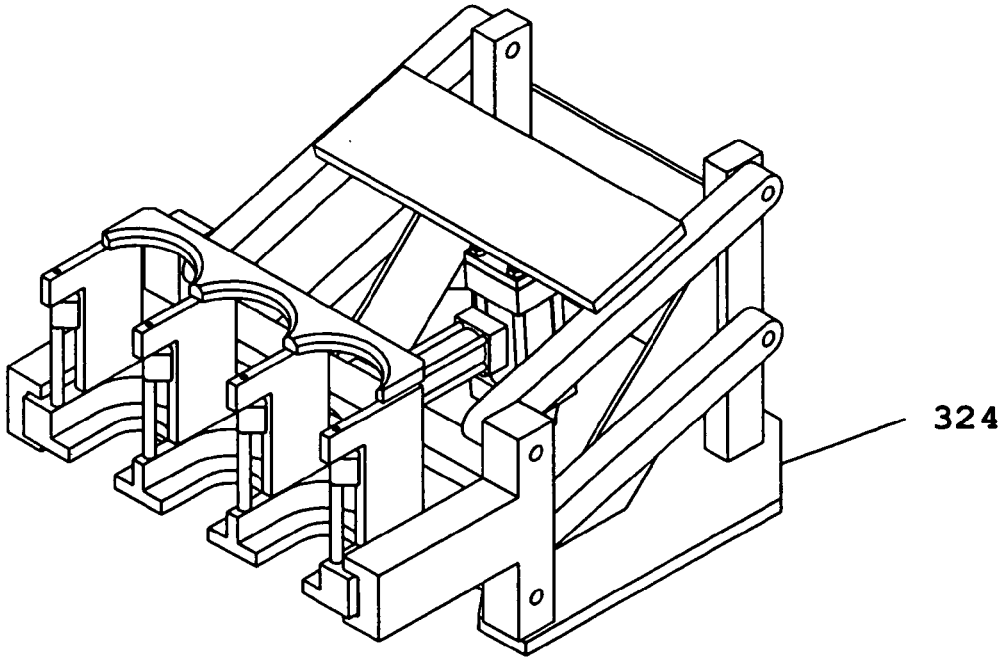
Figure 49:
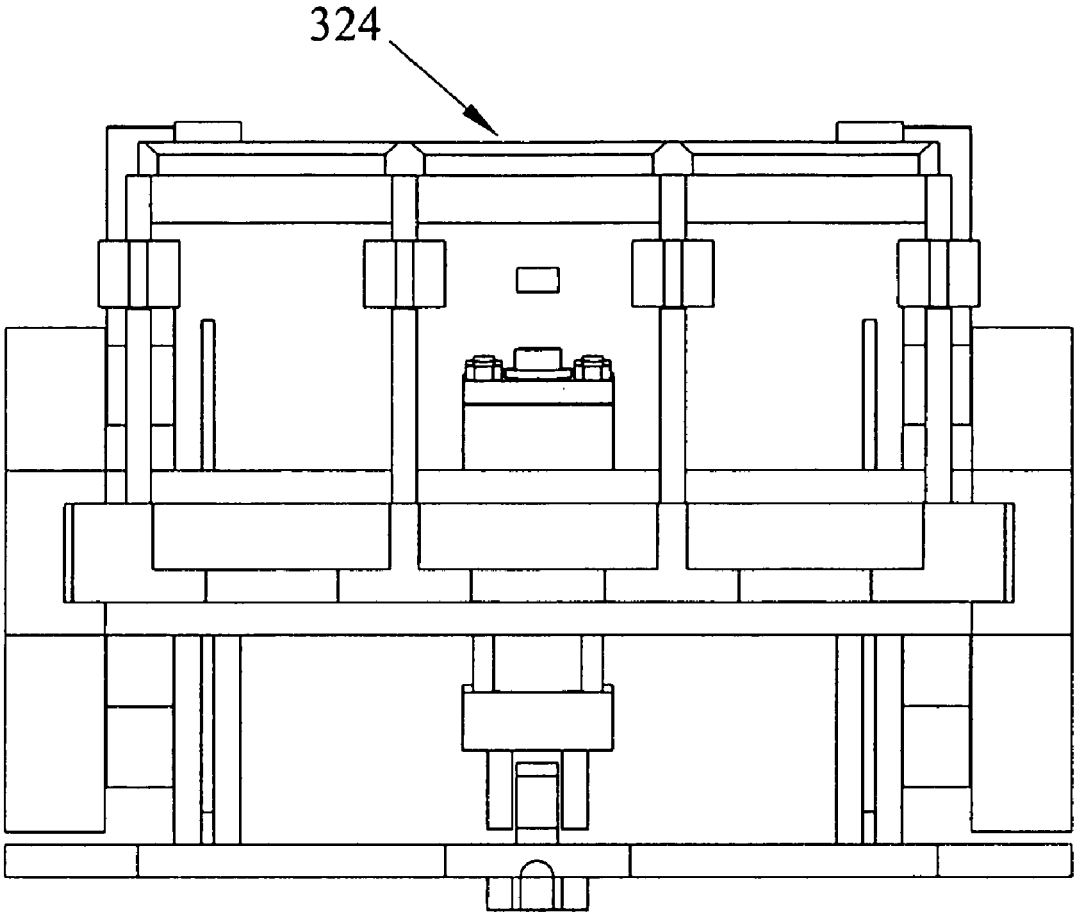
Figure 50:
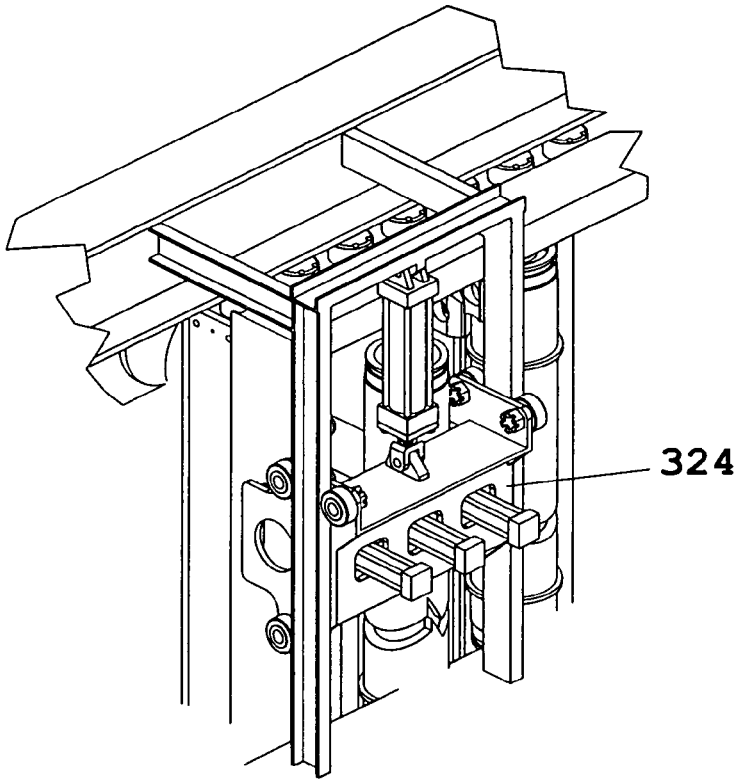
Figure 51:
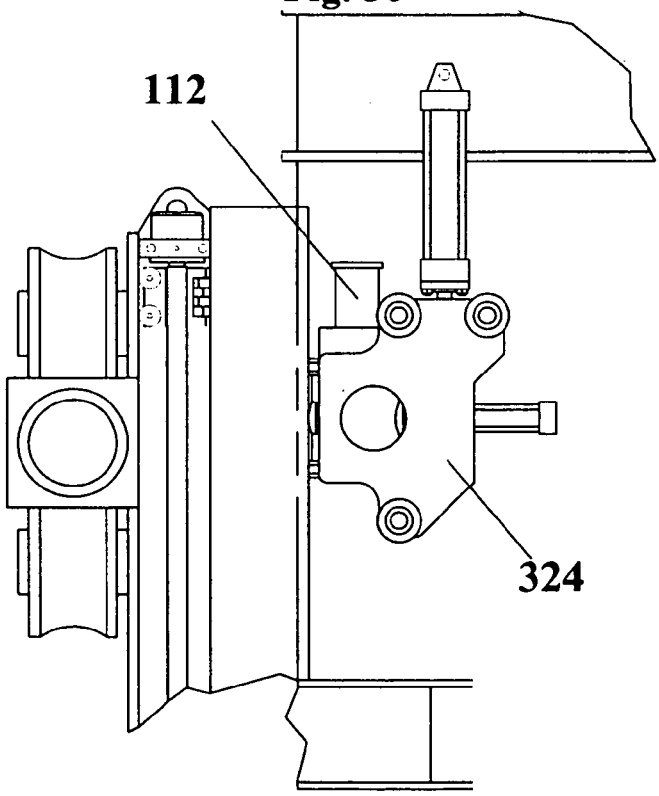

FIGS. 46 and 47 illustrate a tool changer assembly 324 which may be used for replacing one or more of the downhole tools after the assembly shown in FIG. 1 has been positioned over the tree. A top view and a front view of the tool changer assembly are shown in FIGS. 48 and 49, respectively. The tool changer assembly 324 is pictorially shown in FIGS. 46–50 and in a side view in FIG. 51.

The process for changing out tools after the system has been positioned subsea is briefly set forth below.

Changing Tools

Tool magazine shuttles empty grip jaw in-line with well centerline.

Injector, coil tubing and magazine module skid back 39½" to engage gear and connect grip jaw onto tool holder.

Motor rotates gear and ACME threaded rod, which drives the grip jaw and attached tool holder to the top position (approximately 29 feet) in the tool magazine.

Injector, coil tubing and magazine skid forward, 39½", to original position.

Magazine shuttles selected tool in-line with well centerline.

Injector, coil tubing and magazine skid back 39½", to engage gear.

Motor rotates gear and threaded rod, driving grip jaw and selected tool into the stand tube at well centerline.

Fly Down

ROV flies down with tool holder and attached tool. Lands it into the tool changer.

Tool changer pivots up, in-line with empty grip jaw at lowest position.

Tool changer extends to latch tool holder into grip jaw.

Threaded rod rotates, driving grip jaw and attached tool to top position.

Tool changer pivots down and retracts.

Injector, coil tubing and magazine skid back 39½" to engage gear.

Motor rotates gear and threaded rod, driving grip jaw and selected tool into the stand tube at well centerline.

Figure 30:
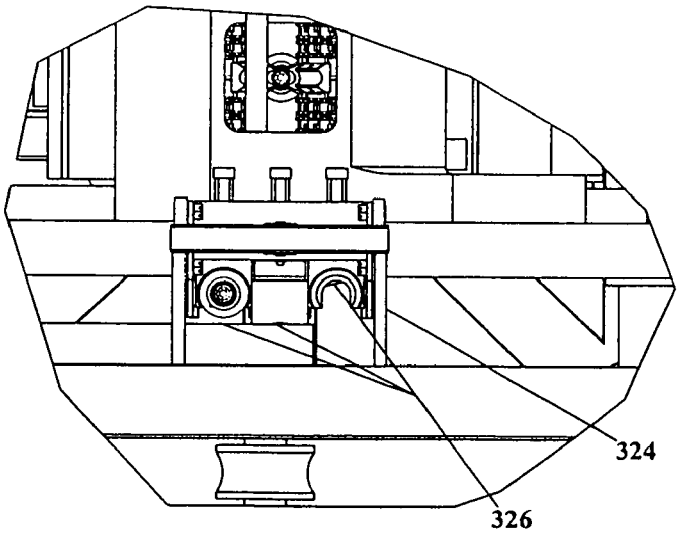

As shown in FIGS. 29 and 30, the tool changer assembly 324 may be located at the top of the SIM module and in front of the tool magazine 320. Tools 22 may be lowered from the ship and guided into the top of the tool changer via an ROV. In a preferred design, the tool changer has a plurality and preferably three loading receivers 326, which each translate horizontally and are inline with the spring-loaded jaws when in their uppermost position in the tool magazine. The three loading receivers 326 may be contained in a carriage capable of translating vertically. Vertical translation allows the loading receivers to lower and disengage from the tool or to raise and engage the tool. Horizontal translation also engages or disengages the tool from the spring-loaded jaw.

Pivoting Connection Method

Figure 52:
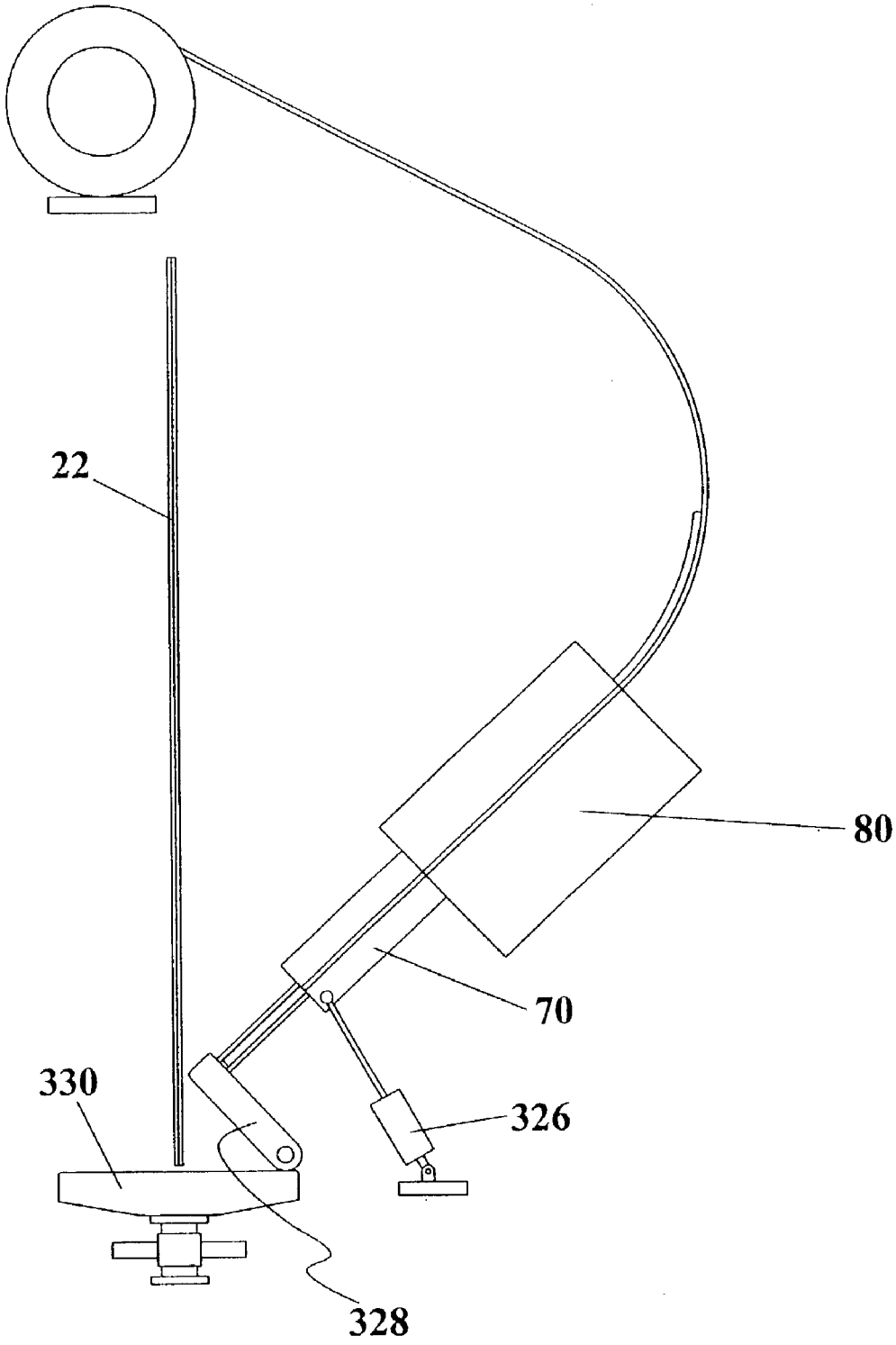
FIG. 52 shows an alternative method for loading tools into the well.
Figure 53:
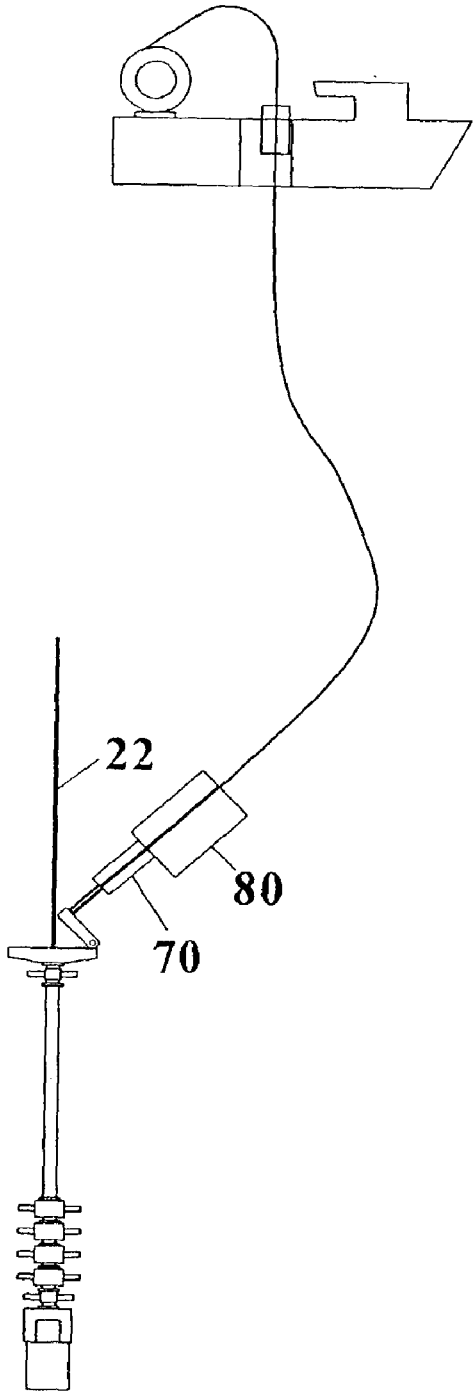
FIG. 53 illustrates tools being loaded onto a deployment vessel.
Figure 54:
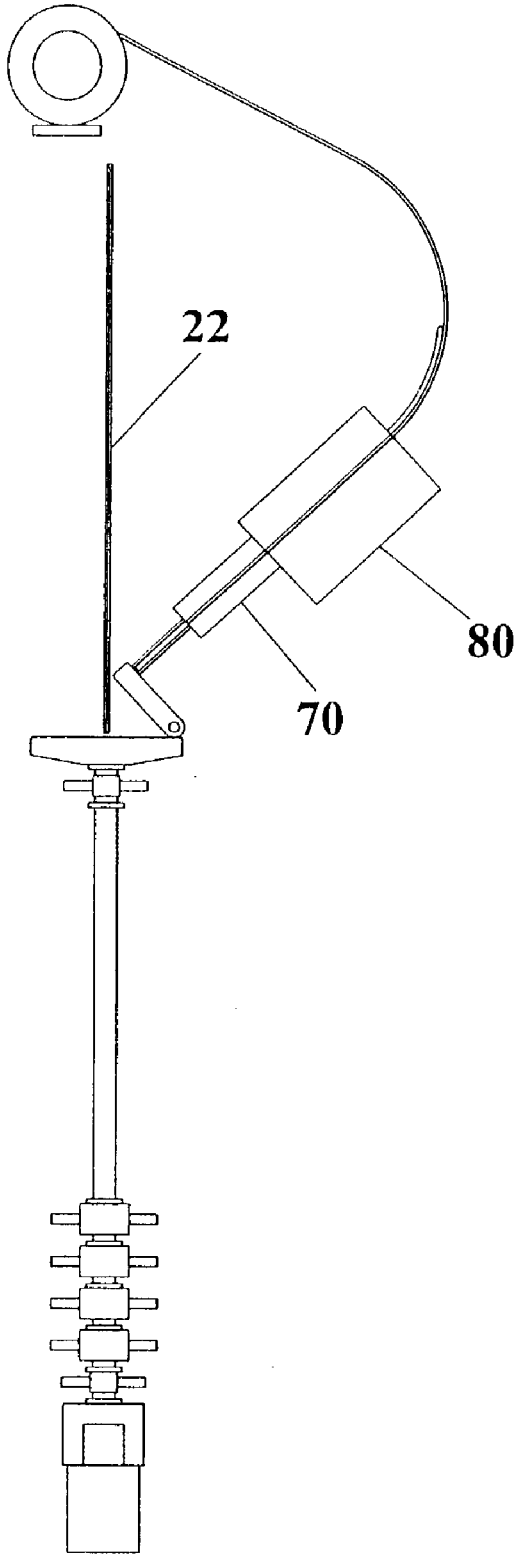
FIG. 54 shows a tubing reel subsea.

FIG. 52 shows an alternative method for loading tools into a well. In this Figure, the strippers 70 and injector 80 are pivoted to the side with positioning system 326 so that the tools can be loaded. The pivoting, top piece 328 seals with the base 330 located above the non-sealing ram. The non-sealing ram holds the tool during connection of the tool and coiled tubing line. This design may be used to load numerous tools with the reel on a deployment vessel, as shown in FIG. 53 or with the reel subsea, as shown in FIG. 54.

Y-Connection Method

Figure 55:
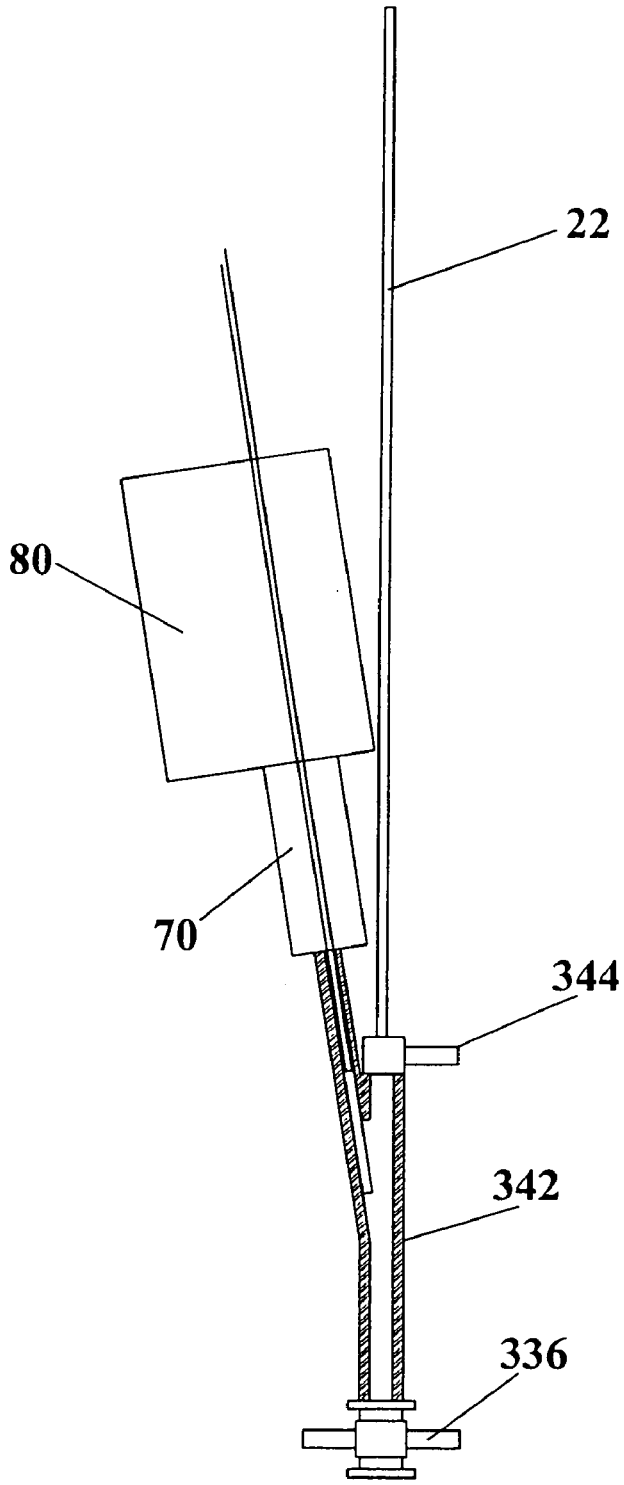
FIG. 55 illustrates an alternative method for loading tools into the well.

FIG. 55 shows an alternative method for loading tools into a well. In this figure, the connection between the coiled tubing and downhole tool is made in a y-connection system. The y-connector 342 is a pressure vessel with a gate valve 344 on top and a non-sealing ram 336. The gate valve opens and closes to add tools. The non-sealing ram 338 holds the tool during connection of the tool and the coiled tubing. An advantage of this design is that the reel, injector, and stripper assembly does not need to be translate back and forth or left to right. This design may be used to load numerous tools with the reel on the deployment vessel, similar to that shown in FIG. 53, or with the reel subsea, similar to that shown in FIG. 54.

A preferred embodiment of the intervention system provides both the subsea reel for the coiled string, the injector, and the tool positioning system within a module, which is discussed above as the CT module. The reel alternatively could be run in a separate module, in which case the center of gravity of the reel may be below the entirety of the injector. At least the injector, the tool positioning system and the injector positioning system are conveniently housed within a single module.

Various types of linear actuators have been disclosed for moving a selected tool from a plurality of stored tools to a run-in position, wherein the tool is over the BOP with the tool axis substantially aligned with the BOP axis. A system with similar actuators may be used in alternate embodiments for moving the injector from its run-in position above the BOP to its inactive position, thereby allowing the selected tool to be positioned in the run-in position. Also, the actuators on either the tool positioning system or the injector positioning system may be electrically powered, and thus all or part of the SIM need not require a hydraulic fluid system with pumps powered by electric motors, i.e., the electric motors controlled by a surface PCU may directly power the actuators.

For the application discussed above, the selected tool is run-in the well through the BOP on coiled tubing, which is a preferred embodiment for many applications, since fluid may be circulated through the downhole tool through the coil tubing string. In other applications, however, another type of coiled string may be used, such as a coiled wireline string, to run a selected tool in the well and to subsequently retrieve the selected tool from the well and return the tool to the bank stored subsea tools. In most applications, the intervention system will use one or more strippers or equivalent tools to control blowout pressure while running the tool into the well, i.e., some device for sealing with the axially moving string. There may be applications, however, where one or more strippers may not be required.

While preferred embodiments of the present invention have been illustrated in detail, it is apparent that other modifications and adaptations of the preferred embodiments will occur to those skilled in the art. However, it is to be expressly understood that such modifications and adaptations are within the spirit and scope of the present invention, which is defined in the following claims.

The invention claimed is:

1. A subsea intervention system for lowering a selected tool from a plurality of stored subsea tools through a subsea blowout preventor having a BOP axis and into a well on coiled string and for selectively withdrawing the tool from the well through the subsea blowout preventor and returning the selected tool to the plurality of the subsea tools, the system comprising: a subsea injector for moving the coiled string axially through the blowout preventor: one or more strippers for sealing with the axially moving string; a tool positioning system for moving the selected tool in a first linear direction substantially perpendicular to the BOP axis to a run-in position wherein the selected tool is above the blowout preventor with a tool axis substantially aligned with the BOP axis; and an injector positioning system for moving the injector from a run-in position wherein the injector is above the blowout preventor and an injector axis is substantially aligned with the BOP axis, to an inactive position for allowing the selected tool to occupy at least a portion of the BOP axis occupied by the injector when in the run-in position.

2. A subsea intervention system as defined in claim 1, further comprising: a subsea tool storage rack for storing at least some of the plurality of tools along a common plane substantially parallel to the BOP axis.

3. A subsea intervention system as defined in claim 2, wherein the tool positioning system further moves the selected tool in a second linear direction angled with respect to the first linear direction and substantially perpendicular to the BOP axis.

4. A subsea intervention system as defined in the claim 3, further comprising: a subsea tool storage rack for storing at least some of the plurality of tools along a common plane. substantially parallel to the BOP axis.

5. A subsea intervention system as defined in claim 1, wherein the tool positioning system moves the selected tool in the first linear direction with respect to a stationary tool storage rack.

6. A subsea intervention system as defined in claim 1, wherein the tool positioning system includes one or more fluid powered cylinders for moving the selected tool in the first linear direction.

7. A subsea intervention system as defined in claim 6, wherein the fluid powered cylinders are hydraulics cylinders movably responsive to hydraulic fluid pressure.

8. A subsea intervention system as defined in claim 1, wherein the tool positioning system includes one or more rack and pinion mechanisms for moving the selected tool in the first linear direction.

9. A subsea intervention system as defined in claim 1, wherein the tool positioning system moves the selected tool in a substantially vertical direction parallel to the BOP axis.

10. A subsea intervention system as defined in claim 9, wherein one or more fluid powered cylinders move the selected tool in the vertical direction.

11. A subsea intervention system as defined in claim 9, wherein one or more powered winches move the selected tool in the vertical direction.

12. A subsea intervention system as defined in claim 11, wherein each powered winch includes a chain drive mechanism for driving a chain to move the selected tool in the vertical direction.

13. A subsea intervention system as defined in claim 1, wherein the injector positioning system includes one or more fluid powered cylinders for moving the injector.

14. A subsea intervention system as defined in claim 1, wherein the injector positioning system includes a rack and pinion mechanism for moving the injector.

15. A subsea intervention system as defined in claim 1, wherein the injector positioning system includes a powered winch for moving the injector.

16. A subsea intervention system as defined in claim 1, wherein one or more linearly movable actuators move the selected tool in a substantially vertical direction.

17. A subsea intervention system as defined in claim 1, further comprising: the tool positioning system includes a plurality of actuators, a selected combination of activated actuators providing discreet positions for moving the selected tool in the first linear direction.

18. A subsea intervention system as defined in claim 17, wherein the plurality of actuators includes a plurality of fluid pressured cylinders for moving the selected tool to the first linear direction.

19. A subsea intervention system as defined in claim 17, wherein the plurality of actuators includes a plurality of fluid powered winch mechanisms for moving the selected tool in a direction substantially parallel to the BOP axis.

20. A subsea intervention system as defined in claim 1, wherein the one or more strippers move with the injector when moved to the inactive position.

21. A subsea intervention system as defined in claim 1, wherein the tool positioning system activates each of the plurality of actuators for moving the selected tool to linearly discreet positions.

22. A subsea intervention system as defined in claim 1, wherein the coiled string is stored on a subsea reel.

23. A subsea intervention system as defined in claim 22, wherein the reel is lowered subsea with the subsea injector.

24. A subsea intervention system as defined in claim 22, wherein a reel center of gravity is lower than a top of the injector.

25. A subsea intervention system as defined in claim 1, wherein the coiled string is one of a coiled tubing string and a coiled wireline.

26. A subsea intervention system as defined in claim 1, wherein the coiled string is a coiled tubing string.

27. A subsea intervention system as defined in claim 1, wherein each of the plurality of tools is stored in a substantially cylindrical tube with an open top.

28. A subsea intervention system as defined in claim 1, further comprising: a lower gate valve; an upper gate valve; and an axial length at each of the plurality of the tools is no greater than an axial spacing between the lower gate valve and the upper gate valve.

29. A subsea intervention system for lowering a selected tool from a plurality of stored subsea tools through a subsea blowout preventor having a BOP axis and into a well, and for selectively withdrawing the tool from the well, through the subsea blowout preventor and returning the selected tool to the plurality of stored subsea tools, further comprising: a subsea injector for moving a coiled string through the blowout preventor; a tool positioning system for moving the selected tool from a storage position to a run-in position above the blowout preventor with a tool axis substantially aligned with the BOP axis; an injector positioning system for moving the injector from the run-in position wherein the injector is above the blowout preventor with an injector axis substantially aligned with the BOP axis, to an inactive position for allowing the selected tool to occupy at least a portion of the BOP axis occupied by the injector when in the run-in position; one or more subsea motors electrically powered by an electrical umbilical extending to the surface; and one or fluid pumps powered by the one or more motors, the pumps powering at least one of the tool positioning system and the injector positioning system.

30. A subsea intervention system as defined in claim 29, wherein the subsea intervention system is powered by at least one of the electrical umbilical extending to the surface and a subsea ROV.

31. A subsea intervention system as defined in claim 29, further comprising: the plurality of tools are arranged within one or more planes each substantially parallel to the BOP axis.

32. A subsea intervention system as defined in claim 29, further comprising: one or more strippers for sealing with the axially moving string.

33. A subsea intervention system as defined in claim 29, wherein the coiled string is a coiled tubing string.

34. A subsea intervention system as defined in claim 29, wherein the coil string is stored on a subsea reel.

35. A subsea intervention system as defined in claim 34, wherein a reel center of gravity is lower than a top of the injector.

36. A subsea intervention system as defined in claim 31, further comprising: a lower gate valve; an upper gate valve; and an axial length at each of the plurality of the tools is no greater than an axial spacing between the lower gate valve and the upper gate valve.

37. A subsea intervention system as defined in claim 29, wherein each of the plurality of tools is stored in a substantially cylindrical tube with an open top.

38. A subsea intervention system for lowering a selected tool from a plurality of stored subsea tools through a subsea blowout preventor having a BOP axis and into a well, and for selectively withdrawing the tool from the well, through the subsea blowout preventor and returning the selected tool to the plurality of stored subsea tools, further comprising: a subsea injector for moving a coiled string through the blowout preventor; a tool positioning system for moving the selected tool from a storage position to a run-in position above the blowout preventor with a tool axis substantially aligned with the BOP axis; an injector positioning system for moving the injector from the run-in position wherein the injector is above the blowout preventor with an injector axis substantially aligned with the BOP axis, to an inactive position for allowing the selected tool to occupy at least a portion of the BOP axis occupied by the injector when in the run-in position; and a BOP structural frame housing the blowout preventor, the structural frame substantially decoupling forces transmitted through the blowout preventor.

39. A subsea intervention system as defined in claim 38, wherein the structural frame sustains at least four times the forces transmitted through the blowout preventor.

40. A subsea intervention system as defined in claim 38, further comprising: one or more strippers for sealing with the axially moving string.

41. A subsea intervention system as defined in claim 38, wherein the coiled string is a coiled tubing string.

42. A subsea intervention system as defined in claim 38, wherein the coiled string is stored on a subsea reel.

43. A subsea intervention system as defined in claim 38, wherein a reel center of gravity is lower than a top of the injector.

44. A subsea intervention system as defined in claim 38, further comprising: a lower gate valve; an upper gate valve; and an axial length at each of the plurality of the tools is no greater than an axial spacing between the lower gate valve and the upper gate valve.

45. A subsea intervention system for lowering a selected tool from a plurality of stored subsea tools through a subsea blowout preventor having a BOP axis and into a well, and for selectively withdrawing the tool from the well, through the subsea blowout preventor and returning the selected tool to the plurality of stored subsea tools, further comprising: a subsea injector for moving the selected tool through the blowout preventor; a lower gate valve; a tool latching device to latch the selected tool to a coiled string; a tool positioning system for moving the selected tool from a storage position to a run-in position above the blowout preventor with a tool axis substantially aligned with the BOP axis; an injector positioning system for moving the injector from the run-in position wherein the injector is above the blowout preventor with an injector axis substantially aligned with the BOP axis, to an inactive position for allowing the selected tool to occupy at least a portion of the BOP axis occupied by the injector when in the run-in position; and an axial length of each of the plurality of tools is no greater than an axial spacing between the lower gate valve and the tool latching device.

46. A subsea intervention system as defined in claim 45, further comprising: one or more strippers for sealing with the axially moving string.

47. A subsea intervention system as defined in claim 45, wherein the coiled string is a coiled tubing string.

48. A subsea intervention system as defined in claim 45, wherein the coiled string is stored on a subsea reel.

49. A subsea intervention system for lowering a selected tool from a plurality of stored subsea tools through a subsea blowout preventor having a BOP axis and into a well, and for selectively withdrawing the tool from the well, through the subsea blowout preventor and returning the selected tool to the plurality of stored subsea tools, further comprising: a subsea injector for moving the selected tool through the blowout preventor; a tool positioning system for moving the selected tool from a storage position to a run-in position above the blowout preventor with a tool axis substantially aligned with the BOP axis; an injector positioning system for moving the injector from the run-in position wherein the injector is above the blowout preventor with an injector axis substantially aligned with the BOP axis, to an inactive position for allowing the selected tool to occupy at least a portion of the BOP axis occupied by the injector when in the run-in position; and a subsea coiled string reel with a reel center of gravity lower than a top of the injector.

50. A subsea intervention system as defined in claim 49, further comprising: one or more strippers for sealing with the axially moving string.

51. A subsea intervention system as defined in claim 49, wherein the coiled string is a coiled tubing string.

52. A subsea intervention system as defined in claim 49, wherein the coiled string is stored on a subsea reel.

53. A subsea intervention system for lowering a selected tool from a plurality of stored subsea tools through a subsea blowout preventor having a BOP axis and into a well, and for selectively withdrawing the tool from the well, through the subsea blowout preventor and returning the selected tool to the plurality of stored subsea tools, further comprising: a subsea injector for moving the selected tool through the blowout preventor; a tool positioning system for moving the selected tool from a storage position to a run-in position above the blowout preventor with a tool axis substantially aligned with the BOP axis; an injector positioning system for moving the injector from the run-in position wherein the injector is above the blowout preventor with an injector axis substantially aligned with the BOP axis, to an inactive position for allowing the selected tool to occupy at least a portion of the BOP axis occupied by the injector when in the run-in position; and a circulation system for flushing the selected tool with fluid while substantially aligned with the well.

54. A subsea intervention system as defined in claim 53, further comprising: one or more strippers for sealing with the axially moving string.

55. A subsea intervention system as defined in claim 53, wherein the coiled string is a coiled tubing string.

56. A subsea intervention system as defined in claim 53, wherein the coiled string is stored on a subsea reel.

57. A subsea intervention system as defined in claim 53, further comprising: a lower gate valve; an upper gate valve; and an axial length at each of the plurality of the tools is no greater than an axial spacing between the lower gate valve and the upper gate valve.

58. A subsea intervention system for lowering a selected tool from a plurality of stored subsea tools through a subsea blowout preventor having a BOP axis and into a well, and for selectively withdrawing the tool from the well, through the subsea blowout preventor and returning the selected tool to the plurality of stored subsea tools, further comprising: a subsea injector for moving the selected tool through the blowout preventor; a tool positioning system for moving the selected tool from a storage position to a run-in position above the blowout preventor with a tool axis substantially aligned with the BOP axis; an injector positioning system for moving the injector from the run-in position wherein the injector is above the blowout preventor with an injector axis substantially aligned with the BOP axis, to an inactive position for allowing the selected tool to occupy at least a portion of the BOP axis occupied by the injector when in the run-in position; a pivoting mechanism for moving the injector from a run-in position to allow the selected tool to be positioned above the blowout preventor.

59. A subsea intervention system as defined in claim 58, further comprising: one or more strippers for sealing with the axially moving string.

60. A subsea intervention system as defined in claim 58, wherein the coiled string is a coiled tubing string.

61. A subsea intervention system as defined in claim 58, wherein the coiled string is stored on a subsea reel.

62. A subsea intervention system for lowering a selected tool from a plurality of stored subsea tools through a subsea blowout preventor having a BOP axis and into a well, and for selectively withdrawing the tool from the well, through the subsea blowout preventor and returning the selected tool to the plurality of stored subsea tools, further comprising: a subsea injector for moving the selected tool through the blowout preventor; a tool positioning system for moving the selected tool from a storage position to a run-in position above the blowout preventor with a tool axis substantially aligned with the BOP axis; an injector positioning system for moving the injector from the run-in position wherein the injector is above the blowout preventor with an injector axis substantially aligned with the BOP axis, to an inactive position for allowing the selected tool to occupy at least a portion of the BOP axis occupied by the injector when in the run-in position; and a Y-mechanism for placing the injector in parallel with the selected tool when in the run-in position.

63. A subsea intervention system as defined in claim 62, further comprising: one or more strippers for sealing with the axially moving string.

64. A subsea intervention system as defined in claim 62, wherein the coiled string is stored on a subsea reel.

65. A subsea intervention system as defined in claim 62, wherein the coiled string is a coiled tubing string.

66. A method of operating subsea intervention system to lower a selected tool from a plurality of stored subsea tools through a subsea blowout preventor having a BOP axis and into a well on coiled string and to selectively withdraw the tool from the well through the subsea blowout preventor and return the selected tool to the plurality of the subsea tools, the method comprising: providing a subsea injector for moving the coiled string axially through the blowout preventor; providing one or more strippers for sealing with the axially moving string; moving the selected tool in a first linear direction substantially perpendicular to the BOP axis to a run-in position wherein the selected tool is above the blowout preventor with a tool axis substantially aligned with the BOP axis; and moving the injector from a run-in position wherein the injector is above the blowout preventor and an injector axis is substantially aligned with the BOP axis, to an inactive position for allowing the selected tool to occupy at least a portion of the BOP axis occupied by the injector when in the run-in position.

67. A method as defined in claim 66, further comprising: providing a subsea tool storage rack for storing at least some of the plurality of tools along a common plane substantially parallel to the BOP axis.

68. A method as defined in claim 67, wherein the selected tool is moved in a second linear direction angled with respect to the first linear direction and substantially perpendicular to the BOP axis.

69. A method as defined in the claim 68, further comprising: providing a subsea tool storage rack for storing at least some of the plurality of tools along a common plane substantially parallel to the BOP axis.

70. A method as defined in claim 66, wherein the selected tool is moved in the first linear direction with respect to a stationary tool storage rack.

71. A method as defined in claim 66, wherein one or more fluid powered cylinders move the selected tool in the first linear direction.

72. A method as defined in claim 66, wherein one or more rack and pinion mechanisms move the selected tool in the first linear direction.

73. A method as defined in claim 66, wherein the selected tool is moved in a substantially vertical direction parallel to the BOP axis.

74. A method as defined in claim 73, wherein one or more fluid powered cylinders move the selected tool in the vertical direction.

75. A subsea intervention system as defined in claim 66, wherein one or more powered winches move the selected tool in the vertical direction.

76. A method as defined in claim 75, wherein a chain drive mechanism drives a chain to move the selected tool in the vertical direction.

77. A method as defined in claim 73, wherein one or more fluid powered cylinders move the selected tool in the vertical direction.

78. A method as defined in claim 66, wherein one or more fluid powered cylinders move the injector.

79. A method as defined in claim 66, wherein a rack and pinion mechanism moves the injector.

80. A method as defined in claim 66, wherein a powered winch moves the injector.

81. A method as defined in claim 66, further comprising: providing a plurality of actuators, a selected combination of activated actuators providing discreet positions for moving the selected tool in the first linear direction.

82. A method as defined in claim 81, wherein a plurality of fluid powered cylinders move the selected tool to the first linear direction.

83. A method as defined in claim 81, wherein a plurality of fluid powered winch mechanisms move the selected tool in a direction substantially parallel to the BOP axis.

84. A method as defined in claim 81, wherein one or more strippers move with the injector when moved to the inactive position.

85. A method as defined in claim 81, wherein the plurality of actuators are activated to move the selected tool to linearly discreet positions.

86. A method as defined in claim 66, wherein the coiled string is stored on a subsea reel.

87. A method as defined in claim 66, wherein the reel is lowered subsea with the subsea injector.

88. A method as defined in claim 66, wherein a reel center of gravity is lower than a top of the injector.

89. A method as defined in claim 66, wherein the coiled string is one of the coiled tubing string and the coiled wireline.

90. A method as defined in claim 66, wherein the coiled string is a coiled tubing string.

91. A method as defined in claim 66, wherein each of the plurality of tools are stored in a substantially cylindrical tube with an open top.

92. A method as defined in claim 66, further comprising: providing a lower gate valve; providing an upper gate valve; and controlling an axial length at each of the plurality of the tools is no greater than an axial spacing between the lower gate valve and the upper gate valve.

93. A method of operating a subsea intervention system to lower a selected tool from a plurality of stored subsea tools through a subsea blowout preventor having a BOP axis and into a well, and to selectively withdraw the tool from the well, through the subsea blowout preventor and return the selected tool to the plurality of stored subsea tools, the method comprising: providing a subsea injector for moving the selected tool through the blowout preventor; moving the selected tool from a storage position to a run-in position above the blowout preventor with a tool axis substantially aligned with the B0P axis; moving the injector from the run-in position wherein the injector is above the blowout preventor with an injector axis substantially aligned with the BOP axis, to an inactive position for allowing the selected tool to occupy at least a portion of the BOP axis occupied by the injector when in the run-in position; electrically powering one or more subsea motors by an electrical umbilical extending to the surface; and providing the motors to drive one or more or fluid pumps, the pumps powering an intervention hydraulic system.

94. A methods as defined in claim 93, wherein the subsea intervention system is powered by at least one of the electrical umbilical extending to the surface and a subsea ROV.

95. A subsea intervention system as defined in claim 93, further comprising: storing a plurality at tools within one or more planes each substantially parallel to the BOP axis.

96. A method as defined in claim 93, further comprising: providing one or more strippers for sealing with the axially moving string.

97. A method as defined in claim 93, wherein the coiled string is a coiled tubing string.

98. A method as defined in claim 93, wherein the coiled string is stored on a subsea reel.

99. A method as defined in claim 98, wherein a reel center of gravity is lower than a top of the injector.

100. A method as defined in claim 93, further comprising: providing a lower gate valve; providing an upper gate valve; and controlling the axial length at each of the plurality of the tools is no greater than an axial spacing between the lower gate valve and the upper gate valve.

101. A method of operating a subsea intervention system to lower a selected tool from a plurality of stored subsea tools through a subsea blowout preventor having a BOP axis and into a well, and to selectively withdraw the tool from the well, through the subsea blowout preventor and return the selected tool to the plurality of stored subsea tools, the method comprising: providing a subsea injector for moving the selected tool through the blowout preventor; moving the selected tool from a storage position to a run-in position above the blowout preventor with a tool axis substantially aligned with the BOP axis; moving the injector from the run-in position wherein the injector is above the blowout preventor with an injector axis substantially aligned with the BOP axis, to an inactive position for allowing the selected tool to occupy at least a portion of the BOP axis occupied by the injector when in the run-in position; and housing the blowout preventor within a BOP structural frame, thereby substantially decoupling forces transmitted through the blowout preventor.

102. A method as defined in claim 101, wherein the structural frame sustains at least four times the forces transmitted through the blowout preventor.

103. A method as defined in claim 101, further comprising: providing one or more strippers for sealing with the axially moving string.

104. A method as defined in claim 101, wherein the coiled string is a coiled tubing string.

105. A method as defined in claim 101, wherein the coiled string is stored on a subsea reel.

106. A method as defined in claim 101, wherein a reel center of gravity is lower than a top of the injector.

107. A method as defined in claim 101, further comprising: providing a lower gate valve; providing an upper gate valve; and controlling an axial length at each of the plurality of the tools is no greater than an axial spacing between the lower gate valve and the upper gate valve.

108. A method of operating a subsea intervention system to lower a selected tool from a plurality of stored subsea tools through a subsea blowout preventor having a BOP axis and into a well, and to selectively withdraw the tool from the well, through the subsea blowout preventor and return the selected tool to the plurality of stored subsea tools, the method comprising: providing a subsea injector for moving the selected tool through the blowout preventor; moving the selected tool from a storage position to a run-in position above the blowout preventor with a tool axis substantially aligned with the BOP axis; moving the injector from the run-in position wherein the injector is above the blowout preventor with an injector axis substantially aligned with the BOP axis, to an inactive position for allowing the selected tool to occupy at least a portion of the BOP axis occupied by the injector when in the run-in position; and controlling an axial length of each of the plurality of tools to be no greater than an axial spacing between a gate valve and a latch.

109. A method as defined in claim 108, further comprising: providing one or more strippers for sealing with the axially moving string.

110. A method as defined in claim 108, wherein the coiled string is a coiled tubing string.

111. A method as defined in claim 108, wherein the coiled string is stored on a subsea reel.

112. A method of operating a subsea intervention system to lower a selected tool from a plurality of stored subsea tools through a subsea blowout preventor having a BOP axis and into a well, and to selectively withdraw the tool from the well, through the subsea blowout preventor and return the selected tool to the plurality of stored subsea tools, the method comprising: providing a subsea injector for moving the selected tool through the blowout preventor; moving the selected tool from a storage position to a run-in position above the blowout preventor with a tool axis substantially aligned with the BOP axis; moving the injector from the run-in position wherein the injector is above the blowout preventor with an injector axis substantially aligned with the BOP axis, to an inactive position for allowing the selected tool to occupy at least a portion of the BOP axis occupied by the injector when in the run-in position; and positioning a subsea coiled string reel below a top of the injector.

113. A method as defined in claim 112, further comprising: providing one or more strippers for sealing with the axially moving string.

114. A method as defined in claim 112, wherein the coiled string is a coiled tubing string.

115. A method as defined in claim 112, wherein the coiled string is stored on a subsea reel.

116. A method of operating a subsea intervention system to lower a selected tool from a plurality of stored subsea tools through a subsea blowout preventor having a BOP axis and into a well, and to selectively withdraw the tool from the well, through the subsea blowout preventor and return the selected tool to the plurality of stored subsea tools, the method comprising: providing a subsea injector for moving the selected tool through the blowout preventor; moving the selected tool from a storage position to a run-in position above the blowout preventor with a tool axis substantially aligned with the BOP axis; moving the injector from the run-in position wherein the injector is above the blowout preventor with an injector axis substantially aligned with the BOP axis, to an inactive position for allowing the selected tool to occupy at least a portion of the BOP axis occupied by the injector when in the run-in position; and providing a circulation system for flushing the selected tool with fluid while substantially aligned with the well.

117. A method as defined in claim 116, further comprising: providing one or more strippers for sealing with the axially moving string.

118. A method as defined in claim 116, wherein the coiled string is a coiled tubing string.

119. A method as defined in claim 116, wherein the coiled string is stored on a subsea reel.

120. A method as defined in claim 116, wherein a reel center of gravity is lower than a top of the injector.

121. A method as defined in claim 116, further comprising: providing a lower gate valve; providing an upper gate valve; and controlling an axial length at each of the plurality of the tools is no greater than an axial spacing between the lower gate valve and the upper gate valve.

122. A method of operating a subsea intervention system to lower a selected tool from a plurality of stored subsea tools through a subsea blowout preventor having a BOP axis and into a well, and to selectively withdraw the tool from the well, through the subsea blowout preventor and return the selected tool to the plurality of stored subsea tools, the method comprising: providing a subsea injector for moving the selected tool through the blowout preventor; moving the selected tool from a storage position to a run-in position above the blowout preventor with a tool axis substantially aligned with the BOP axis; moving the injector from the run-in position wherein the injector is above the blowout preventor with an injector axis substantially aligned with the BOP axis, to an inactive position for allowing the selected tool to occupy at least a portion of the BOP axis occupied by the injector when in the run-in position; providing a pivoting mechanism for moving the injector from a run-in position to allow the selected tool to be positioned above the blowout preventor.

123. A method as defined in claim 122, further comprising: providing one or more strippers for sealing with the axially moving string.

124. A method as defined in claim 122, wherein the coiled string is a coiled tubing string.

125. A method as defined in claim 122, wherein the coiled string is stored on a subsea reel.

126. A method of operating a subsea intervention system to lower a selected tool from a plurality of stored subsea tools through a subsea blowout preventor having a BOP axis and into a well, and to selectively withdraw the tool from the well, through the subsea blowout preventor and return the selected tool to the plurality of stored subsea tools, the method comprising: providing a subsea injector for moving the selected tool through the blowout preventor; moving the selected tool from a storage position to a run-in position above the blowout preventor with a tool axis substantially aligned with the BOP axis; moving the injector from the run-in position wherein the injector is above the blowout preventor with an injector axis substantially aligned with the BOP axis, to an inactive position for allowing the selected tool to occupy at least a portion of the BOP axis occupied by the injector when in the run-in position; and providing a Y-mechanism for placing the injector in parallel with the selected tool when in the run-in position.

127. A method as defined in claim 126, further comprising: providing one or more strippers for sealing with the axially moving string.

128. A method as defined in claim 126, wherein the coiled string is a coiled tubing string.

129. A method as defined in claim 126, wherein the coiled string is stored on a subsea reel.

* * * * *